US008072844B2

(12) United States Patent
Miyahara

(10) Patent No.: US 8,072,844 B2
(45) Date of Patent: Dec. 6, 2011

(54) ELECTRONIC TIMEPIECE WITH INTERNAL ANTENNA

(75) Inventor: Fumiaki Miyahara, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 534 days.

(21) Appl. No.: 12/361,646

(22) Filed: Jan. 29, 2009

(65) Prior Publication Data

US 2009/0201769 A1 Aug. 13, 2009

(30) Foreign Application Priority Data

Feb. 7, 2008 (JP) ..... 2008-027890
May 7, 2008 (JP) ..... 2008-121655
May 7, 2008 (JP) ..... 2008-121656

(51) Int. Cl.
*H01Q 7/08* (2006.01)
*G04C 11/02* (2006.01)

(52) U.S. Cl. ..... 368/47; 343/788

(58) Field of Classification Search ..... 368/47; 343/787–788
See application file for complete search history.

(56) References Cited

U.S. PATENT DOCUMENTS 6,927,739 B2 * 8/2005 Nomura et al. ..... 343/788
7,436,372 B2 10/2008 Abe
7,511,679 B2 * 3/2009 Araki et al. ..... 343/788
7,515,112 B2 * 4/2009 Someya et al. ..... 343/788
7,724,199 B2 * 5/2010 Someya et al. ..... 343/788
2008/0080320 A1 * 4/2008 Abe et al. ..... 368/47

FOREIGN PATENT DOCUMENTS

EP 1523063 A1 4/2005
EP 1906270 A2 4/2008
JP 2005-269234 9/2005
JP 2006-053158 2/2006
JP 2007-184894 7/2007

* cited by examiner

*Primary Examiner* — Sean Kayes
(74) *Attorney, Agent, or Firm* — Mark P. Watson

(57) ABSTRACT

An electronic timepiece with an internal antenna has an antenna that has an elongated magnetic core formed from a magnetic body and a coil wound around the magnetic core, and can receive external wireless information, the magnetic core having a coil winding part to which the coil is wound in the lengthwise center part of the magnetic core, and a pair of lead parts extending from both ends of the coil winding part; a module that houses the antenna and processes the external wireless information; and a magnetic member that is positioned with a predetermined gap between the magnetic member and the lead part at a position that is not superposed on a coil-overlapping area that overlaps the coil winding part of the antenna and is superposed on at least a part of a lead-overlapping area that overlaps the pair of lead parts when the electronic timepiece with internal antenna is viewed in plan view from the timepiece thickness direction of the electronic timepiece with internal antenna.

20 Claims, 35 Drawing Sheets

| LOCATION OF AMORPHOUS FOIL MEMBER | IMPROVEMENT IN RECEPTION SENSITIVITY (COMPARED WITH NO AMORPHOUS FOIL MEMBER) |
|---|---|
| NOT SUPERPOSED TO COIL-OVERLAPPING AREA, SUPERPOSED TO LEAD-OVERLAPPING AREA | 2 dB |
| SUPERPOSED TO BOTH COIL-OVERLAPPING AREA AND LEAD-OVERLAPPING AREA | 0 dB |

FIG. 8

| LOCATION OF AMORPHOUS FOIL MEMBER | IMPROVEMENT IN RECEPTION SENSITIVITY (COMPARED WITH NO AMORPHOUS FOIL MEMBER) |
|---|---|
| NOT SUPERPOSED TO COIL-OVERLAPPING AREA, SUPERPOSED TO LEAD-OVERLAPPING AREA | 2 dB |
| SUPERPOSED TO BOTH COIL-OVERLAPPING AREA AND LEAD-OVERLAPPING AREA | 0 dB |

FIG.29

ELECTRONIC TIMEPIECE WITH INTERNAL ANTENNA

CROSS-REFERENCE TO RELATED APPLICATIONS

Japanese Patent application Nos. 2008-027890 filed Feb. 7, 2008, 2008-121655 file May 7, 2008, and 2008-121656 filed May 7, 2008 are hereby incorporated by reference in their entirety.

BACKGROUND

1. Field of Invention

The present invention relates to an electronic timepiece with an internal antenna enabling receiving external radio frequency signals through the antenna.

2. Description of Related Art

Electronic timepieces with an internal antenna are known from the literature. Typical of such timepieces is a radio-controlled timepiece that receives external radio frequency signals carrying time information from an external source and uses this information to adjust the time kept by the timepiece. In order to improve antenna performance in this type of electronic timepiece with an internal antenna, Japanese Unexamined Patent Appl. Pub. JP-A-2005-269234 and Japanese Unexamined Patent Appl. Pub. JP-A-2007-184894 teach configurations that improve the flux collection effect of the antenna.

The wristwatch described in Japanese Unexamined Patent Appl. Pub. JP-A-2005-269234 has an internal antenna that includes a laminated core part, a winding part having a wire wound around the laminated core, and end caps affixed to both ends of the laminated core part.

The wristwatch described in Japanese Unexamined Patent Appl. Pub. JP-A-2007-184894 uses a configuration having a core, a core case housing the core, a coil wound around the core case, and an amorphous thin film applied to a part of the core to which the coil is not wound.

With the configuration of the related art that attaches an end cap to both ends of the laminated core part of the antenna as described in Japanese Unexamined Patent Appl. Pub. JP-A-2005-269234, the end caps increase the size of the timepiece module accordingly and interfere with forming the timepiece thinner and smaller.

Furthermore, a problem with the configuration that affixes an amorphous thin film to the core as described in Japanese Unexamined Patent Appl. Pub. JP-A-2007-184894 is that the amorphous thin film becomes easily damaged when shock is applied to the timepiece. Damage to the thin film can be prevented by additionally providing a support member, but providing such a support member also increases the size of the timepiece.

SUMMARY OF INVENTION

With consideration for the foregoing problems, an electronic timepiece with an internal antenna according to the present invention improves the antenna characteristics without making the timepiece large.

An electronic timepiece with an internal antenna according to a first aspect of the invention has an antenna that has an elongated magnetic core formed from a magnetic body and a coil wound around the magnetic core, and can receive external wireless information, the magnetic core having a coil winding part to which the coil is wound in the lengthwise center part of the magnetic core, and a pair of lead parts extending from both ends of the coil winding part; a module that houses the antenna and processes the external wireless information; and a magnetic member that is positioned with a predetermined gap between the magnetic member and the lead part at a position that is not superposed on a coil-overlapping area that overlaps the coil winding part of the antenna and is superposed on at least a part of a lead-overlapping area that overlaps the pair of lead parts when the electronic timepiece with internal antenna is viewed in plan view from the timepiece thickness direction of the electronic timepiece with internal antenna.

In this aspect of the invention the magnetic member is positioned so that it is not superposed on the coil-overlapping area and is superposed on the lead-overlapping area. The coil-overlapping area and lead-overlapping area are areas that are respectively superposed with the coil winding part of the antenna and the lead parts of the antenna when the electronic timepiece with an internal antenna is seen in plan view from the thickness direction.

The thickness direction of the timepiece is the direction in which the outside dimension of the electronic timepiece with an internal antenna is smallest, such as the direction from the back cover to the crystal of a wristwatch.

By positioning a magnetic member that guides magnetic flux lines in the lead-overlapping area proximal to the lead parts, more magnetic flux lines can be collected in the magnetic member and the magnetic flux lines can be guided from the lead parts into the magnetic core.

The flux collection effect of the antenna can therefore be improved and reception performance can be improved. Because the magnetic member is not positioned in the coil-overlapping area, magnetic flux lines can be effectively collected in the lead parts at both ends of the magnetic core, and a secondary magnetic path can be easily formed from one end to the other end of the magnetic core. As a result, the reception performance of the antenna can be further improved.

An electronic timepiece with an internal antenna according to another aspect of the invention further preferably has a dial made from a nonconductive material, and the magnetic member has higher magnetic permeability than the dial and is positioned between the dial and the module.

In this aspect of the invention the magnetic member is located at a position not superposed to the coil-overlapping area and superposed to the lead-overlapping area between the module and the dial.

When seen in plan view, the position in which the magnetic member is located is not superposed on the coil and is superposed on the lead parts, and may be on the surface of the dial facing the module, the surface of the module facing the dial, or between the dial and the module.

Because a magnetic member with higher magnetic permeability than the dial is positioned in the lead-overlapping area proximally to the lead parts, more magnetic flux lines can be collected by the magnetic member, and these magnetic flux lines can be guided from the lead parts to the magnetic core.

Flux collection by the antenna can therefore be improved and reception performance can be improved. Because the magnetic member is not positioned in the coil-overlapping area, magnetic flux lines can be effectively collected in the lead parts at both ends of the magnetic core, and a secondary magnetic path can be easily formed from one end to the other end of the magnetic core. As a result, the reception performance of the antenna can be further improved.

The case member and back cover of a wristwatch are commonly metal, and external wireless information such as standard time signals can enter through the nonconductive crystal positioned on the dial side of the timepiece. By positioning a magnetic member between the dial and the module in a timepiece thus comprised, magnetic flux lines produced when receiving the external wireless information can be desirably collected by the magnetic member, and better reception performance can be achieved than when the magnetic member is positioned on the back cover side, for example.

In addition, because of how a timepiece is typically constructed, a drive mechanism for driving hands or other form of time display is commonly assembled on the back cover side of the module, and clockwork parts are not usually positioned on the dial side of the module. Other clockwork parts are therefore not typically positioned between the module and the dial, and space sufficient to accommodate the magnetic member can be easily assured.

In an electronic timepiece with an internal antenna according to another aspect of the invention the module has a base plate to which the antenna is fastened, and the magnetic member is positioned on the surface of the base plate that faces the dial.

In this aspect of the invention the magnetic member is positioned on the surface of the base plate that faces the dial. As described above, clockwork parts are not usually positioned between the base plate and dial, and space sufficient to accommodate the magnetic member can be easily assured on the surface of the base plate facing the dial. A recess, for example, for holding the magnetic member can therefore be easily formed in the surface of the base plate facing the dial, and the surface of the base plate opposite the dial can be easily formed flush by positioning the magnetic member in this recess. Therefore, because the base plate is flat, the surface of the base plate opposite the dial can be set in contact with the dial during timepiece assembly, and the timepiece can be formed thin.

In addition, by applying the magnetic member on the base plate, the magnetic member can be easily affixed to a suitable position relative to the antenna, and manufacturing productivity can be improved.

Furthermore, by positioning the magnetic member in the module, the tuning frequency of the antenna and the reception sensitivity of the antenna can be easily measured before the module is assembled into the case.

In an electronic timepiece with an internal antenna according to another aspect of the invention the magnetic member is positioned on the surface of the dial that faces the module.

As described above, clockwork parts are not usually positioned between the base plate and dial, and space sufficient to accommodate the magnetic member can be easily assured on the back side of the dial. Furthermore, because the back of the dial is flat, the magnetic member can be easily located in the desired position. In addition, because the dial is typically affixed to the module before being assembled in the timepiece case, the tuning frequency of the antenna and the reception sensitivity of the antenna can be easily measured before the module and dial are assembled into the case.

In an electronic timepiece with an internal antenna according to another aspect of the invention the module has a base plate to which the antenna is fastened, and the magnetic member is positioned on the surface of the base plate that faces the dial through an intervening adhesive layer.

In this aspect of the invention the magnetic member can be easily affixed through an intervening adhesive layer formed by applying an adhesive. Using an adhesive layer to hold the magnetic member also enables reducing the thickness compared with using a synthetic resin. The gap between the dial and the module can thus be further reduced, and a thin electronic timepiece with an internal antenna can be achieved.

In addition, when a recess is formed in the base plate and the magnetic member is adhesively affixed in this recess, the depth of the recess can be shallow, the base plate can be more easily manufactured, and a thin timepiece can be achieved without impinging on the space available on the base plate for positioning other timepiece components.

In an electronic timepiece with an internal antenna according to another aspect of the invention, the base plate comprises a through-hole communicating the lead-side surface opposite the lead parts and the dial-side surface opposite the dial in at least one part opposite the lead parts, and the magnetic member includes a flux collection unit positioned in an area larger than the lead-overlapping area on the dial-side surface of the base plate and covering the through-hole, and a magnetic field output unit that is laminated through the through-hole and projects toward the lead parts from the surface of the flux collection unit opposite the antenna.

In this aspect of the invention the flux collection unit positioned on the side of the base plate facing the dial can efficiently collect magnetic flux lines, and the magnetic flux lines can be guided by the magnetic field output unit laminated in the through-hole to the side of the base plate facing the lead parts. Magnetic flux lines can thus be more efficiently guided to the lead parts, and antenna performance can be further improved.

In an electronic timepiece with an internal antenna according to another aspect of the invention the module has a base plate on which the antenna is positioned, and one or more date wheels positioned on the surface of the base plate opposite the dial for displaying the date in a date display window formed in the dial, and the magnetic member is located in a position that is not superposed on the date wheel between the base plate and the dial.

In an electronic timepiece with an internal antenna that drives a date wheel positioned between the base plate and the dial to display the date according to this aspect of the invention, the magnetic member is positioned between the base plate and the dial. More specifically, in a configuration having a date wheel, a space of a certain size is required between the base plate and the dial to accommodate the thickness of the date wheel, and sufficient space can therefore be gained where the date wheel is not located in the space between the base plate and the dial. By positioning the magnetic member in this space, the space can be used efficiently, it is not necessary to form a recess for holding the magnetic member in the base plate, and the construction of the base plate is thus simplified.

An electronic timepiece with an internal antenna according to another aspect of the invention preferably also has an outside case having a back cover made of metal, and the magnetic member has higher magnetic permeability than the back cover and is positioned on the inside surface of the back cover opposite the module.

In this aspect of the invention a metal magnetic foil member is located on the inside surface of the back cover at a position that is not superposed to the coil-facing area (coil-overlapping area) opposite the coil winding part and is superposed to the lead-facing area (lead-overlapping area) opposite the lead parts.

Because the magnetic member is located at a position closest to the lead parts in this aspect of the invention, magnetic flux lines collected by the magnetic member are input to the antenna through the magnetic core, and the reception performance of the antenna is improved. Because the magnetic member is not positioned in the coil-overlapping area, magnetic flux lines can be effectively collected in the lead parts at both ends of the magnetic core, and a secondary magnetic path can be easily formed from one end to the other end of the magnetic core. As a result, the reception performance of the antenna can be further improved.

In an electronic timepiece with an internal antenna according to another aspect of the invention the magnetic member is adhesively affixed to the inside surface of the back cover by an intervening adhesive layer.

In this aspect of the invention the magnetic member can be easily affixed through an intervening adhesive layer formed by applying an adhesive. Using an adhesive layer to hold the magnetic member also enables reducing the thickness compared with using a synthetic resin. The gap between the back cover and the module can thus be further reduced, and a thin electronic timepiece with an internal antenna can be achieved.

In an electronic timepiece with an internal antenna according to another aspect of the invention the magnetic member is positioned on the inside surface of the back cover through an intervening nonconductive member.

When there is a sufficient gap between the back cover and antenna, this aspect of the invention enables positioning the magnetic member close to the antenna, further improving flux collection, and improving antenna performance. In addition, problems caused by part of the magnetic flux flowing from the magnetic member to the back cover and producing an eddy current in the back cover can be prevented. Furthermore, when shock is applied to the electronic timepiece with an internal antenna, the nonconductive member functions as a shock absorber, preventing stress from the back cover being applied directly to the magnetic member and thus preventing damage to the magnetic member.

In an electronic timepiece with an internal antenna according to another aspect of the invention the module comprises a circuit board on which is positioned a processing circuit unit for executing processes based on external wireless information received by the antenna, and the magnetic member has higher magnetic permeability than the circuit board and is positioned on the circuit board.

In this aspect of the invention the magnetic member is located at a position on the circuit board that is not superposed on the coil-overlapping area and is superposed on the lead-overlapping area. If the magnetic member is located at a position that is not superposed with the coil and is superposed with a part of the lead parts when seen in plan view, the magnetic member may be positioned on the front side of the circuit board opposite the antenna or on the back side opposite the back cover.

Because a magnetic member with higher magnetic permeability than the circuit board is positioned in the lead-overlapping area proximally to the lead parts, more magnetic flux lines can be collected by the magnetic member, and these magnetic flux lines can be guided from the lead parts to the magnetic core.

The flux collection effect of the antenna can therefore be improved and reception performance can be improved. Because the magnetic member is not positioned in the coil-overlapping area, magnetic flux lines can be effectively collected in the lead parts at both ends of the magnetic core, and a secondary magnetic path can be easily formed from one end to the other end of the magnetic core. As a result, the reception performance of the antenna can be further improved.

The circuit board is commonly positioned on the back cover side in the timepiece thickness direction, and by positioning the magnetic member on the circuit board, external wireless information such as standard time signals entering through the back cover can be desirably collected by the magnetic member if the back cover is made from glass or other nonconductive member. In addition, if the back cover is metal, external wireless information that enters from the crystal side and is not picked up by the antenna can be stopped by this magnetic member, travel around from the back cover side, and enter the antenna. The reception sensitivity of the antenna is thus good and antenna performance can be improved. Because the magnetic member can be positioned closer to the lead part of the antenna than in a configuration in which the magnetic member is positioned on the back cover, magnetic flux lines collected at the magnetic member can be better guided to the lead parts without escaping in a different direction, and antenna performance, including the reception sensitivity of the antenna, can be improved.

Furthermore, because few components of the processing circuit unit are positioned in the area of the circuit board proximal to the antenna in order to prevent a magnetic field from affecting the antenna, and the magnetic member is positioned in this area, the area of the magnetic member can be increased, and the flux collection effect can be improved. In addition, because the circuit board is flat, the magnetic member can be adhesively affixed more easily and productivity can be improved.

In an electronic timepiece with an internal antenna according to another aspect of the invention the magnetic member is adhesively affixed to the circuit board by an intervening adhesive layer.

In this aspect of the invention the magnetic member can be easily affixed through an intervening adhesive layer formed by applying an adhesive. Using an adhesive layer to hold the magnetic member also enables reducing the thickness compared with using a plastic sheet, for example, to affix the metal magnetic foil member. As a result, a thin electronic timepiece with an internal antenna can be achieved.

In addition, when a recess is formed in the base plate and the magnetic member is adhesively affixed in this recess, the depth of the recess can be shallow, the base plate can be more easily manufactured, and a thin timepiece can be achieved without impinging on the space available on the base plate for positioning other timepiece components.

In an electronic timepiece with an internal antenna according to another aspect of the invention the magnetic member is positioned on the antenna side of the circuit board opposite the antenna.

This aspect of the invention positions the magnetic member on the antenna side of the circuit board, and the magnetic member can thus be positioned closer to the lead parts of the antenna. Magnetic flux lines collected in the magnetic member can thus be guided more easily to the lead parts of the antenna, and antenna performance can be improved.

An electronic timepiece with an internal antenna according to another aspect of the invention preferably also has an outside case that houses the antenna and the circuit board and has a back cover. The circuit board is positioned between the antenna and the back cover, and the magnetic member is positioned on the back cover side of the circuit board opposite the back cover.

The circuit board is commonly positioned near the back cover in the timepiece thickness direction, and the capacitors, integrated circuit devices, wiring patterns, and other circuit elements populate the antenna side of the circuit board on the side that does not face the back cover. Because the circuit elements are not positioned on the back cover side of this circuit board opposite the back cover, space sufficient to accommodate the magnetic member can be assured.

Furthermore, a magnetic member with a large surface area can be positioned on the circuit board, more magnetic flux lines can thus be collected, and flux collection can be further improved.

In an electronic timepiece with an internal antenna according to another aspect of the invention the magnetic member includes a flux collection unit positioned in an area larger than the lead-overlapping area when seen in plan view, and a magnetic field output unit that is formed by laminating a plurality of magnetic foil members toward the lead parts at a position superposed with a part of the lead-overlapping area when seen in plan view.

In this aspect of the invention a flux collection unit with an area larger than the lead-overlapping area is located in a position not superposed with the coil-overlapping area and superposed with a part of the lead-overlapping area by, for example, a single thin magnetic body positioned on the back cover side of the circuit board.

Furthermore, because few components of the processing circuit unit are positioned on the back cover of the circuit board and the area of the flux collection unit can be increased, the flux collection unit can collect more magnetic flux lines, and the flux collection effect is improved.

In addition, a magnetic field output unit is formed in the lead-overlapping area on the antenna side of the circuit board, that is, at a position opposite the lead parts, by laminating a plurality of magnetic foil members in a stack that grows toward the lead parts. The magnetic field output unit thus formed proximally to the lead parts can desirably output the magnetic flux lines collected by the flux collection unit to the lead parts. The magnetic field output unit may be positioned in part of the lead-overlapping area on the antenna side without affecting the space needed to position other circuit elements on the antenna side of the circuit board.

As a result, magnetic flux lines efficiently collected in the flux collection unit can be desirably output from the magnetic field output unit to the lead parts, the flux density can be increased in the magnetic core, and antenna performance can be improved. In addition, the space used to position the magnetic member does not interfere with the placement of the circuit elements of the processing circuit, the dimensions of the electronic timepiece with an internal antenna are not increased, and the size of the electronic timepiece with an internal antenna can be reduced.

An electronic timepiece with an internal antenna according to another aspect of the invention preferably also has an outside case that houses the antenna and the circuit board and has a back cover, the circuit board being positioned between the antenna and the back cover, the flux collection unit being positioned on the back cover side of the circuit board opposite the back cover, and the magnetic field output unit being positioned on the antenna side of the circuit board opposite the antenna.

Because the flux collection unit is positioned on the back cover side of the circuit board where few circuit elements forming the processing circuits on the circuit board are positioned, the area of the flux collection unit can be increased as described above and more magnetic flux lines can be collected. In addition, because the magnetic field output unit is positioned on the antenna side of the circuit board, the magnetic field output unit can be positioned closer to the lead parts, and magnetic flux lines collected in the flux collection unit can be output more reliably to the lead parts. The flux collection effect can thus be further improved, and antenna performance can be further improved.

In an electronic timepiece with an internal antenna according to another aspect of the invention the circuit board comprises a through-hole passing from the antenna side to the back cover side in at least a part of the lead-overlapping area, the flux collection unit is positioned on the back cover side of the circuit board covering this through-hole, and the magnetic field output unit protrudes through the through-hole toward the lead part from the surface of the flux collection unit facing the antenna.

This aspect of the invention forms a through-hole in the circuit board and forms the magnetic field output unit in this through-hole. The magnetic field output unit and flux collection unit can thus be positioned in contact with each other, and magnetic flux lines collected by the flux collection unit can be guided directly to the magnetic field output unit. As a result, magnetic flux lines collected by the flux collection unit can be output more efficiently from the magnetic field output unit to the lead parts, the flux density of the magnetic core can be increased, and antenna performance can be further improved.

In an electronic timepiece with an internal antenna according to another aspect of the invention the magnetic member is an amorphous foil member made from an amorphous metal.

The amorphous foil member in this aspect of the invention is, for example, a cobalt-based amorphous metal such as Co—Fe—Ni—B—Si.

Amorphous metals have significantly higher magnetic permeability than the circuit board and the conductive materials (such as copper) used for the processing circuit, such as the wiring pattern. The flux collection effect can therefore be increased by using an amorphous foil member, more magnetic flux lines can be input to the antenna from the lead parts of the magnetic core, and antenna performance can be further improved.

In an electronic timepiece with an internal antenna according to another aspect of the invention the magnetic member is formed to a larger area than the lead-overlapping area when seen in plan view.

By using a magnetic member with an area larger than the lead-overlapping area, this aspect of the invention can collect magnetic flux lines from a broader area, and the flux collection effect can be improved. Therefore, more magnetic flux lines can be passed through the pair of lead parts to the magnetic core, antenna performance, including the reception sensitivity of the antenna, can be improved, and an antenna with desirable characteristics can be achieved.

In an electronic timepiece with an internal antenna according to another aspect of the invention the magnetic member is composed of a plurality of layers.

By laminating a plurality of magnetic members in a stack, this aspect of the invention increases the thickness of the magnetic member and can thus collect even more magnetic flux lines. The flux collection effect is thus improved and antenna performance is further improved.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 8 is a table showing the measured results of the reception sensitivity of the antenna of the radio-controlled timepiece according to the first embodiment of the invention, and the measured results of the reception sensitivity of the antenna in a radio-controlled timepiece having an amorphous foil member positioned overlapping both the coil-overlapping area and the lead-overlapping area.

FIG. 29 is a table showing the measured results of the reception sensitivity of the antenna of the radio-controlled timepiece according to the ninth embodiment of the invention, and the measured results of the reception sensitivity of the antenna in a radio-controlled timepiece having an amorphous foil member positioned overlapping both the coil-overlapping area and the lead-overlapping area.

DESCRIPTION OF THE PREFERRED EMBODIMENTS

Embodiment 1

Figure 1:
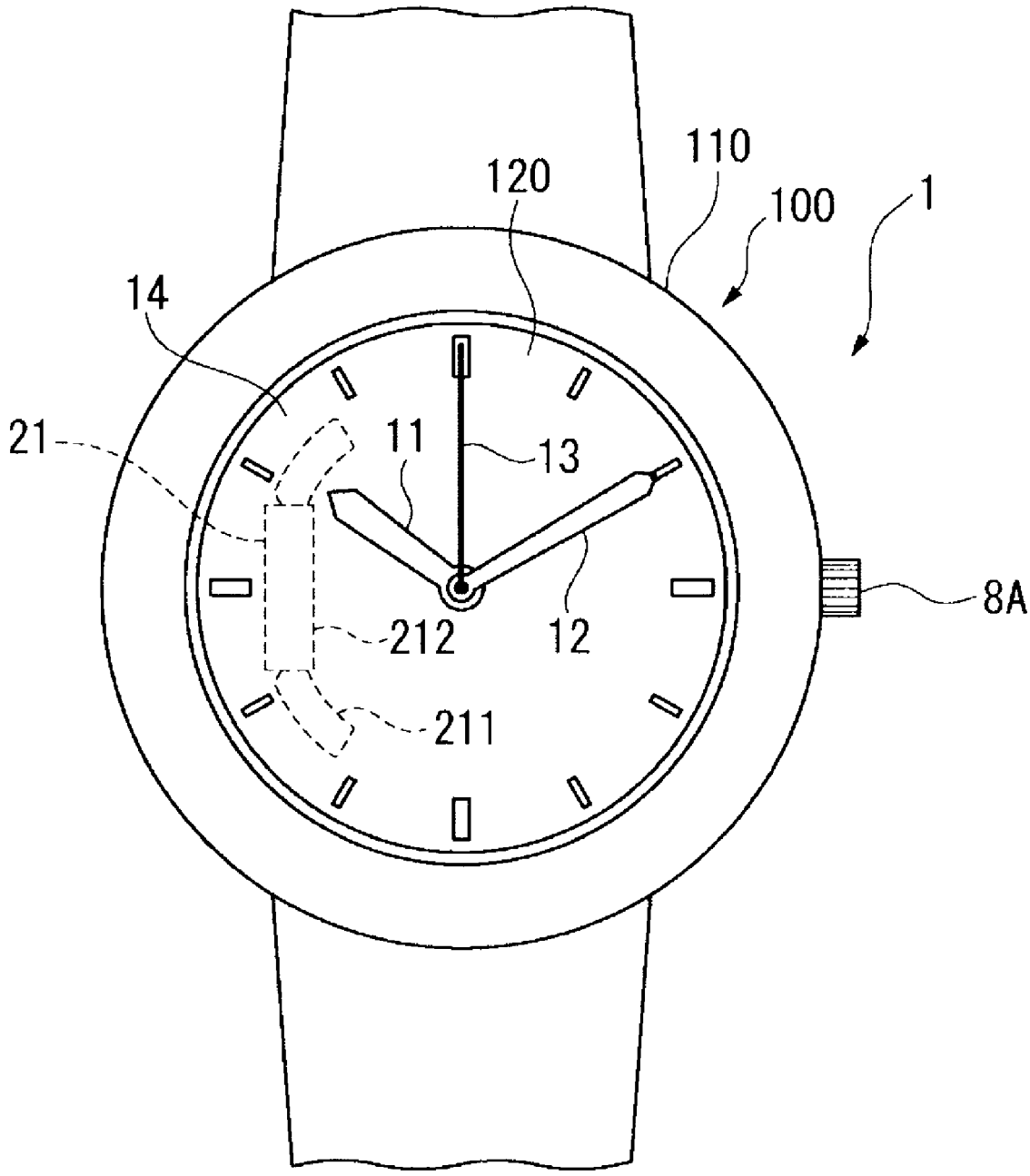
FIG. 1 is a front view of a radio-controlled timepiece as an example of an electronic timepiece with an internal antenna according to a preferred embodiment of the invention.

Preferred embodiments of the present invention are described below with reference to the accompanying figures. Note that parts that are functionally the same as parts that have already been described are identified by the same reference numerals, and further description thereof is omitted.

FIG. 1 is a front view of a radio-controlled timepiece as an example of an electronic timepiece with an internal antenna according to a preferred embodiment of the invention.

As shown in FIG. 1, a radio-controlled timepiece 1 according to a preferred embodiment of the invention is an analog timepiece with hands 11, 12, and 13 and a dial 14, and is a timepiece that can receive long-wave standard time signals as external radio frequency information containing time information, and can correct the positions indicated by the hands 11, 12, and 13 based on the received time information.

The radio-controlled timepiece 1 includes the hands 11, 12, and 13, the dial 14, a module 10 (see FIG. 2) including components for controlling an antenna 21 that receives the standard time signals and driving the hands 11, 12, and 13, and an external case 100 that houses thereinside the hands 11, 12, and 13, dial 14, and module 10.

The dial 14 is preferably made from a non-electrically conductive material such as plastic or ceramic so that the dial 14 does not interfere with standard time signal waves entering the timepiece from the crystal side and signals can be received with good reception.

Module Configuration

The module 10 used in the radio-controlled timepiece 1 is described below with reference to FIG. 2 to FIG. 7.

Figure 2:
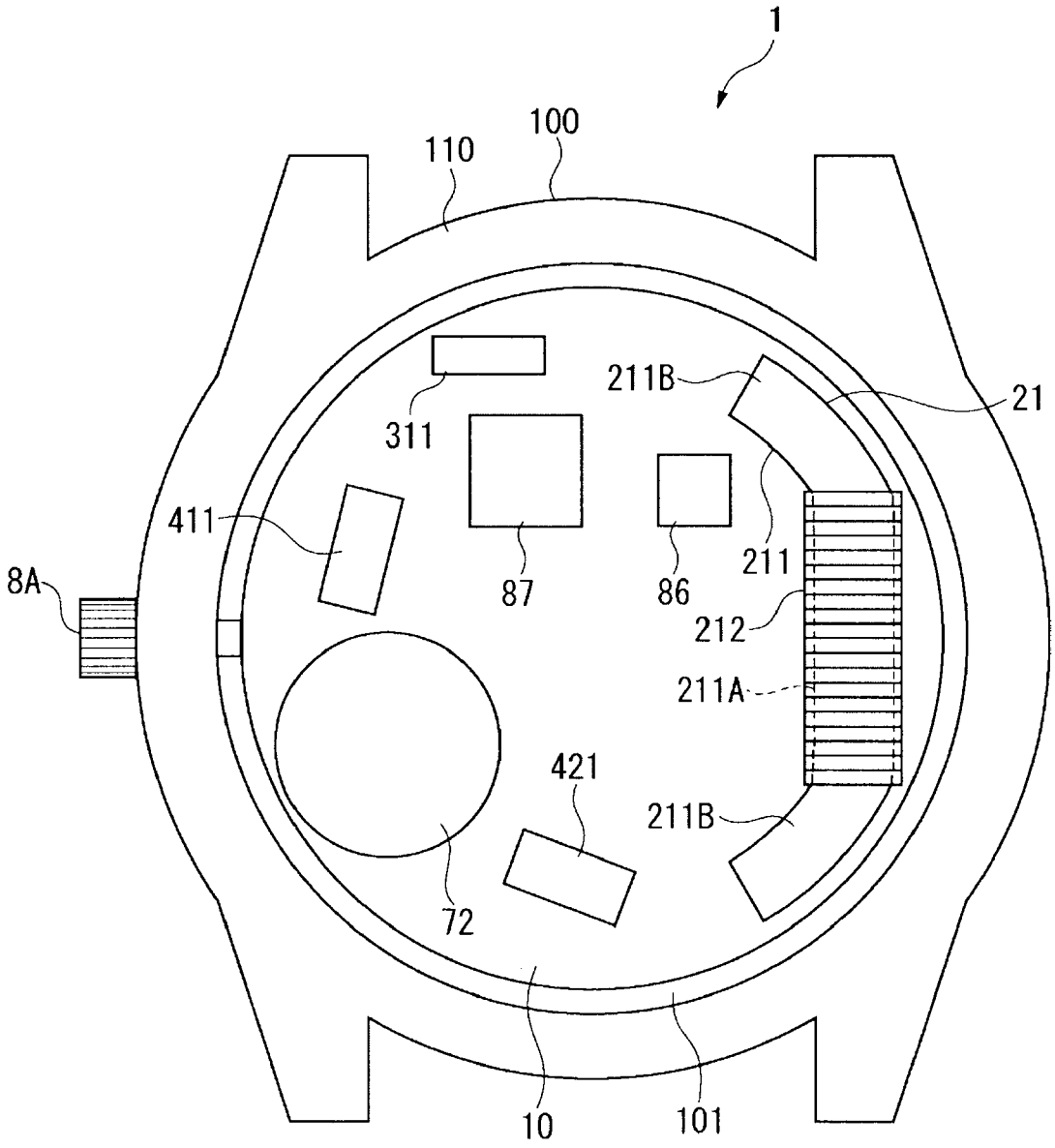
FIG. 2 is a schematic plan view from the back cover side of the radio-controlled timepiece according to the first embodiment of the invention.

FIG. 2 is a schematic plan view from the back cover side of the radio-controlled timepiece according to the first embodiment of the invention.

Figure 3:
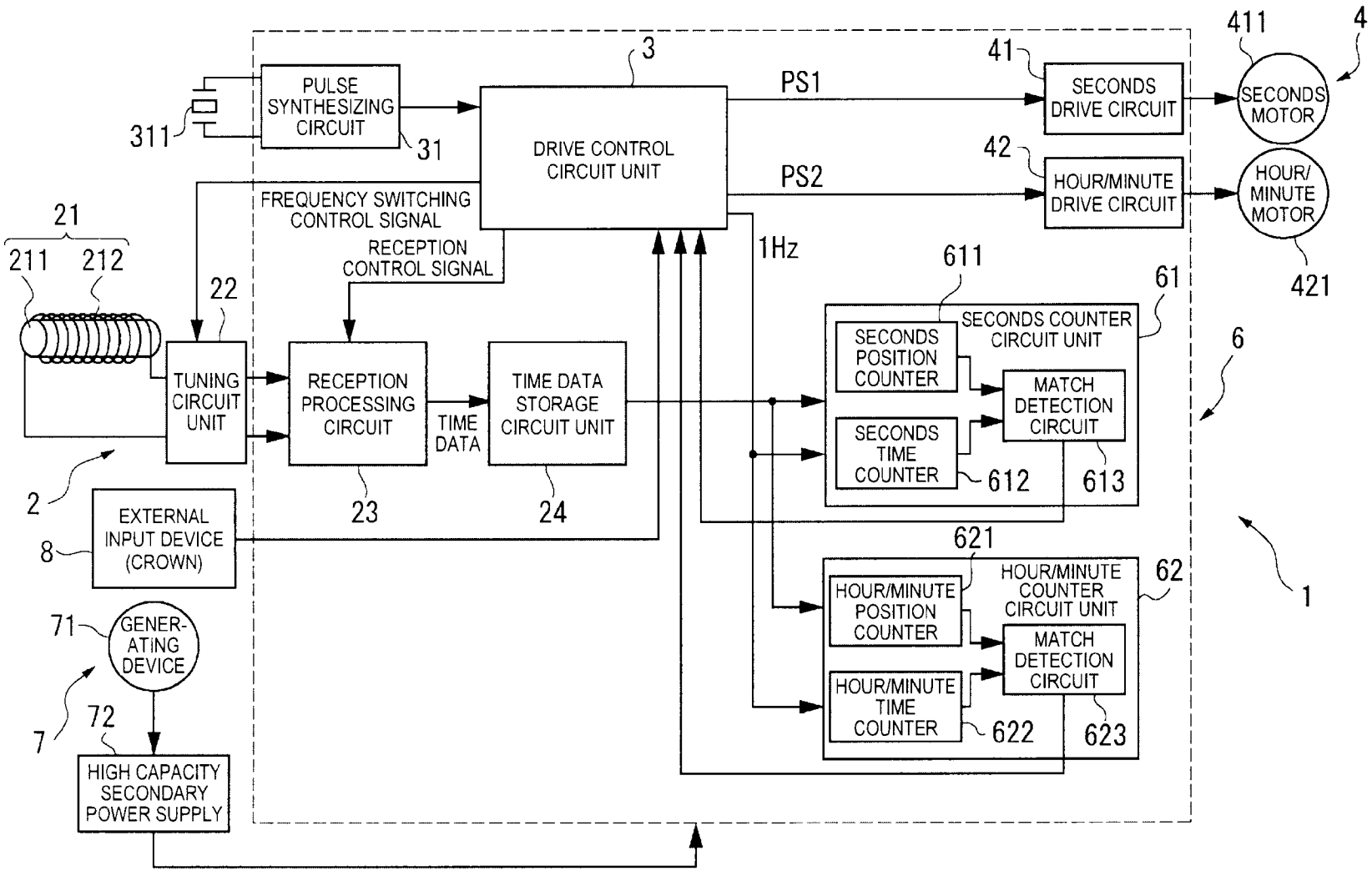
FIG. 3 is a schematic block diagram of the radio-controlled timepiece according to the first embodiment of the invention.

FIG. 3 is a schematic block diagram of the radio-controlled timepiece according to the first embodiment of the invention.

Figure 4:
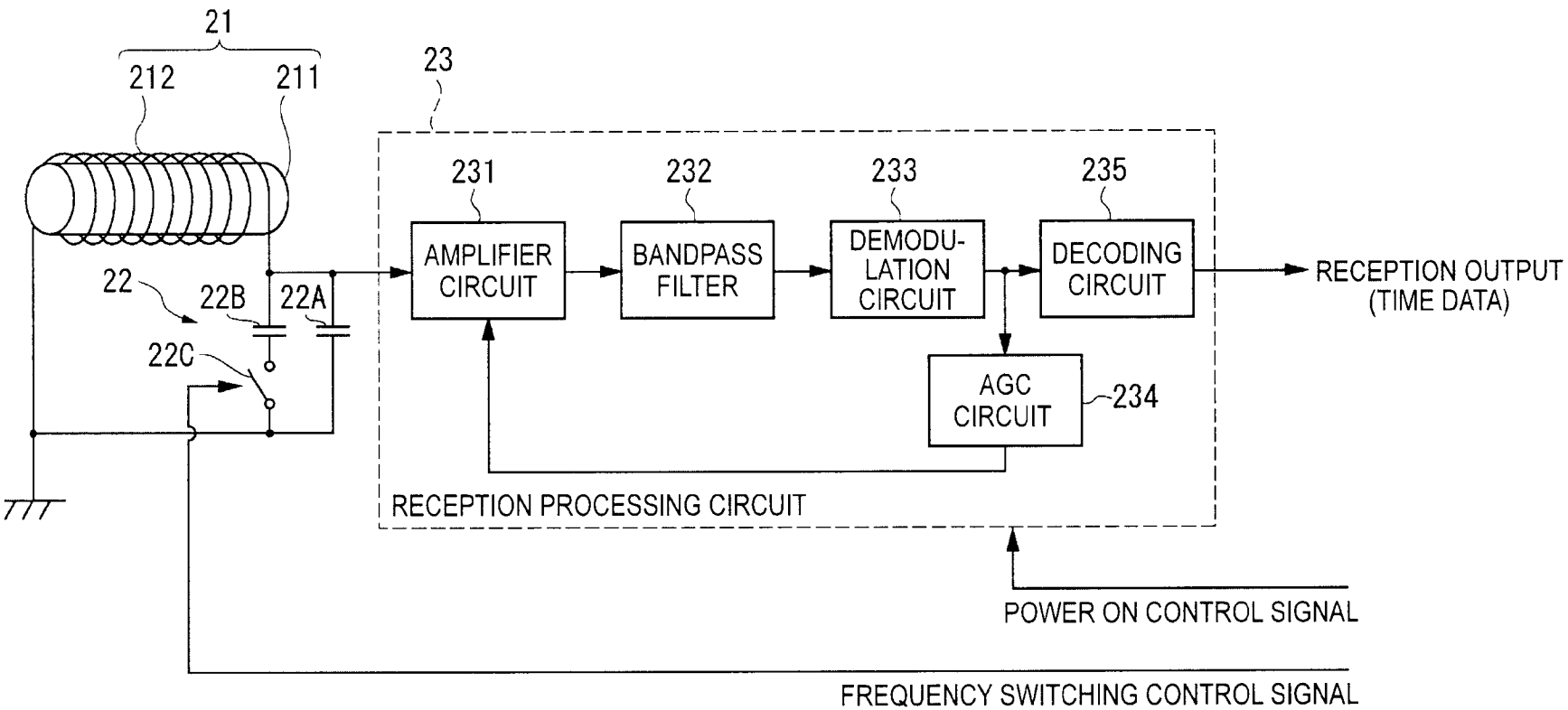
FIG. 4 is a schematic block diagram of the reception circuit unit of the radio-controlled timepiece according to the first embodiment of the invention.

FIG. 4 is a schematic block diagram of the reception circuit unit of the radio-controlled timepiece according to the first embodiment of the invention.

Figure 5:
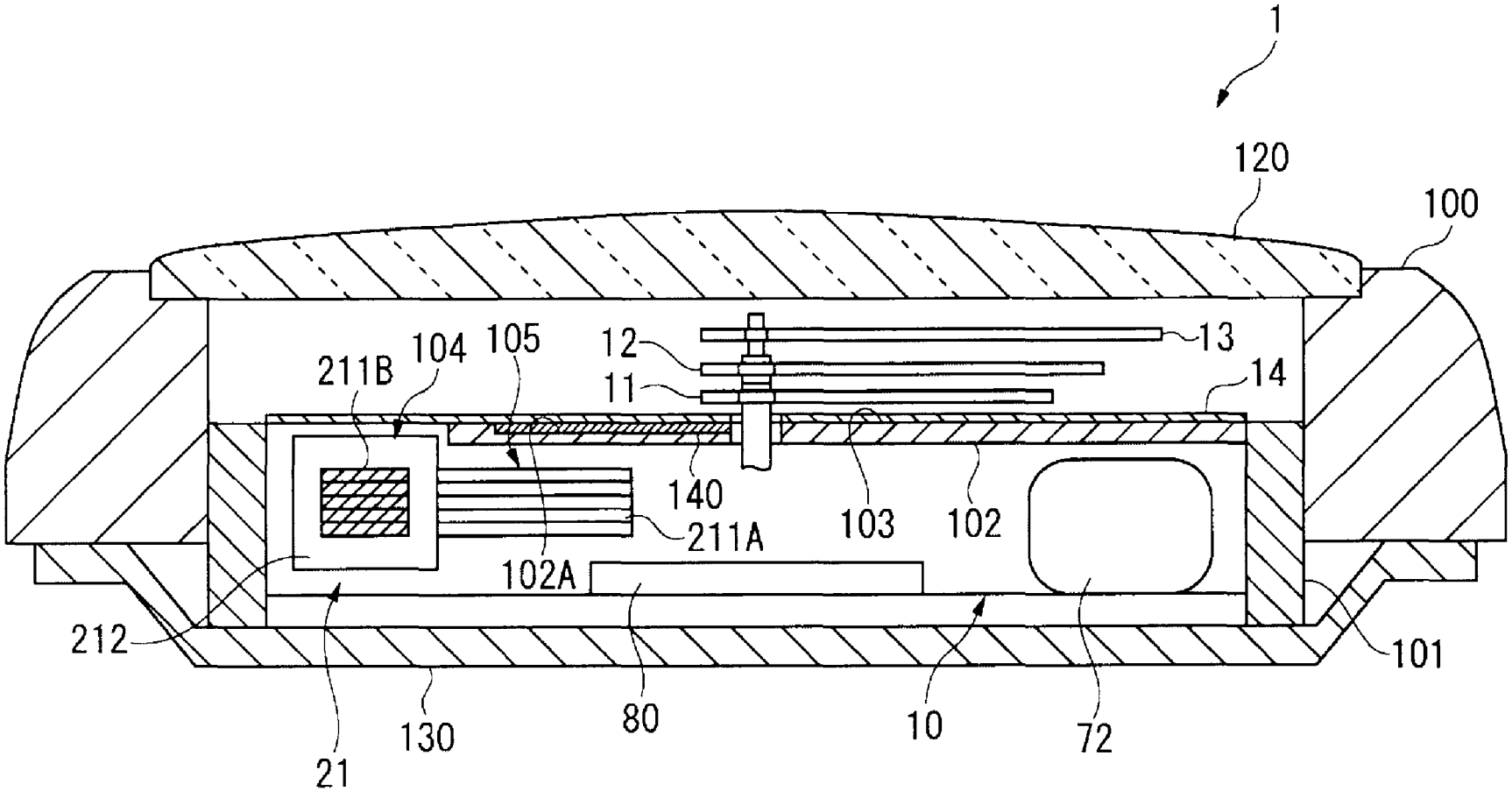
FIG. 5 is a side section view through the thickness of the radio-controlled timepiece according to the first embodiment of the invention.

FIG. 5 is a side section view through the thickness of the radio-controlled timepiece according to the first embodiment of the invention.

Figure 6:
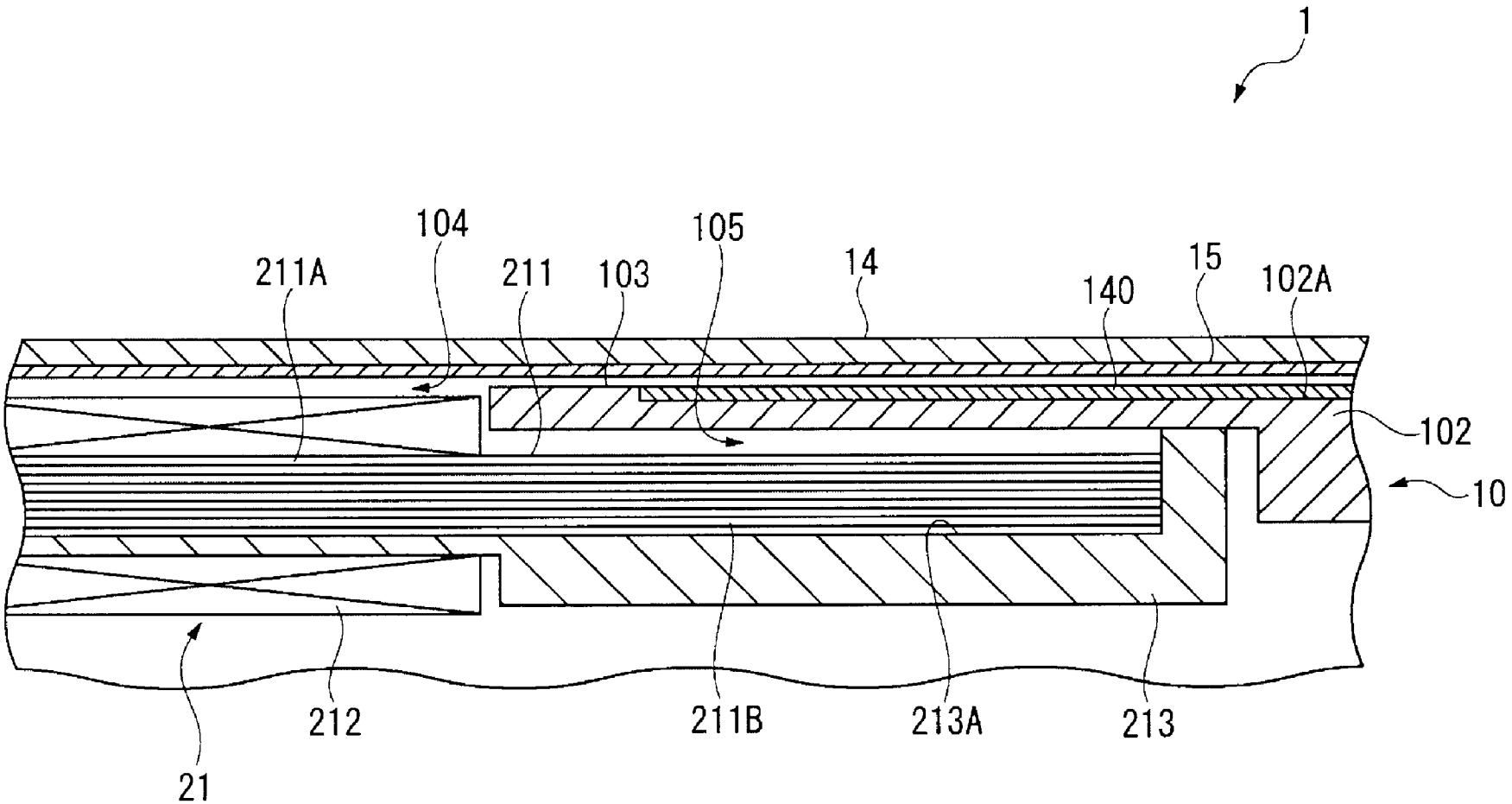
FIG. 6 is a section view through a position near the antenna in the radio-controlled timepiece according to the first embodiment of the invention.

FIG. 6 is a section view through a position near the antenna in the radio-controlled timepiece according to the first embodiment of the invention.

Figure 7:
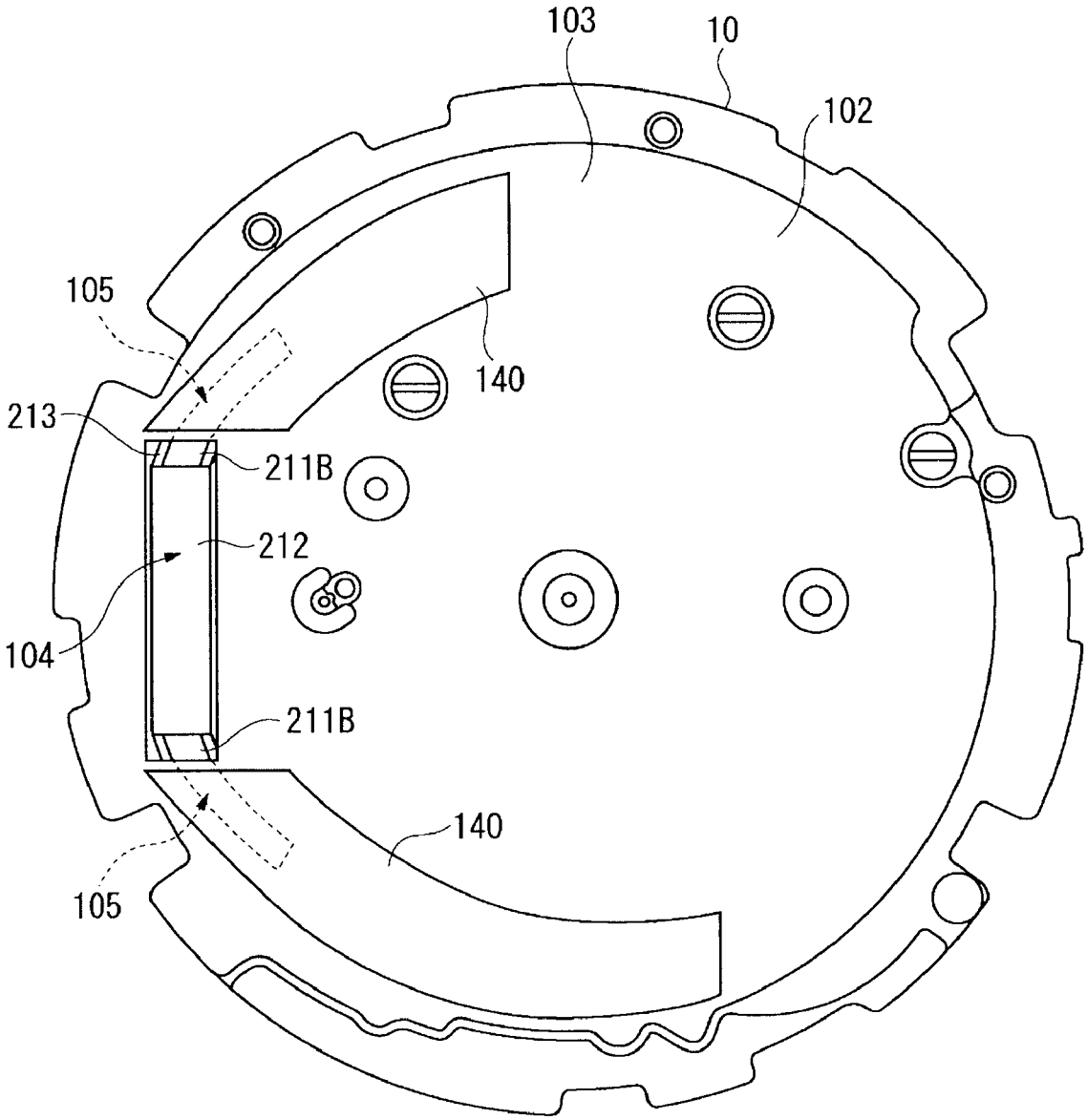
FIG. 7 is a front view of the base plate of the timekeeping module in the radio-controlled timepiece according to the first embodiment from the side facing the dial.

FIG. 7 is a front view of the base plate of the timekeeping module in the radio-controlled timepiece according to the first embodiment from the side facing the dial.

The module 10 has a plastic module spacer 101 that is round when seen in plan view (see FIG. 5), and is secured by being press fit, for example, to the inside of the external case 100.

Note that a plurality of bosses may be positioned projecting from the outside surface of the module spacer 101 so that when the module spacer 101 is housed in the external case 100, the bosses contact the inside circumference surface of the external case 100 and hold the module spacer 101 in place.

Assembled on the inside of the module spacer 101 in the module 10 are components including a circuit board 80 (see FIG. 5), the movement, a high capacity secondary power supply (storage battery) 72 forming a power supply 7, an antenna 21 for receiving signals, and a base plate 102 that supports the movement and antenna 21. The circuit board 80 is populated with devices including a reception chip 86 (see FIG. 2), a CPU 87 (see FIG. 2), and a reference oscillator 311 (see FIG. 3). The movement includes motors 411 and 421 that are part of the drive unit 4, and a wheel train.

Note that as shown in FIG. 6 the module 10 is housed in the casing 110 with the dial-side surface 103 of the base plate 102 facing the dial 14 substantially touching the solar cell 15 positioned on the back side of the dial 14.

As also shown in FIG. 3, the circuit devices positioned on the circuit board 80 include a reception processor 2 for processing the received signals, a drive control circuit unit 3, a drive unit 4 for driving the hands, and a counter unit 6 for counting the time.

The reception processor 2 includes the antenna 21 for receiving signals, a tuning circuit unit 22 composed of a capacitor and other components for tuning to the signal received by the antenna 21, a reception processing circuit 23 that processes information received by the antenna 21, and a time data storage circuit unit 24 that stores the time data processed by the reception processing circuit 23.

As shown in FIG. 4, the tuning circuit unit 22 includes two capacitors 22A and 22B parallel connected to the antenna 21 with one capacitor 22B connected to the antenna 21 through a switch 22C.

The frequency of the signal received by the antenna 21 can be changed by a frequency switching control signal that is output from the drive control circuit unit 3 and causes the switch 22C to turn on or off. This enables switching and receiving long-wave standard time signals of two different frequencies, such as the 40-kHz signals that are transmitted by the standard time signal transmission station at Mount Otakadoya (for eastern Japan) and the 60-kHz signals that are transmitted by the transmission station at Mount Hagane (for western Japan) in Japan.

As also shown in FIG. 4, the reception processing circuit 23 includes an amplifier circuit 231, a bandpass filter 232, a demodulation circuit 233, an automatic gain control (AGC) circuit 234, and a decoding circuit 235.

The amplifier circuit 231 amplifies the long-wave standard time signal received by the antenna 21. The bandpass filter 232 extracts the desired frequency component from the amplified long-wave standard time signal. The demodulation circuit 233 smoothes and demodulates the extracted long-wave standard time signal. The AGC circuit 234 controls the gain of the amplifier circuit 231 to keep the reception level of the long-wave standard time signal constant. The decoding circuit 235 then decodes and outputs the demodulated long-wave standard time signal.

The time data that is received and signal processed by the reception processing circuit 23 is output to and stored by the time data storage circuit unit 24 as shown in FIG. 3.

The reception processing circuit 23 starts receiving time information based on a reception control signal output from the drive control circuit unit 3 according to a predetermined reception schedule or when reception is started unconditionally by operation of an external input device 8.

As shown in FIG. 3, a pulse signal from the pulse synthesizing circuit 31 is input to the drive control circuit unit 3. The pulse synthesizing circuit 31 frequency divides a reference pulse from the reference oscillator 311, such as a crystal oscillator, to generate a clock pulse, and generates pulse signals of different pulse widths and timing from the reference pulse. The reference oscillator 311 is connected to the CPU 87 and produces a clock signal for the circuitry, and is located away from the antenna 21 because the clock signal frequency is near the frequency of the received long-wave standard time signal and produces noise if mixed with the signals received by the antenna 21.

The drive control circuit unit 3 outputs a seconds drive pulse signal PS1 that is output once a second for driving the second hand, and an hour/minute drive pulse signal PS2 that is output once a minute for driving the hour and minute hands, to the seconds drive circuit 41 and hour/minute drive circuit 42. Based on the pulse signals output from the drive control circuit unit 3, the drive circuits 41 and 42 drive the seconds motor 411 and hour/minute motor 421, which are stepping motors, thus driving the second hand and the minute and hour hands that are connected to the motors 411 and 421. The hands, dial, motors 411 and 421, and drive circuits 41 and 42 thus form a time display for displaying the time. Note that the time display may also drive the hour hand, minute hand, and second hand using a single motor.

The counter unit 6 includes a seconds counter circuit unit 61 for counting the seconds, and a hour/minute counter circuit unit 62 for counting the hour and minute.

The seconds counter circuit unit 61 includes a seconds position counter 611, a seconds time counter 612, and a match detection circuit 613. The seconds position counter 611 and seconds time counter 612 are both counters that loop at the 60 count, that is, every 60 seconds when a 1-Hz signal is input. The seconds position counter 611 counts the drive pulse signal (seconds drive pulse signal PS1) that is supplied from the drive control circuit unit 3 to the seconds drive circuit 41. More specifically, the position that is pointed to by the second hand is counted by counting the drive pulse signal that drives the second hand.

The seconds time counter 612 normally counts the 1-Hz reference pulse (clock pulse) that is output from the drive control circuit unit 3. If time data is received by the reception processor 2, the counter is adjusted to match the seconds value in the received time data.

The hour/minute counter circuit unit 62 similarly includes an hour/minute position counter 621, an hour/minute time counter 622, and a match detection circuit 623. The hour/minute position counter 621 and hour/minute time counter 622 are both counters that loop when signals equal to 24 hours are input. The hour/minute position counter 621 counts the drive pulse signal (hour/minute drive pulse signal PS2) that is supplied from the drive control circuit unit 3 to the hour/minute drive circuit 42, and counts the positions that are pointed to by the hour hand and minute hand.

The hour/minute time counter 622 normally counts a 1-Hz clock pulse that is output from the drive control circuit unit 3. More precisely, the hour/minute time counter 622 increments 1 when sixty 1-Hz pulses are counted. If time data is received by the reception processor 2, the counter is adjusted to match the hour and minute values in the received time data.

The match detection circuits 613 and 623 detect if the counts of the position counters 611 and 621 and the counts of the time counters 612 and 622 match, and output a detection signal indicating whether or not the counts match to the drive control circuit unit 3.

If a mismatch signal is input from the match detection circuits 613 and 623, the drive control circuit unit 3 continues outputting the drive pulse signals PS1 and PS2 until a match signal is input. If the 1-Hz reference signal from the drive control circuit unit 3 causes the count of the time counters 612 and 622 to change and a mismatch with the position counters 611 and 621 occurs during the normal timekeeping operation of the movement, the drive pulse signals PS1 and PS2 are output so that the hands move and the position counters 611 and 621 again match the time counters 612 and 622. This operation keeps repeating and the movement is controlled as usual.

When time counters 612 and 622 are adjusted to the received time data, the drive pulse signals PS1 and PS2 are output continuously and the hands are moved quickly and adjusted to the correct time until the counts of the position counters 611 and 621 and the time counters 612 and 622 match.

The power supply 7 is formed with a high capacity secondary power supply 72 that is connected to a solar cell 15 adhesively affixed to the back cover side of the dial 14 (the side facing the module 10) and stores power produced by the solar cell 15. The high capacity secondary power supply 72 may be a lithium ion battery or other type of secondary cell. A primary cell such as a silver oxide battery may alternatively be used as the power supply 7. Note that the high capacity secondary power supply 72 has a stainless steel case, and is positioned at a location near 3:00 o'clock separated from the antenna 21 inside the module 10 as shown in FIG. 2 in order to suppress its influence on antenna performance. Note that a solar battery panel with magnetic permeability low enough to not affect standard time signal reception is used for the solar cell 15.

The external input device 8 used for external input has a crown 8A and is used to set the time and start reception, for example.

As shown in FIG. 6, the antenna 21 has a magnetic core 211, a coil 212 wound around the magnetic core 211, and an antenna frame 213 that supports the magnetic core 211.

When seen in plan view as shown in FIG. 2, the antenna 21 has an elongated arc shape that is substantially concentric to the inside surface of the casing 110 forming the body of the external case 100, and is positioned at the 9:00 o'clock position of a timepiece along the inside surface of the module spacer 101.

The magnetic core 211 has an elongated shape conforming to the length of the antenna 21. The magnetic core 211 has a coil winding part 211A in the middle around which the coil 212 is wound, and lead parts 211B that extend from both ends of the coil winding part 211A.

The magnetic core 211 is made by adhesively stacking approximately 10 to 30 foil layers stamped or etched from a cobalt-based amorphous foil sheet (such as amorphous foil containing at least 50 wt % Co) as a magnetic foil member, and heat treating the foil layers by annealing, for example, to stabilize the magnetic characteristics. The magnetic core 211 is thus formed by stacking flat amorphous foil layers in the thickness direction of the timepiece. The magnetic core 211 is not limited to a layered amorphous foil construction, and may be made using a ferrite material that is shaped using a mold and then heat treated.

As shown in FIG. 6, the magnetic core 211 is supported by the antenna frame 213. The antenna frame 213 has a recessed core-holding-magnetic-member seat 213A corresponding to the shape of the magnetic core 211. The magnetic core 211 is adhesively affixed in the core-holding-magnetic-member seat 213A of the antenna frame 213 by an intervening adhesive layer formed by applying an adhesive, for example. A fastening part not shown is positioned on an end part of the antenna frame 213, and this fastening part is affixed to the base plate 102 to secure the antenna 21 in the module 10.

The antenna frame 213 is fastened to the base plate 102 so that the open part of the core-holding-magnetic-member seat 213A faces the base plate 102. This enables locating the magnetic core 211 closer to the dial side, which is the side of the timepiece from which the standard time signal is received. The magnetic core 211 is also fastened to the base plate 102 so that a gap of a predetermined size is formed between the magnetic core 211 and the base plate 102. This prevents damage to the antenna 21 because when the radio-controlled timepiece 1 is subject to shock the impact is not passed from the base plate 102 directly to the magnetic core 211.

The coil 212 must have an inductance of approximately 10 mH to receive long-wave standard time signals in the 40-77.5 kHz range. In this embodiment of the invention the coil 212 was made by wrapping several hundred winds of an approximately 0.1 μm diameter polyurethane-coated magnet wire around the core.

When the radio-controlled timepiece 1 is seen in plan view from the dial or back cover side, a coil-overlapping area 104 that overlaps the coil 212, and a lead-overlapping area 105 that overlaps the lead part 211B, are defined as shown in FIG. 7.

The antenna 21 and the reception chip 86 are connected by two leads. More specifically, the antenna 21 and the reception chip 86 are electrically connected by soldering the coil 212 at an end part of the antenna to the circuit board 80. This enables outputting the standard time signal received by the antenna 21 to the reception processor 2. Note that the electrical connection may alternatively be made by attaching a flexible circuit made of polyimide, for example, to the antenna 21, and fastening this circuit to the circuit board 80 with a screw.

As shown in FIG. 6 and FIG. 7, the amorphous foil member 140 is bonded as a magnetic member to the dial-side surface 103 of the base plate 102 facing the dial 14.

More specifically, when the inside of the radio-controlled timepiece 1 is seen in plan view from the dial or back cover side as shown in FIG. 6, recessed magnetic member seats 102A are formed in the dial-side surface 103 of the base plate 102 at positions that are outside of the coil-overlapping area 104 superposed on the coil 212 of the antenna 21, and are partially within the pair of lead-overlapping areas 105 that are superposed on the pair of lead parts 211B of the antenna 21. These two amorphous foil members 140 are formed extending in the direction in which the lead parts 211B project from the coil 212 (that is, away from the coil 212) when seen in plan view. The amorphous foil members 140 are larger in area than the lead-overlapping areas 105. The amorphous foil members 140 are also bonded to the dial-side surface 103 through an intervening adhesive layer.

This amorphous foil member 140 is a cobalt-based amorphous foil made of Co—Fe—Ni—B—Si, for example. The relative magnetic permeability of an amorphous foil member 140 made of a Co—Fe—Ni—B—Si cobalt-based amorphous foil, for example, is 20,000, and the permeability is significantly higher than the dial 14 and the solar cell 15. Ambient magnetic flux lines therefore collect in the amorphous foil members 140, the field strength rises, and more flux lines pass from the amorphous foil members 140 through the lead parts 211B into the magnetic core 211.

A test sample was prepared with the amorphous foil members 140 positioned on the base plate 102 at locations superimposed on the coil-overlapping area 104 and lead-overlapping area 105, and another sample was prepared with the amorphous foil members 140 not superimposed on the coil-overlapping area but superimposed on the lead-overlapping area. The reception sensitivity of the antenna 21 was then measured in both samples, and the results are shown in FIG. 8.

As shown in FIG. 8, an improvement in reception sensitivity was not observed when the amorphous foil members 140 are located at positions superimposed on the coil-overlapping area. More specifically, when a part of the amorphous foil member 140 overlaps the coil-overlapping area 104, the distance from the amorphous foil member 140 to the coil 212 becomes closer, magnetic flux lines collected in the coil 212 escape from the part of the amorphous foil members 140 overlapping the coil-overlapping area, reception sensitivity does not improve, and the desired effect of improving antenna performance is not achieved. However, when the amorphous foil members 140 are located at positions not overlapping the coil-overlapping area and overlapping the lead-overlapping area, a 2 dB improvement in the reception sensitivity of the antenna 21 was confirmed compared with a configuration not having the amorphous foil members 140.

Configuration of the External Case

The configuration of the external case 100 of the radio-controlled timepiece 1 is described next.

As shown in FIG. 2 and FIG. 5, the external case 100 includes the casing 110, a crystal 120 attached to the dial side of the casing 110, and a metal back cover 130 removably attached to the back side of the casing 110 (the side on the bottom).

The casing 110 may be made of metal, such as stainless steel, brass, or titanium. The casing 110 in this embodiment of the invention is substantially cylindrical and the inside surface is substantially round when seen in plan view. Note that, for example, a magnetic member for preventing eddy currents produced in a secondary magnetic path by the antenna 21 receiving radio waves may be positioned on the back cover 130 or casing 110.

Effect of the Radio-Controlled Timepiece

As described above, an amorphous foil member 140 with higher permeability than the dial 14 and solar cell 15 is positioned in a radio-controlled timepiece 1 according to this first embodiment of the invention between the dial 14 and base plate 102 of the module 10 at a position not superposed to the coil-overlapping area 104 and superposed to the lead-overlapping area 105.

As a result, the amorphous foil members 140 can attract more magnetic flux lines and guide the magnetic flux lines into the lead parts 211B, and thus more effectively collect magnetic flux lines in the antenna 21. Furthermore, because the amorphous foil members 140 are not positioned in the coil-overlapping area, the magnetic flux lines collected by the amorphous foil members 140 do not escape into the coil 212 and can be concentrated in the lead parts 211B of the magnetic core 211. More magnetic flux lines therefore pass through the magnetic core 211, the magnetic flux density increases, and the performance of the antenna 21 can be improved.

When a back cover that is made of metal is used, locating the antenna 21 proximally to the back cover subjects antenna 21 performance to the effects of eddy current, and reception sensitivity drops. To avoid this, the antenna 21 is preferably located near the dial 14 away from the back cover as described in the foregoing embodiment of the invention and amorphous foil members 140 are positioned between the dial 14 and the module 10, further suppressing the production of eddy current in the secondary magnetic path produced at the antenna 21 and thus improving antenna characteristics.

Furthermore, because the circuit board 80 and the drive unit, motors, and wheel train of the movement are positioned on the back cover side of the base plate 102 in the module 10, and few other timepiece parts are positioned on the dial-side surface 103 of the base plate 102, the amorphous foil members 140 can be positioned in this space without impinging on the space available for other parts while also assuring sufficient space for positioning the amorphous foil members 140. The area of the amorphous foil members 140 can therefore be increased and flux collection can be improved.

Furthermore, the amorphous foil members 140 are adhesively affixed to the magnetic member seats 102A formed in the dial-side surface 103 of the base plate 102. More specifically, because the circuit board 80 and the drive unit, motors, wheel train, high capacity secondary power supply 72, and other parts of the movement are positioned on the back cover side of the base plate 102 in the module 10, none of the movement parts are located on the dial-side surface 103 side of the base plate 102. Sufficient area for positioning the amorphous foil members 140 can thus be assured, and the area of the amorphous foil members 140 can be increased. More magnetic flux lines can therefore be collected, the flux collection effect of the antenna 21 can be improved, and antenna performance can be improved.

Furthermore, in a configuration in which the amorphous foil members 140 are applied to the base plate 102, antenna performance, such as the tuning frequency of the antenna 21, can be measured before the module 10 is placed in the casing 110. Compared with measuring the antenna performance after the radio-controlled timepiece 1 is assembled, the invention thus enables inspecting the antenna 21 and detecting defective antennas 21 at an earlier stage in the manufacturing process. Therefore, compared with measuring the performance of the antenna 21 after the radio-controlled timepiece 1 is assembled, the invention enables simplifying the manufacturing process and efficiently manufacturing the radio-controlled timepiece 1.

In addition, if the amorphous foil members 140 are affixed to the dial 14, for example, the antenna 21 and the amorphous foil members 140 must be precisely positioned to each other when installing the module 10 after installing the dial 14 in the casing 110. However, because the position of the antenna 21 on the base plate 102 is fixed with the foregoing configuration in which the amorphous foil members 140 are adhesively affixed to the base plate 102, the amorphous foil member 140 and the antenna 21 can be easily positioned to each other. The manufacturing efficiency of the radio-controlled timepiece 1 can thus be further improved.

An amorphous foil member 140 is used as the magnetic member in this embodiment of the invention. The permeability of this amorphous foil member 140 is significantly greater than the timepiece parts other than the magnetic core 211 of the antenna 21, particularly the dial 14, the solar cell 15, the casing 110, and the back cover 130. Ambient magnetic flux lines can thus be efficiently gathered in the amorphous foil member 140. More magnetic flux lines are thus input to the magnetic core 211 from the amorphous foil members 140 through the lead parts 211B, the magnetic flux collection effect of the antenna 21 is improved, and antenna performance can be improved.

The amorphous foil members 140 are formed extending in the same directions as the lead parts 211B, and cover a larger area than the lead-overlapping area.

More magnetic flux lines are thus gathered in the amorphous foil members 140, and more magnetic flux lines are input to the lead parts 211B. The flux density in the center of the magnetic core 211 is thus also increased, and reception sensitivity can be further improved.

The amorphous foil members 140 are made of foil and are adhesively affixed using an adhesive layer. As a result, the thickness of the amorphous foil members 140 and the adhesive layer can be sufficiently reduced compared with the configuration of the related art that uses a magnetic sheet having an amorphous metal blended with a plastic sheet, and the amorphous foil members 140 can be easily positioned in the small gap between base plate 102 and the solar cell 15 that is adhesively affixed to the back side of the dial 14. The thickness of the radio-controlled timepiece 1 is thus not increased and a good design can be achieved.

Embodiment 2

A second embodiment of the invention is described next with reference to the accompanying figures. Note that in the figures and embodiments described below parts that are the same as in the radio-controlled timepiece 1 according to the first embodiment described above are identified by the same reference numerals, and further description thereof is simplified or omitted.

Figure 9:
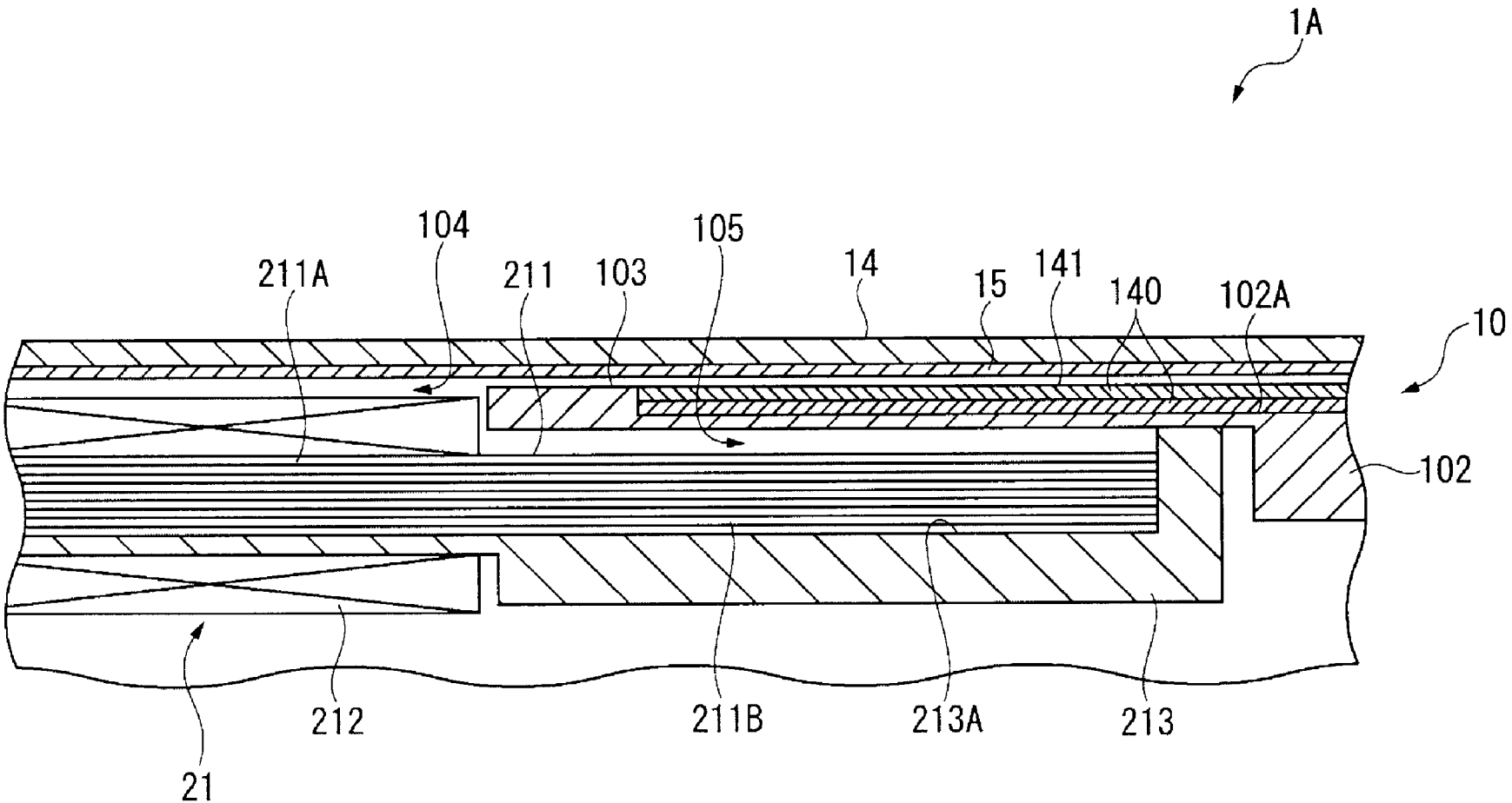
FIG. 9 is a section view through a position near the lead part of the antenna in a radio-controlled timepiece according to a second embodiment of the invention.

FIG. 9 is a section view of a radio-controlled timepiece according to a second embodiment of the invention through a position near the lead part of the antenna.

The radio-controlled timepiece 1A according to this second embodiment of the invention has plural layers of the amorphous foil members 140 positioned on the base plate 102 in the first embodiment.

More specifically, a plurality of amorphous foil members 140 are layered on the base plate 102 of the radio-controlled timepiece 1A according to the second embodiment of the invention at a position that is not superposed to the coil-overlapping area 104 and is superposed to the lead-overlapping area 105 as shown in FIG. 9, thus forming an amorphous foil layer 141.

As in the first embodiment, magnetic member seats 102A are positioned on the dial-side surface 103 of the base plate 102. The depth of this magnetic member seats 102A is set appropriately according to the number of amorphous foil members 140 that are stacked so that when the amorphous foil layer 141 is formed the dial-side surface 103 of the base plate 102 and the surface of the amorphous foil layer 141 facing the dial 14 are substantially flush. These amorphous foil members 140 are bonded together by an adhesive layer formed from an adhesive, and are adhesively bonded to the base plate 102 through an intervening adhesive layer as described above in the first embodiment.

Effect of a Radio-Controlled Timepiece According to the Second Embodiment

As described above, an amorphous foil layer 141 of plural stacked amorphous foil members 140 is positioned on the dial-side surface 103 of the base plate 102 in the radio-controlled timepiece 1A according to the second embodiment of the invention at a position not overlapping the coil-overlapping area 104 and overlapping at least a part of the lead-overlapping area 105.

Compared with a configuration having a single amorphous foil member 140, this embodiment of the invention increases the thickness of the amorphous foil layer 141 so that even more magnetic flux lines can be collected and the magnetic flux collection effect can be further improved. The performance of the antenna 21 can thus be even further improved.

Magnetic member seats 102A with a depth determined according to the number of amorphous foil member 140 layers, that is, according to the thickness of the amorphous foil layer 141, is formed in the base plate 102. As a result, the surface of the amorphous foil layer 141 facing the dial 14 can be formed substantially flush to the dial-side surface 103 of the base plate 102. Therefore, when the module 10 is placed in the casing 110, the gap between the solar cell 15 on the back cover side of the dial 14 and the base plate 102 can be reduced and a thin radio-controlled timepiece 1A can be achieved.

Furthermore, by increasing the depth of the magnetic member seats 102A, the distance between the amorphous foil layer 141 and the lead parts 211B can be shortened, magnetic flux lines collected by the amorphous foil layer 141 can be desirably input to the lead parts 211B, and the flux density passing through the center of the magnetic core 211 can be increased. The magnetic flux collection efficiency of the amorphous foil layer 141 can thus be improved and antenna performance can be improved.

Embodiment 3

A third embodiment of the invention is described next with reference to the accompanying figures. Note that in the figures and embodiments described below parts that are the same as in the radio-controlled timepiece 1 according to the first embodiment described above are identified by the same reference numerals, and further description thereof is simplified or omitted.

Figure 10:
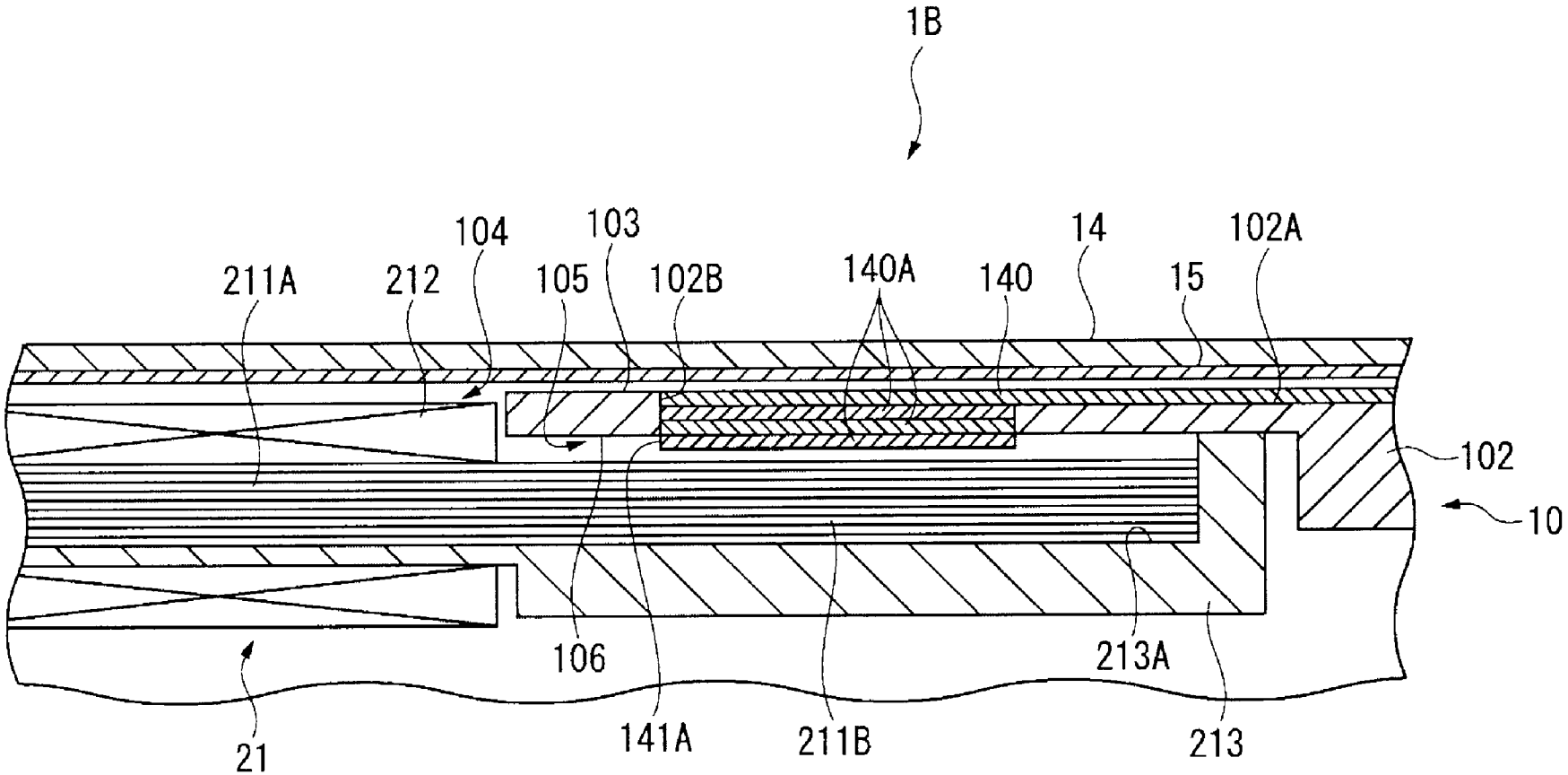
FIG. 10 is a section view through a position near the lead part of the antenna in a radio-controlled timepiece according to a third embodiment of the invention.

FIG. 10 is a section view through a position near the lead part of the antenna in a radio-controlled timepiece according to a third embodiment of the invention.

In the radio-controlled timepiece 1A according to the second embodiment described above, the amorphous foil layer 141 is formed by stacking the amorphous foil members 140 on the dial-side surface 103 of the base plate 102. In a radio-controlled timepiece 1B according to this third embodiment, however, the amorphous foil members 140 are stacked towards the lead part 211B side.

More specifically, as shown in FIG. 10, a through-hole 102B communicating the dial-side surface 103 with the lead-facing surface 106 opposite the lead part 211B is positioned in a part of the magnetic member seats 102A within the lead-overlapping area 105 of the base plate 102. As described in the first embodiment, the amorphous foil members 140 are positioned in the magnetic member seats 102A. In this third embodiment of the invention the amorphous foil members 140 form the magnetic flux collection unit of the invention.

Amorphous foil members 140A are then stacked toward the lead part 211B from the surface of the amorphous foil member 140 that is adhesively affixed to the magnetic member seats 102A and facing the through-hole 102B. This amorphous foil layer 141A forms the magnetic field output unit of the invention.

A gap of a predetermined size is positioned between the surface of the amorphous foil layer 141A facing the lead part 211B and the lead part 211B to prevent damage to the lead part 211B and the amorphous foil layer 141A. More particularly, if the lead part 211B and the amorphous foil layer 141A touch and the radio-controlled timepiece 1B is subject to shock, vibration induced by the shock will cause the amorphous foil layer 141A and lead part 211B to collide and possibly be damaged. However, by providing a gap as described above, this collision caused by vibration can be avoided even if the timepiece is subject to shock, and damage to the lead part 211B and amorphous foil layer 141A can be prevented.

Effect of a Radio-Controlled Timepiece According to the Third Embodiment

As described above, an amorphous foil member 140 is positioned on the dial-side surface 103 of the base plate 102 in the radio-controlled timepiece 1A according to the third embodiment of the invention at a position not overlapping the coil-overlapping area 104 and overlapping at least a part of the lead-overlapping area 105. A through-hole 102B communicating the dial-side surface 103 with the lead-facing surface 106 is also formed in the lead-overlapping area 105 of the base plate 102, and amorphous foil members 140A are stacked in this through-hole 102B from the amorphous foil member 140 toward the lead part 211B to form an amorphous foil layer 141A.

The resulting amorphous foil layer 141A can thus desirably guide magnetic flux lines collected by the amorphous foil members 140 from the dial-side surface 103 of the base plate 102 to the lead-facing surface 106 side. Furthermore, because the amorphous foil layer 141A is positioned proximally to the lead part 211B, magnetic flux lines guided by the base plate 102 can be more efficiently input to the lead parts 211B. This increases magnetic flux line input to the lead parts 211B, increases the flux density of the magnetic core 211, improves the flux collection effect, and further improves antenna performance.

A gap of a predetermined size is positioned between the lead part 211B and the amorphous foil layer 141A. Therefore, even if impact is applied to the radio-controlled timepiece 1B, vibration caused by the impact will not cause the lead parts 211B and amorphous foil layer 141A to collide, and damage can be prevented.

Embodiment 4

A fourth embodiment of the invention is described next with reference to the accompanying figures. Note that in the figures and embodiments described below parts that are the same as in the radio-controlled timepiece 1 according to the first embodiment described above are identified by the same reference numerals, and further description thereof is simplified or omitted.

Figure 11:
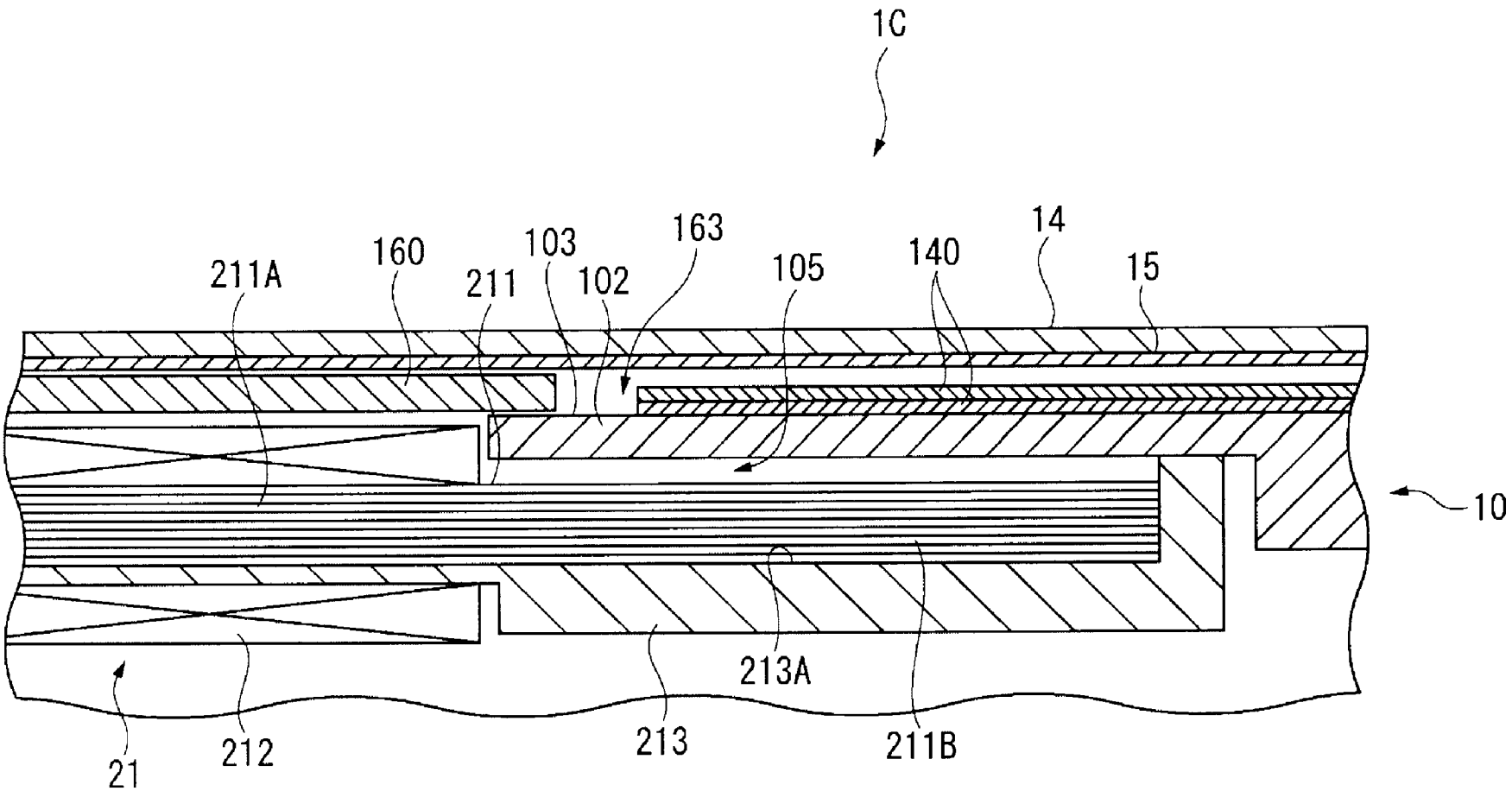
FIG. 11 is a section view through a position near the lead part of the antenna in a radio-controlled timepiece according to a fourth embodiment of the invention.
Figure 12:
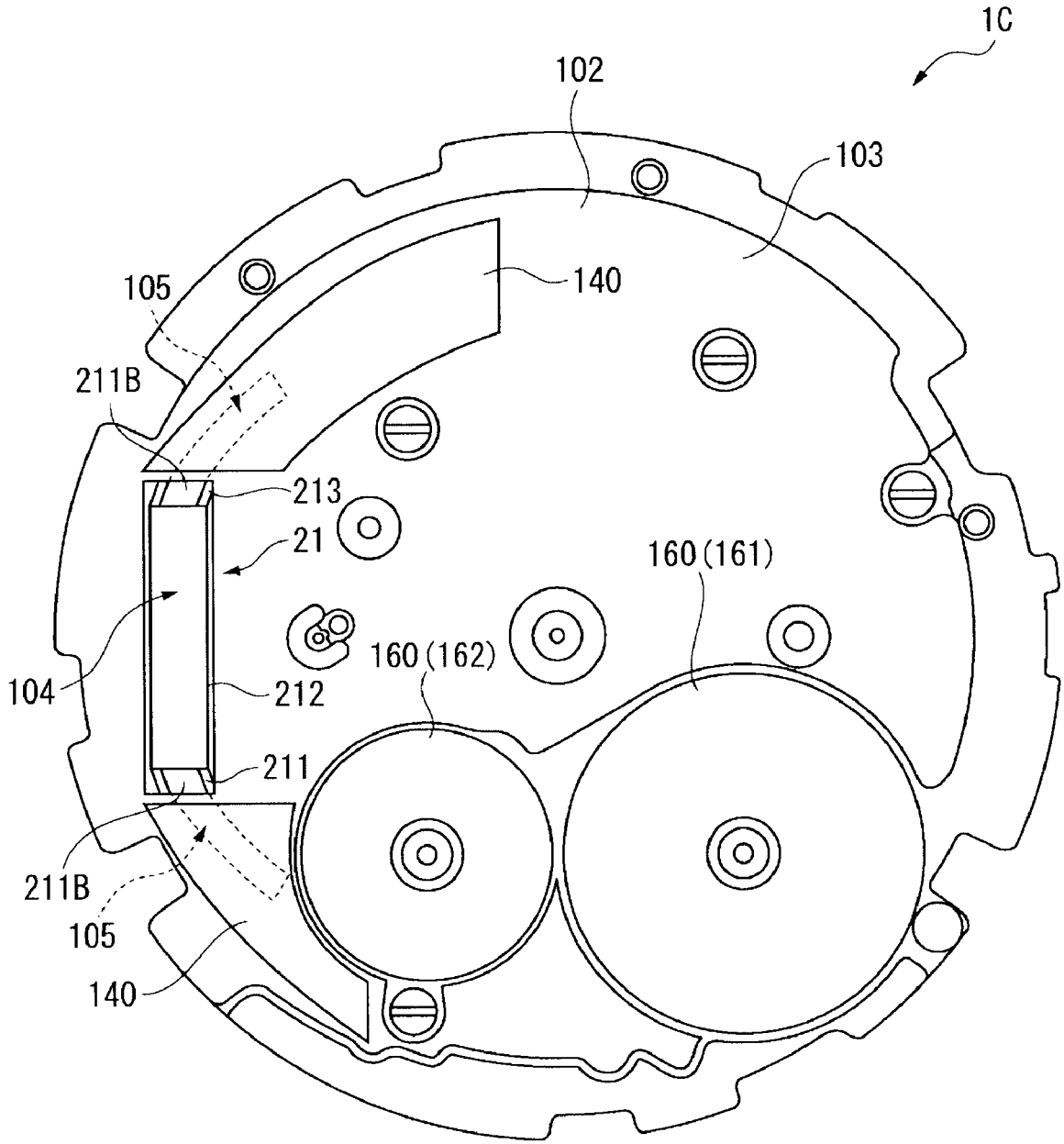
FIG. 12 is a plan view showing the side of the base plate facing the dial in the radio-controlled timepiece according to the fourth embodiment of the invention.

FIG. 11 is a section view through a position near the lead part of the antenna in a radio-controlled timepiece according to a fourth embodiment of the invention. FIG. 12 is a plan view showing the side of the base plate facing the dial in the radio-controlled timepiece according to the fourth embodiment of the invention.

The radio-controlled timepiece 1C according to a fourth embodiment of the invention has a date display window not shown for displaying the date formed in the dial 14 and solar cell 15, and therefore also has in the module 10 a date wheel 160 for displaying the date in the date display window.

The date wheel 160 includes a tens-digit wheel 162 and a ones-digit wheel 161.

The tens-digit wheel 162 has tens-digit markers for 0, 1, 2, and 3 positioned at equal intervals around the outside edge on the side facing the dial 14. Positioned around the outside edge of the ones-digit wheel 161 on the side facing the dial 14 in the following order are a group of markers displaying "1" to "9" for the first ten days of the month (the 1st to the 9th), a group of markers displaying "0" to "9" for the second ten days of the month (the 10th to the 19th), a group of markers displaying "0" to "9" for the third ten days of the month (the 20th to the 29th), and end-of-month markers "0" and "1" corresponding to the 30th and 31st.

Drive power from the hour/minute motor 421 is speed-reduced and transferred to the ones-digit wheel 161 through a date wheel train that is configured to a predetermined gear ratio. This results in the ones-digit wheel 161 turning the distance of one marker in 24 hours, thereby advancing the date displayed in the date window one day, and turning one revolution in 31 days.

The ones-digit wheel 161 also has a tens-digit wheel engaging unit not shown. When the ones-digit wheel 161 rotates from the 9 in the first ten day group of markers to the 0 in the second ten day group of markers, from the 9 in the second ten day group of markers to the 0 in the third ten day group of markers, and from the 9 in the third ten day group of markers to the 1 in the end-of-month markers, the tens-digit wheel engaging unit engages the tens-digit wheel 162 and causes the tens-digit wheel 162 to advance one marker. This causes one of the tens digit markers on the tens-digit wheel 162 and one of the unit markers on the ones-digit wheel 161 of the date wheel 160 assembly to be displayed in the date display window, and the displayed date thus changes daily.

The date wheel 160 described above is attached to the dial 14 side of the base plate 102 in the module 10. More specifically, a gap 163 of a predetermined size is formed between the solar cell 15 and the base plate 102 in the module 10 of the radio-controlled timepiece 1C, and the date wheel 160 is positioned in this gap 163.

The amorphous foil member 140 is then adhesively affixed in this gap 163 between the base plate 102 and solar cell 15 at a position that is not superposed to the coil-overlapping area 104, is superposed to the lead-overlapping area 105, and is outside the area occupied by the date wheel 160. A magnetic member seat 102A such as formed in the base plate 102 in the first to third embodiments is not formed in this embodiment of the invention, and the amorphous foil member 140 is adhesively affixed protruding from the dial-side surface 103 of the base plate 102 into this gap 163.

Effect of a Radio-Controlled Timepiece According to the Fourth Embodiment

As described above, the module 10 in the radio-controlled timepiece 1C according to this fourth embodiment of the invention includes a date wheel 160 for displaying the date in a date window formed in the dial 14. This date wheel 160 is positioned in a gap 163 formed between the base plate 102 and the dial 14. The amorphous foil member 140 is positioned protruding from the dial-side surface 103 of the base plate 102 into the gap 163 at a position that is not superposed to the coil-overlapping area or the date wheel 160 and is superposed with the lead-overlapping area 105.

More specifically, in a configuration having a date wheel 160, the amorphous foil member 140 is positioned to use the gap 163 where the date wheel 160 is positioned effectively. It is therefore not necessary to form a magnetic member seat 102A in the base plate 102, an amorphous foil member 140 can be positioned with a simpler construction, and the performance of the antenna 21 can be improved.

Embodiment 5

A fifth embodiment of the invention is described next with reference to the accompanying figures.

Figure 13:
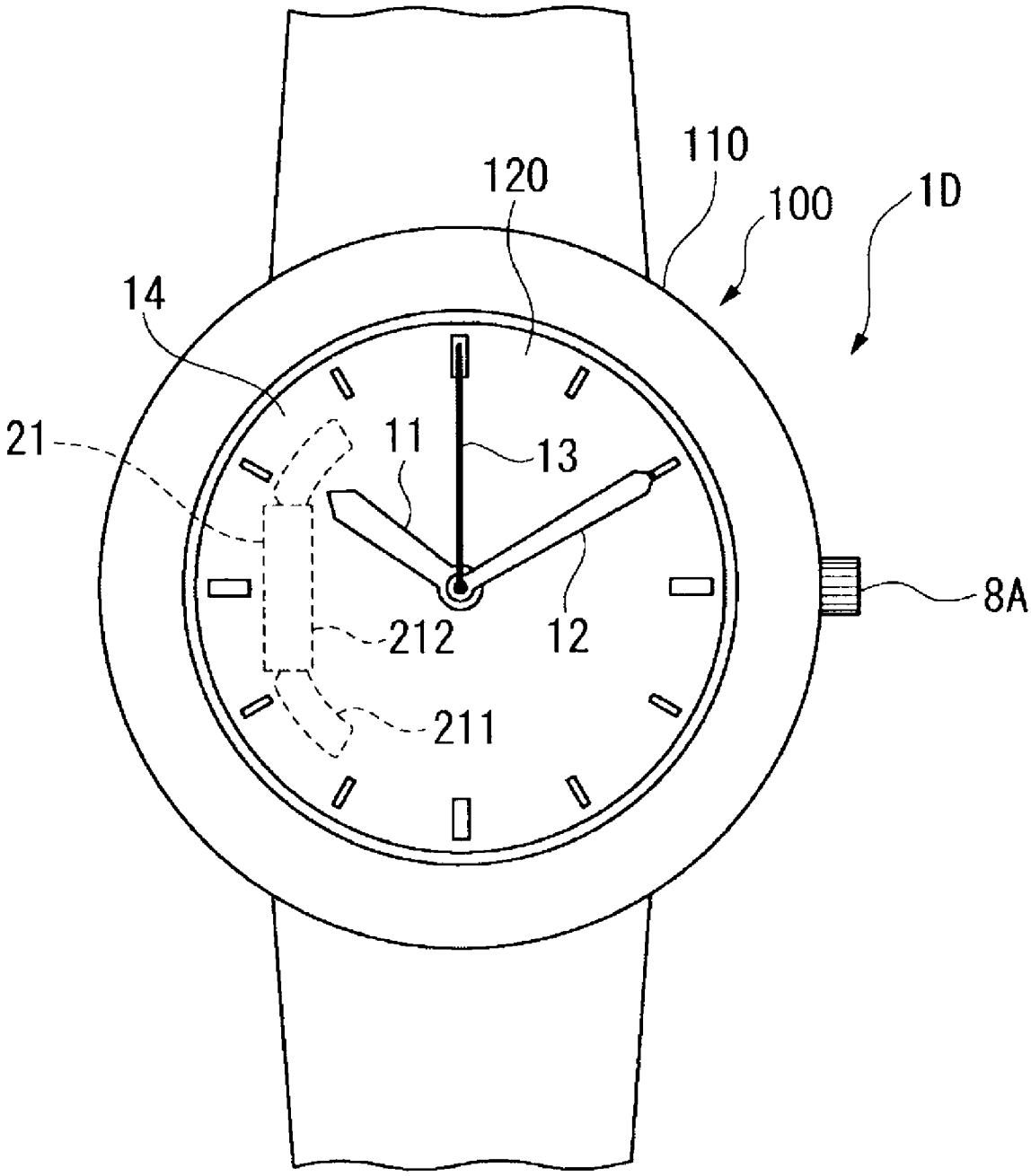
FIG. 13 is a front view of a radio-controlled timepiece as an example of an electronic timepiece with an internal antenna according to a fifth embodiment of the invention.

FIG. 13 is a front view of a radio-controlled timepiece as an example of an electronic timepiece with an internal antenna according to a fifth embodiment of the invention.

As shown in FIG. 13, a radio-controlled timepiece 1D according to a preferred embodiment of the invention is an analog timepiece with hands 11, 12, and 13 and a dial 14, and is a timepiece that can receive long-wave standard time signals as external radio frequency information containing time information, and can correct the positions indicated by the hands 11, 12, and 13 based on the received time information.

The radio-controlled timepiece 1 includes the hands 11, 12, and 13, the dial 14, a module 10 including components for controlling an antenna 21 that receives the standard time signals and driving the hands 11, 12, and 13, and an external case 100 that houses thereinside the hands 11, 12, and 13, dial 14, and module 10.

Module Configuration

The module 10 used in the radio-controlled timepiece 1D is described below with reference to FIG. 14 to FIG. 17.

Figure 14:
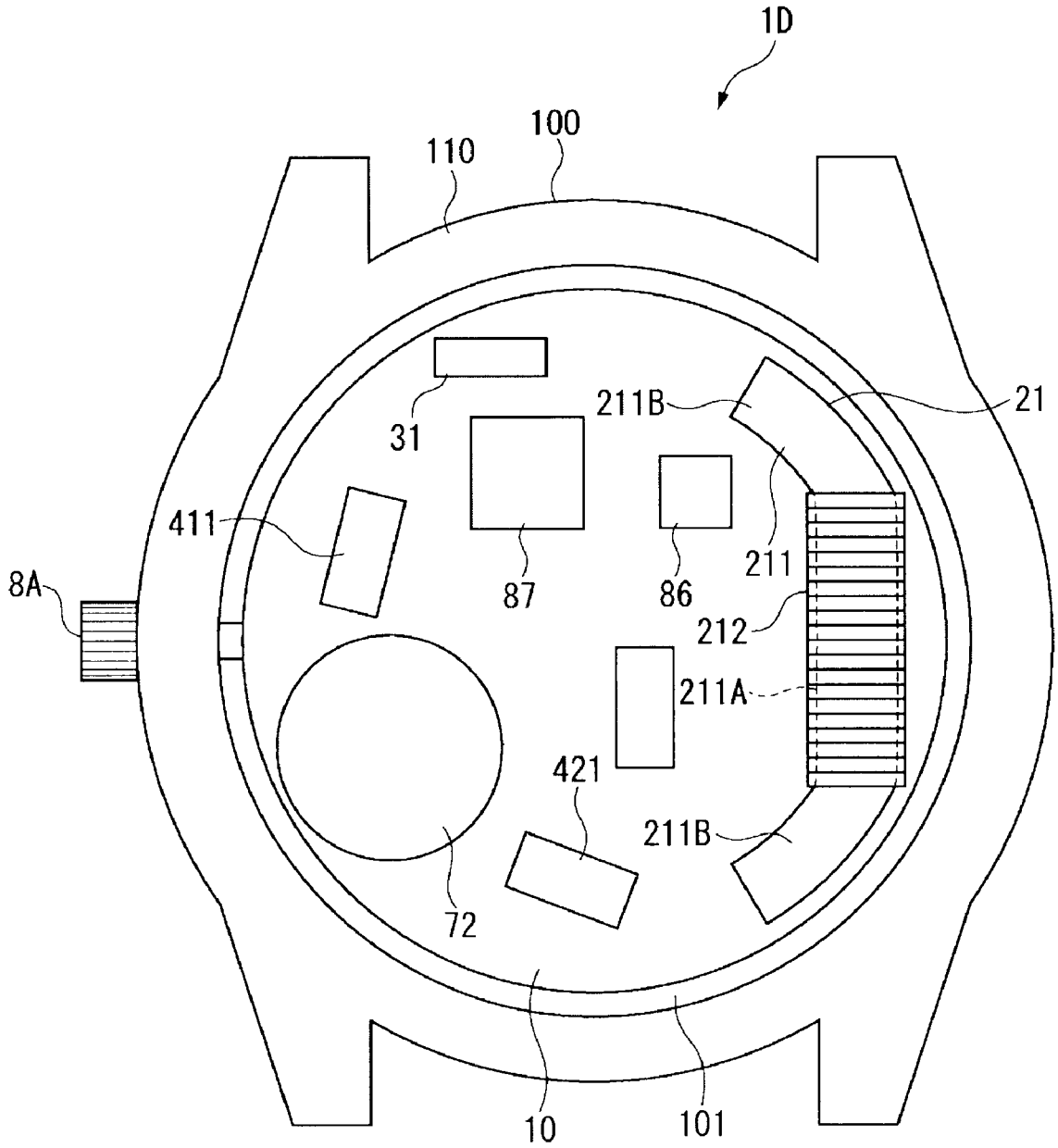
FIG. 14 is a schematic plan view if the radio-controlled timepiece according to the fifth embodiment of the invention from the back side of the timepiece.

FIG. 14 is a schematic plan view from the back cover side of the radio-controlled timepiece according to the fifth embodiment of the invention.

Figure 15:
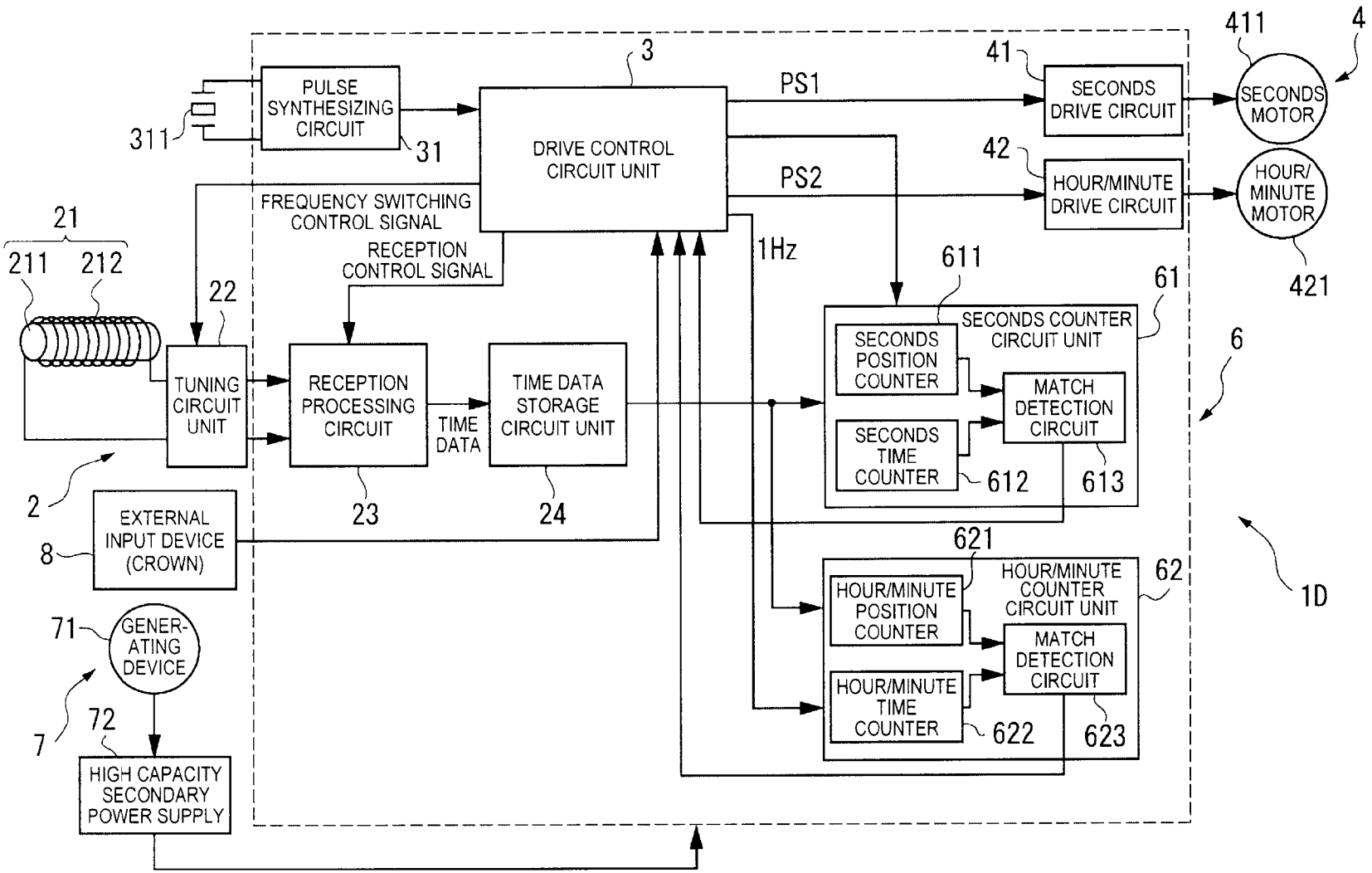
FIG. 15 is a block diagram showing the configuration of a radio-controlled timepiece according to a fifth embodiment of the invention.

FIG. 15 is a schematic block diagram of the radio-controlled timepiece according to the fifth embodiment of the invention.

Figure 16:
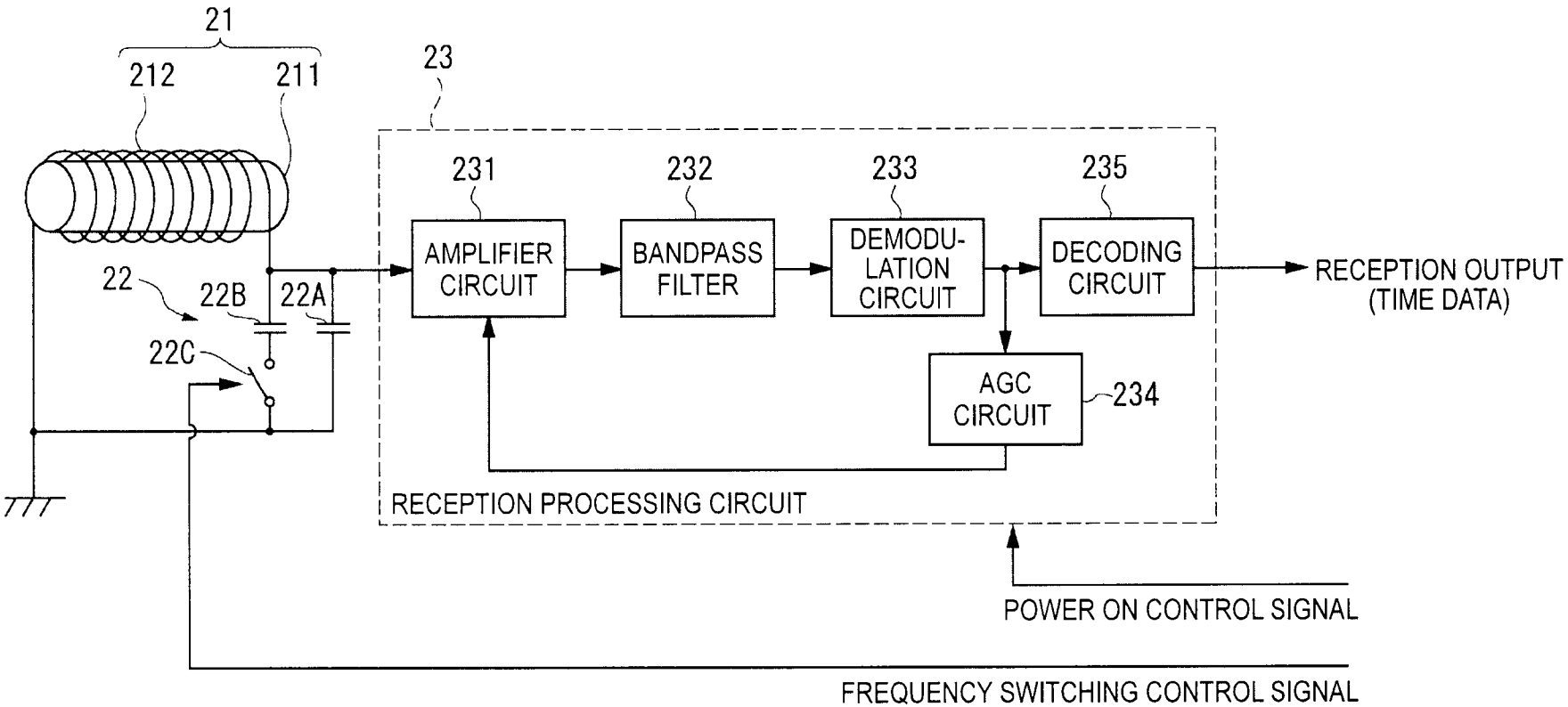
FIG. 16 is a block diagram showing the configuration of a reception circuit unit in a radio-controlled timepiece according to the fifth embodiment of the invention.

FIG. 16 is a schematic block diagram of the reception circuit unit of the radio-controlled timepiece according to the fifth embodiment of the invention.

Figure 17:
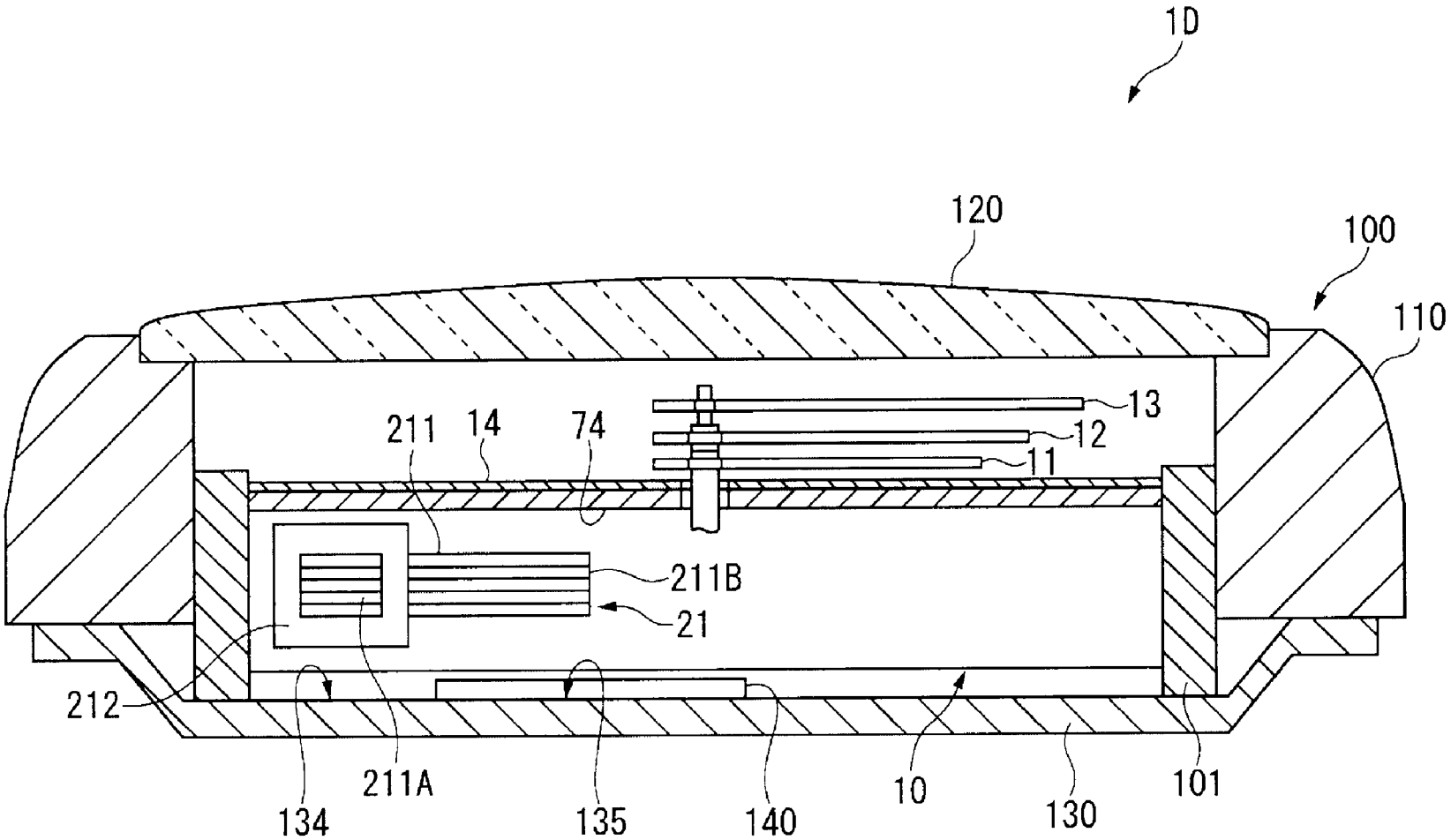
FIG. 17 is a side section view through the thickness of a radio-controlled timepiece according to the fifth embodiment of the invention.

FIG. 17 is a side section view through the thickness of the radio-controlled timepiece according to the fifth embodiment of the invention.

The module 10 has a plastic module spacer 101 that is round when seen in plan view. A plurality of bosses (not shown in the figure) that contact the inside surface of the external case 100 are formed protruding radially on the side of the module spacer 101, and these bosses are arranged around the inside circumference surface of the external case 100.

Gaps equal to the protruding height of the bosses are formed between the inside surface of the external case 100 and the side of the module spacer 101 in the areas (see FIG. 17) where these bosses are not formed around the entire circumference of the side of the module spacer 101.

When the module 10 is placed inside the external case 100, the bosses positioned on the module spacer 101 touch the inside surface of the external case 100 and thus fix the position of the module 10 inside the external case 100.

Assembled on the inside of the module spacer 101 in the module 10 are components including a circuit board, the movement, and a high capacity secondary power supply (storage battery) 72 forming a power supply 7. The circuit board 80 is populated with devices including a reception chip 86, a CPU 87, and a reference oscillator 311 (see FIG. 15). The movement includes motors 411 and 421 that are part of the drive unit 4, and a wheel train. An antenna 21 for receiving signals is positioned proximally to the external case 100.

As also shown in FIG. 15, the circuit devices positioned on the circuit board include a reception processor 2 for processing the received signals, a drive control circuit unit 3, a drive unit 4 for driving the hands, and a counter unit 6 for counting the time.

The reception processor 2 includes the antenna 21 for receiving signals, a tuning circuit unit 22 composed of a capacitor and other components for tuning to the signal received by the antenna 21, a reception processing circuit 23 that processes information received by the antenna 21, and a time data storage circuit unit 24 that stores the time data processed by the reception processing circuit 23.

As shown in FIG. 16, the tuning circuit unit 22 includes two capacitors 22A and 22B parallel connected to the antenna 21 with one capacitor 22B connected to the antenna 21 through a switch 22C.

The frequency of the signal received by the antenna 21 can be changed by a frequency switching control signal that is output from the drive control circuit unit 3 and causes the switch 22C to turn on or off. This enables switching and receiving long-wave standard time signals of two different frequencies, such as the 40-kHz signals that are transmitted by the standard time signal transmission station at Mount Otakadoya (for eastern Japan) and the 60-kHz signals that are transmitted by the transmission station at Mount Hagane (for western Japan) in Japan.

As also shown in FIG. 16, the reception processing circuit 23 includes an amplifier circuit 231, a bandpass filter 232, a demodulation circuit 233, an automatic gain control (AGC) circuit 234, and a decoding circuit 235.

The amplifier circuit 231 amplifies the long-wave standard time signal received by the antenna 21. The bandpass filter 232 extracts the desired frequency component from the amplified long-wave standard time signal. The demodulation circuit 233 smoothes and demodulates the extracted long-wave standard time signal. The AGC circuit 234 controls the gain of the amplifier circuit 231 to keep the reception level of the long-wave standard time signal constant. The decoding circuit 235 then decodes and outputs the demodulated long-wave standard time signal.

The time data that is received and signal processed by the reception processing circuit 23 is output to and stored by the time data storage circuit unit 24 as shown in FIG. 15.

The reception processing circuit 23 starts receiving time information based on a reception control signal output from the drive control circuit unit 3 according to a predetermined reception schedule or when reception is started unconditionally by operation of an external input device 8.

As shown in FIG. 15, a pulse signal from the pulse synthesizing circuit 31 is input to the drive control circuit unit 3. The pulse synthesizing circuit 31 frequency divides a reference pulse from the reference oscillator 311, such as a crystal oscillator, to generate a clock pulse, and generates pulse signals of different pulse widths and timing from the reference pulse. The reference oscillator 311 is connected to the CPU 87 and produces a clock signal for the circuitry, and is located away from the antenna 21 because the clock signal frequency is near the frequency of the received long-wave standard time signal and produces noise if mixed with the signals received by the antenna 21.

The drive control circuit unit 3 outputs a seconds drive pulse signal PS1 that is output once a second for driving the second hand, and an hour/minute drive pulse signal PS2 that is output once a minute for driving the hour and minute hands, to the seconds drive circuit 41 and hour/minute drive circuit 42 to drive the hands. More specifically, the drive circuits 41 and 42 drive the seconds motor 411 and hour/minute motor 421, which are stepping motors that are driven by pulse signals from the corresponding drive circuits 41 and 42, and thus drive the second hand and the minute and hour hands that are connected to the motors 411 and 421. The hands, dial, motors 411 and 421, and drive circuits 41 and 42 thus form a time display for displaying the time. Note that the time display may also drive the hour hand, minute hand, and second hand using a single motor.

The counter unit 6 includes a seconds counter circuit unit 61 for counting the seconds, and a hour/minute counter circuit unit 62 for counting the hour and minute.

The seconds counter circuit unit 61 includes a seconds position counter 611, a seconds time counter 612, and a match detection circuit 613. The seconds position counter 611 and seconds time counter 612 are both counters that loop at the 60 count, that is, every 60 seconds when a 1-Hz signal is input. The seconds position counter 611 counts the drive pulse signal (seconds drive pulse signal PS1) that is supplied from the drive control circuit unit 3 to the seconds drive circuit 41. More specifically, the position that is pointed to by the second hand is counted by counting the drive pulse signal that drives the second hand.

The seconds time counter 612 normally counts the 1-Hz reference pulse (clock pulse) that is output from the drive control circuit unit 3. If time data is received by the reception processor 2, the counter is adjusted to match the seconds value in the received time data.

The hour/minute counter circuit unit 62 similarly includes an hour/minute position counter 621, an hour/minute time counter 622, and a match detection circuit 623. The hour/minute position counter 621 and hour/minute time counter 622 are both counters that loop when signals equal to 24 hours are input. The hour/minute position counter 621 counts the drive pulse signal (hour/minute drive pulse signal PS2) that is supplied from the drive control circuit unit 3 to the hour/minute drive circuit 42, and counts the positions that are pointed to by the hour hand and minute hand.

The hour/minute time counter 622 normally counts a 1-Hz clock pulse that is output from the drive control circuit unit 3. More precisely, the hour/minute time counter 622 increments 1 when sixty 1-Hz pulses are counted. If time data is received by the reception processor 2, the counter is adjusted to match the hour and minute values in the received time data.

The match detection circuits 613 and 623 detect if the counts of the position counters 611 and 621 and the counts of the time counters 612 and 622 match, and output a detection signal indicating whether or not the counts match to the drive control circuit unit 3.

If a mismatch signal is input from the match detection circuits 613 and 623, the drive control circuit unit 3 continues outputting the drive pulse signals PS1 and PS2 until a match signal is input. If the 1-Hz reference signal from the drive control circuit unit 3 causes the count of the time counters 612 and 622 to change and a mismatch with the position counters 611 and 621 occurs during the normal timekeeping operation of the movement, the drive pulse signals PS1 and PS2 are output so that the hands move and the position counters 611 and 621 again match the time counters 612 and 622. This operation keeps repeating and the movement is controlled as usual.

When time counters 612 and 622 are adjusted to the received time data, the drive pulse signals PS1 and PS2 are output continuously and the hands are moved quickly and adjusted to the correct time until the counts of the position counters 611 and 621 and the time counters 612 and 622 match.

A power supply 7 includes a generating device 71 and the high capacity secondary power supply 72. The generating device 71 is a power generator formed by a self-winding generator or a solar cell (solar generator). The high capacity secondary power supply 72 stores power generated by the generating device 71. The high capacity secondary power supply 72 may be a lithium ion battery or other type of secondary cell. A primary cell such as a silver oxide battery may alternatively be used as the power supply 7. Note that because the high capacity secondary power supply 72 has a stainless steel case, it is positioned in the module 10 at a position separated from the antenna 21 at a location near 3:00 o'clock as shown in FIG. 14 in order to suppress its influence on antenna performance.

The external input device 8 used as an external input has a crown and is used to set the time and start reception, for example.

The antenna 21 is located near the 9:00 o'clock position of the timepiece dial conforming substantially to the inside surface of the module spacer 101.

The antenna 21 has a magnetic core 211 and a coil 212 wound around the magnetic core 211.

The magnetic core 211 is substantially square in section as shown in FIG. 17. As shown in FIG. 14, the magnetic core 211 has a straight coil winding part 211A around which the coil 212 is wound, and lead parts 211B that extend from both ends of the coil winding part 211A conforming substantially to the inside surface of the casing 110 that forms the body of the external case 100.

The magnetic core 211 is made by adhesively stacking approximately 10 to 30 foil layers stamped or etched from a cobalt-based amorphous foil sheet (such as amorphous foil containing at least 50 wt % Co), and heat treating the foil layers by annealing, for example, to stabilize the magnetic characteristics. The magnetic core 211 is thus formed by stacking flat amorphous foil layers in the thickness direction of the timepiece. The magnetic core 211 is not limited to a layered amorphous foil construction, and may be made using a ferrite material that is shaped using a mold and then heat treated.

The coil 212 must have an inductance of approximately 10 mH to receive long-wave standard time signals in the 40-77.5 kHz range. In this embodiment of the invention the coil 212 was made by wrapping several hundred winds of an approximately 0.1 μm diameter polyurethane-coated magnet wire around the core.

The antenna 21 and the reception chip 86 are connected by two leads. More specifically, the antenna 21 and the reception chip 86 are electrically connected by soldering the coil 212 at an end part of the antenna to the circuit board. This enables outputting the standard time signal received by the antenna 21 to the reception processor 2. Note that the electrical connection may alternatively be made by attaching a flexible circuit made of polyimide, for example, to the antenna 21, and fastening this circuit to the circuit board with a screw.

Configuration of the External Case

The configuration of the external case 100 of the radio-controlled timepiece 1D is described next.

As shown in FIG. 14 and FIG. 17, the external case 100 includes the casing 110, a crystal 120 attached to the dial side of the casing 110, and a metal back cover 130 attached to the back side of the casing 110 (the side on the bottom).

The casing 110 is made of metal, such as stainless steel, brass, or titanium. The casing 110 in this embodiment of the invention is substantially cylindrical and the inside surface is substantially round when seen in plan view.

Figure 18:
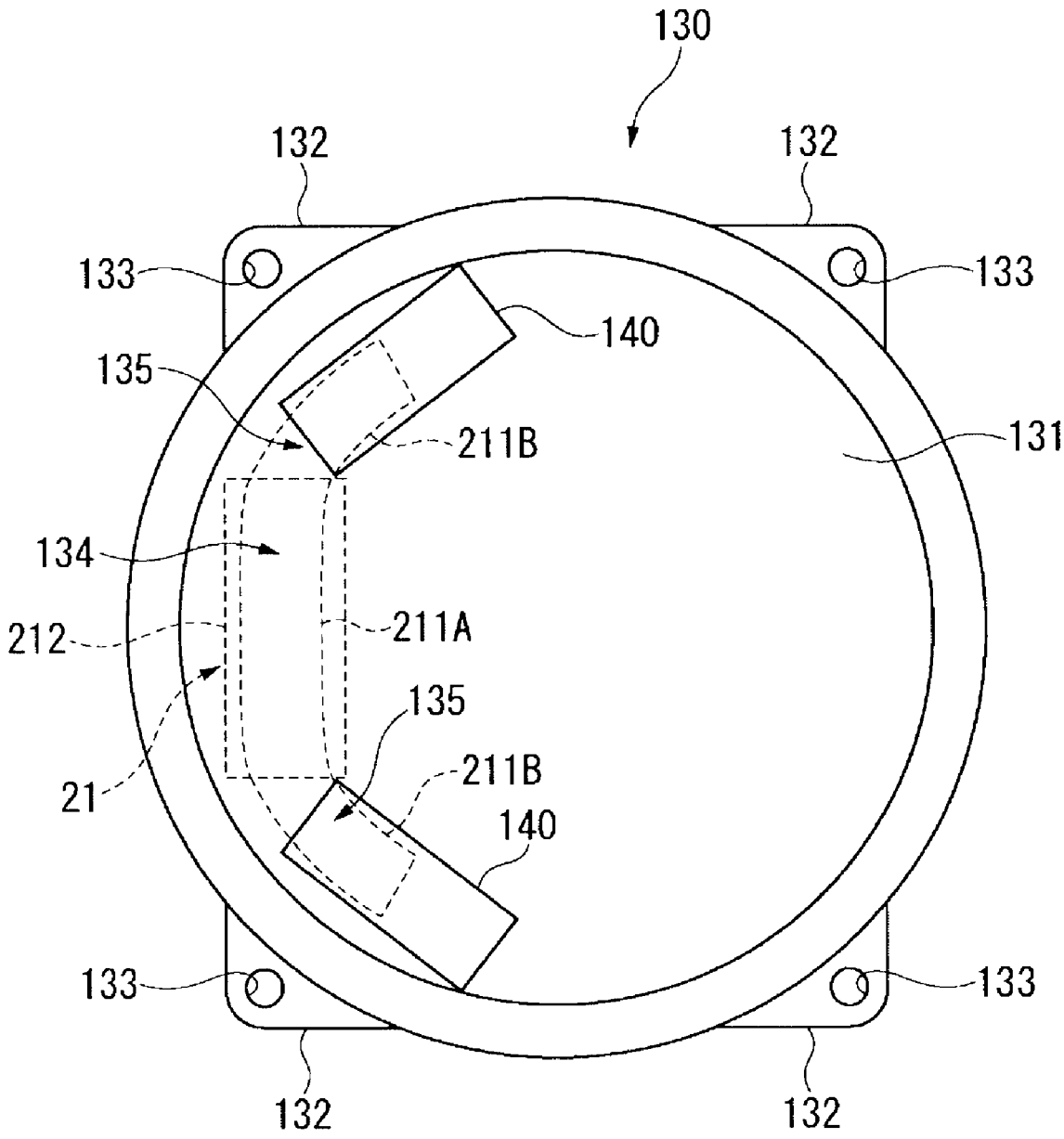
FIG. 18 is a plan view showing the configuration of the inside surface of the back cover in the fifth embodiment of the invention.

The back cover 130 is fastened to the bottom of the casing 110 as described above by screws, for example. FIG. 18 is a plan view showing the configuration of the inside surface of the back cover in the fifth embodiment of the invention.

As shown in FIG. 18 the back cover 130 includes a disc-shaped round part 131 that is slightly larger in diameter than the inside surface of the casing 110, and four screw flanges 132 projecting to the outside radially from the round part 131. Each screw flange 132 has a screw hole 133 through which a screw can pass. The back cover 130 is located in a predetermined position on the bottom of the casing 110, and then fastened to the casing 110 with screws screwed through the screw hole 133 in each of the screw flanges 132 into the bottom of the casing 110.

As shown in FIG. 18, an amorphous foil member 140 is adhesively affixed as a metal magnetic foil member to the inside surface of the back cover 130 (the surface facing the module 10).

More specifically, this amorphous foil member 140 is positioned on the inside surface of the back cover 130 at positions that are not superposed to the coil-facing area 134 (coil-overlapping area) opposite the coil winding part 211A, and are partially superposed to the pair of lead-facing areas 135 (lead-overlapping areas) opposite the lead parts 211B. In addition, the pair of amorphous foil members 140 are formed extending in the direction in which the lead parts 211B project (the direction away from the coil 212) when seen in plan view. These amorphous foil members 140 are adhesively affixed to the back cover 130 through an intervening adhesive layer.

This amorphous foil member 140 is a cobalt-based amorphous foil made of Co—Fe—Ni—B—Si, for example. The relative magnetic permeability of an amorphous foil member 140 made of a Co—Fe—Ni—B—Si cobalt-based amorphous foil, for example, is 20,000. For comparison, the relative magnetic permeability of a back cover 130 made of stainless steel is 1.4, 1.0 when made of brass, and 1.0001 when made of titanium. The magnetic permeability of the amorphous foil member 140 is thus significantly greater than the metal from which the back cover 130 is made. Ambient magnetic flux lines are thus collected in the amorphous foil member 140, and the magnetic field becomes stronger. As a result, more magnetic flux lines pass from the lead parts 211B opposite the amorphous foil members 140 through the magnetic core, and the magnetic flux density increases.

Furthermore, because the electrical conductivity of the amorphous foil members 140 is lower than the metal used in the back cover 130, less eddy current is produced by the magnetic flux lines passing through the amorphous foil members 140 than when the magnetic flux lines pass through the back cover 130.

Effect of a Radio-Controlled Timepiece According to the Fifth Embodiment

As described above, the radio-controlled timepiece 1D according to the fifth embodiment of the invention has a pair of amorphous foil members 140 positioned on the inside surface of the back cover 130 at a position that is not superposed to the coil-facing area 134 opposite the antenna 21 and is superposed to part of the lead-facing areas 135.

As a result, the magnetic flux lines collected by the amorphous foil members 140 pass from the lead parts 211B into the magnetic core 211, and the flux collection effect of the antenna can be improved. Because the reception voltage of the antenna 21 is generally proportional to the flux density in the center of the magnetic core 211, the reception sensitivity can also be increased by thus improving the flux collection effect, and an antenna 21 with good reception sensitivity can be achieved.

Furthermore, because it is not necessary to change the shape or size of the antenna 21, such as by changing the shape or the size of the lead parts 211B of the antenna 21, the size of the radio-controlled timepiece 1D is not increased as a result of a larger antenna 21. The flux collection effect can therefore be improved while affording a pleasing design characteristic. In addition, because the amorphous foil members 140 do not directly touch the antenna 21, damage caused by shock-induced vibration can be prevented when the radio-controlled timepiece 1D is subjected to shock. A separate member for protecting the amorphous foil members 140 is therefore also not necessary.

The radio-controlled timepiece 1D described above thus affords a thinner, smaller timepiece having a simple construction while also achieving good antenna 21 performance.

An amorphous foil member 140 is used as the metal magnetic foil member. The magnetic permeability of this amorphous foil member 140 is significantly higher than the casing 110, back cover 130, and other timepiece parts other than the magnetic core 211 of the antenna 21. As a result, magnetic flux around the amorphous foil members 140 can be efficiently collected, the magnetic flux lines input from the amorphous foil members 140 through the lead parts 211B to the magnetic core 211 can be increased, the flux collection effect of the antenna 21 is thus improved, and antenna performance can be further improved.

The amorphous foil members 140 are formed extending from the lead-facing areas 135 opposite the lead parts 211B in the direction away from the coil-facing area 134. The amorphous foil members 140 are thus formed in an area larger than the lead-facing areas 135. As a result, because more magnetic flux lines enter the lead parts 211B, the flux density in the center of the magnetic core increases and reception sensitivity is further improved.

The amorphous foil members 140 are also made of foil and are adhesively affixed by an adhesive layer formed by applying an adhesive coating. As a result, the thickness of the amorphous foil members 140 and the adhesive layer can be sufficiently reduced compared with the configuration of the related art that uses a magnetic sheet having an amorphous metal blended with a plastic sheet, and the size of the gap between the back cover 130 and module 10 can be reduced. The thickness of the radio-controlled timepiece 1D is thus not increased and a good design can be achieved.

Embodiment 6

A sixth embodiment of the invention is described next with reference to the accompanying figures. Note that in the figures and embodiments described below parts that are the same as in the radio-controlled timepiece 1D according to the fifth embodiment described above are identified by the same reference numerals, and further description thereof is simplified or omitted.

Figure 19:
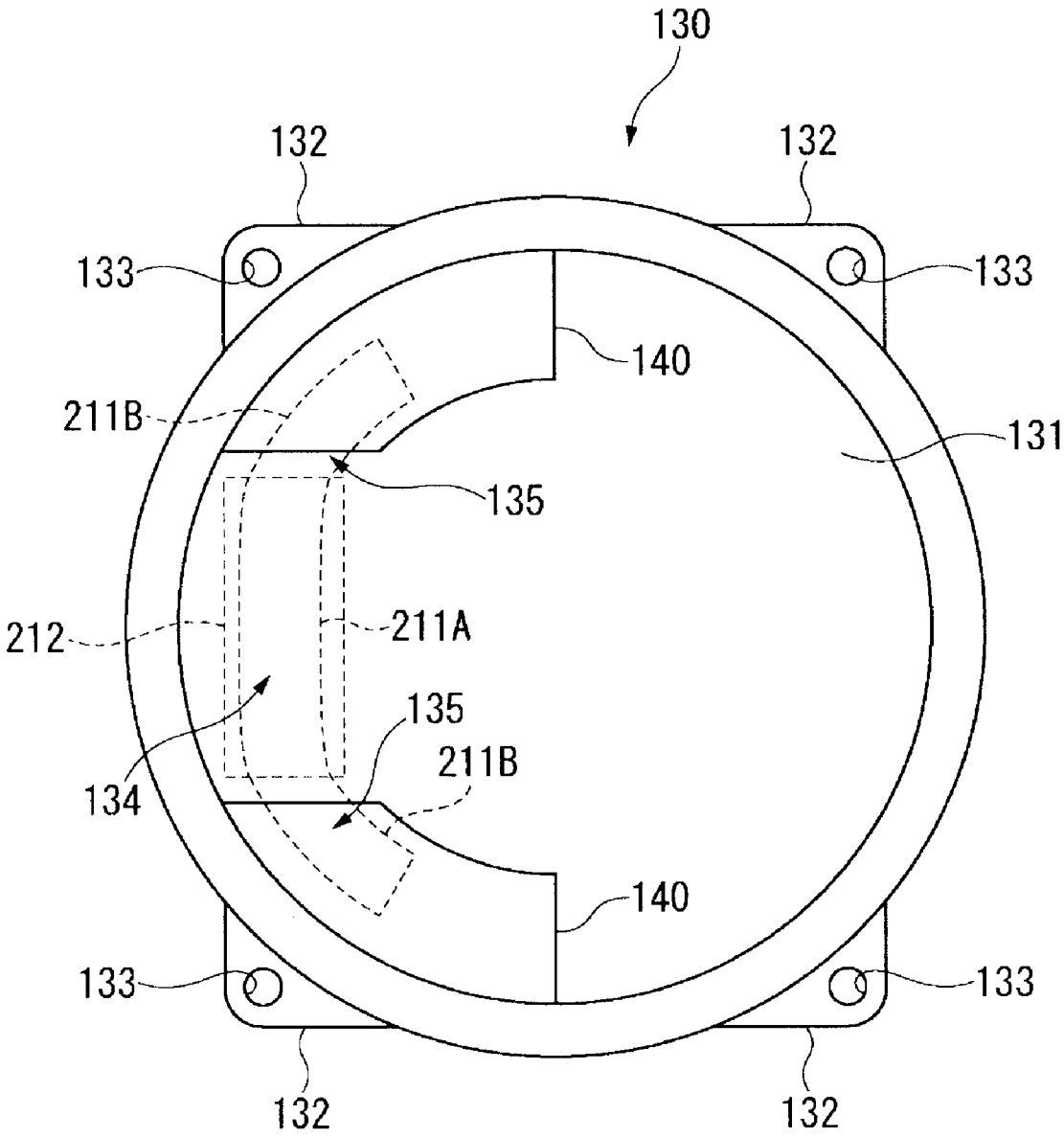
FIG. 19 shows the configuration of the back cover of a radio-controlled timepiece according to a sixth embodiment of the invention.

FIG. 19 shows the configuration of the back cover of a radio-controlled timepiece according to a sixth embodiment of the invention.

This sixth embodiment changes the shape of the amorphous foil members 140 positioned on the back cover 130 in the fifth embodiment.

More specifically, as shown in FIG. 19, the amorphous foil members 140 are positioned on the back cover 130 of the radio-controlled timepiece according to the sixth embodiment of the invention opposite the pair of lead-facing areas 135 in an area superposed to substantially the entire area covered by the lead-facing areas 135 and not superposed to the coil-facing area 134. These amorphous foil members 140 extend on the surface of the back cover 130 opposite the inside surface of the casing 110 to near the center line of the timepiece (a line connecting the 12:00 o'clock and 6:00 o'clock positions of the dial). These amorphous foil member 140 can be made from the same amorphous metal that is used for the amorphous foil members 140 in the fifth embodiment of the invention, and a cobalt-based amorphous metal is used in this embodiment.

Figure 20:
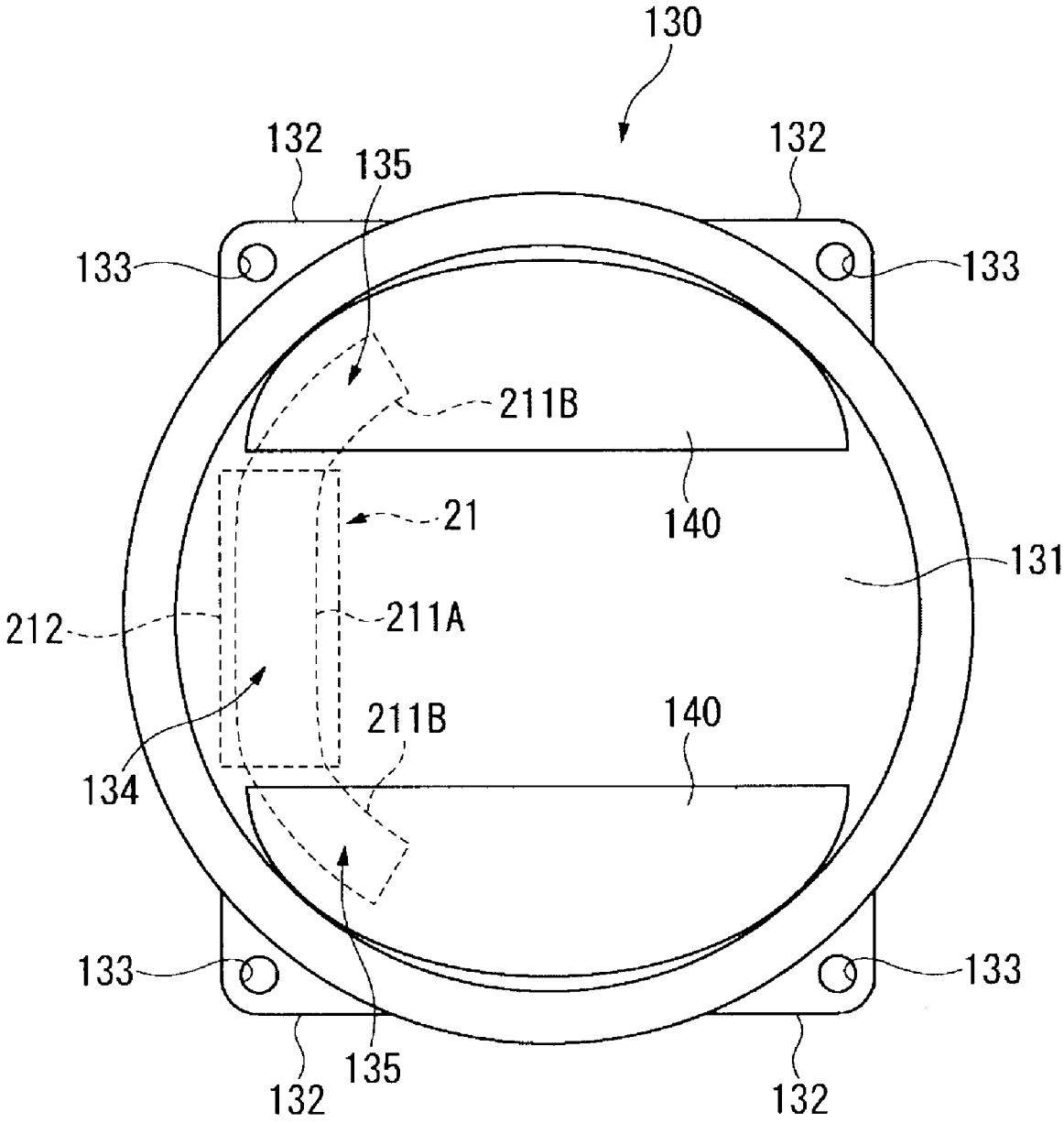
FIG. 20 shows the configuration of the back cover in a variation of the sixth embodiment of the invention.

The size of the extension and the area of the amorphous foil members 140 are not limited to the foregoing. As shown in FIG. 20, for example, the amorphous foil members 140 may be positioned covering the larger part of the 12:00 o'clock and 6:00 o'clock regions on opposite sides of areas extended from the coil-facing area 134. Further alternatively, the pair of amorphous foil members 140 may be located in any positions where the amorphous foil members 140 are not superposed to the coil-facing area 134 and are superposed to the pair of lead-facing areas 135, and the amorphous foil members 140 do not touch each other. This configuration increases the area of the amorphous foil members 140 and improves magnetic flux collection, but magnetic flux lines entering the amorphous foil members 140 at positions relatively distant to the lead-facing areas 135 opposite the lead parts 211B are simply dispersed. Therefore, forming the amorphous foil members 140 in positions proximal to the center line of the timepiece as shown in FIG. 19 enables most efficiently collecting magnetic flux lines that can enter the lead parts 211B.

Effect of the Sixth Embodiment

In the radio-controlled timepiece according to the sixth embodiment of the invention, the amorphous foil members 140 are positioned on the inside surface of the back cover 130 extending substantially along the inside surface of the casing from a position that is not superposed to the coil-facing area 134 and is superposed to substantially the entire area occupied by the lead-facing areas 135 to a position near the center line of the timepiece.

As a result, the amorphous foil member 140 covers a larger area than the amorphous foil member 140 in the fifth embodiment, and thus further improves flux collection. Furthermore, because the magnetic flux lines collected by the amorphous foil member 140 are input to substantially the entire area of the lead parts 211B, more magnetic flux lines enter the magnetic core 211 from the lead parts 211B, and the reception sensitivity of the antenna 21 can be further improved.

Embodiment 7

A radio-controlled timepiece according to a seventh embodiment of the invention is described next with reference to the accompanying figures.

Figure 21:
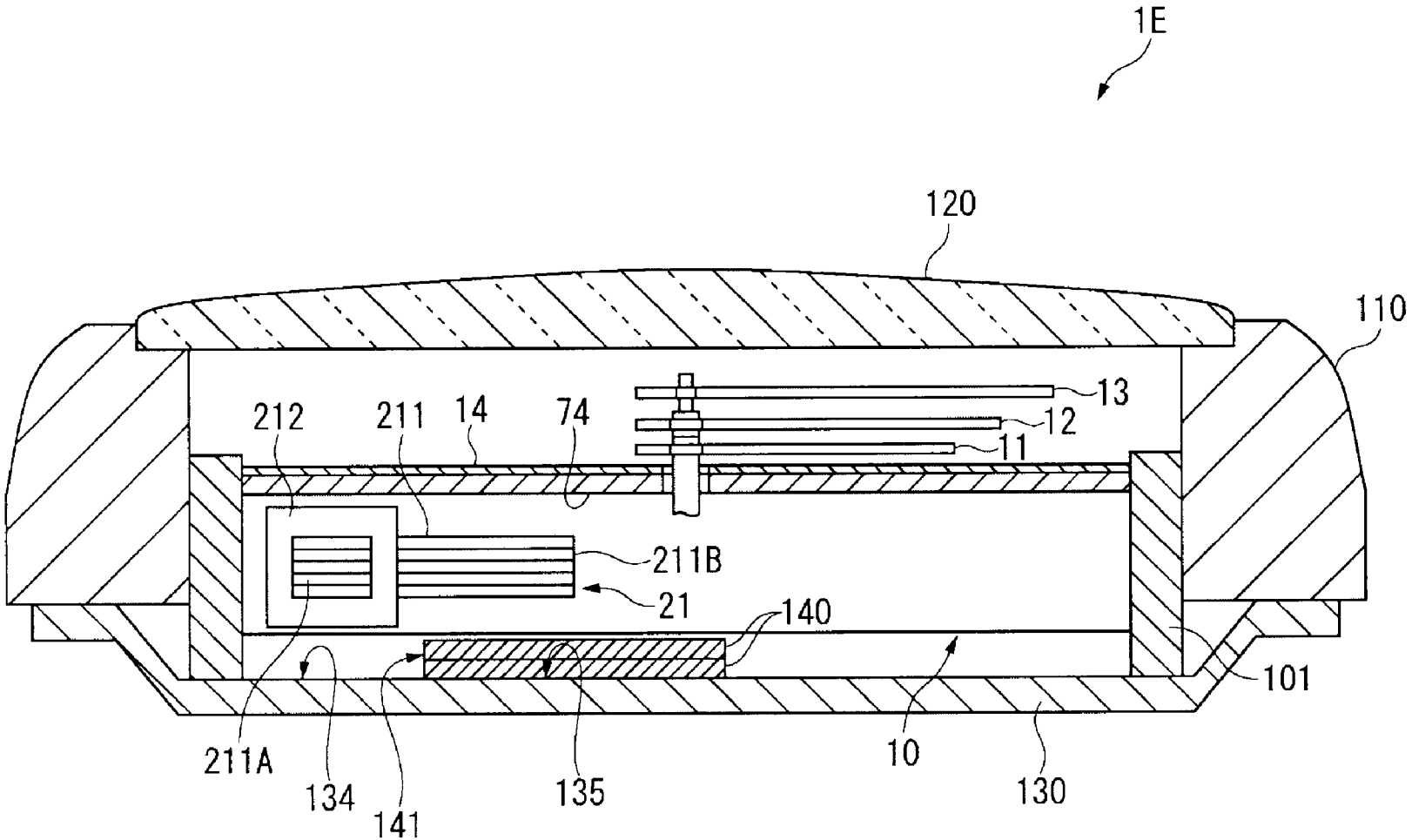
FIG. 21 is a side section view of a radio-controlled timepiece according to a seventh embodiment of the invention.

FIG. 21 is a side section view of a radio-controlled timepiece according to a seventh embodiment of the invention.

The radio-controlled timepiece 1D according to the fifth embodiment described above has a single amorphous foil member 140 adhesively affixed to the back cover 130 opposite each of the pair of lead-facing areas 135. In the radio-controlled timepiece 1E according to this seventh embodiment of the invention, however, a plurality of amorphous foil members 140 are stacked together on the back cover 130 to form an amorphous foil layer 141 opposite each of the pair of lead-facing areas 135.

The amorphous foil layers 141 are formed so that there is a gap of approximately 1 mm, for example, between the top of the amorphous foil layer 141 (the surface facing the module 10) and the module 10.

Effect of a Radio-Controlled Timepiece According to the Seventh Embodiment

As described above, an amorphous foil layer 141 composed of stacked amorphous foil members 140 is formed in the radio-controlled timepiece 1E according to this seventh embodiment of the invention at a position on the inside surface of the back cover 130 that does not overlap the coil-facing area 134 opposite the coil winding part 211A and overlaps at least a part of the lead-facing areas 135 opposite the lead parts 211B.

The thickness of the amorphous foil layer 141 is thus greater than a configuration having a single amorphous foil member 140 affixed, more magnetic flux lines can therefore be collected, and the flux collection effect can be improved. Furthermore, because the distance between the amorphous foil layer 141 and the lead parts 211B is smaller, magnetic flux lines collected by the amorphous foil layer 141 are desirably input to the lead parts 211B, and the flux density passing through the center of the magnetic core 211 can be increased. The flux collection effect of the amorphous foil layer 141 can therefore be improved, and the reception sensitivity of the antenna 21 can be increased.

A small gap is also formed between the top of the amorphous foil layer 141 and the module 10. As a result, if vibration is produced by impact or shock, for example, the amorphous foil layer 141 will not contact the module 10, and damage to the amorphous foil layer 141 can be prevented.

Embodiment 8

A radio-controlled timepiece according to an eighth embodiment of the invention is described next with reference to the accompanying figures.

Figure 22:
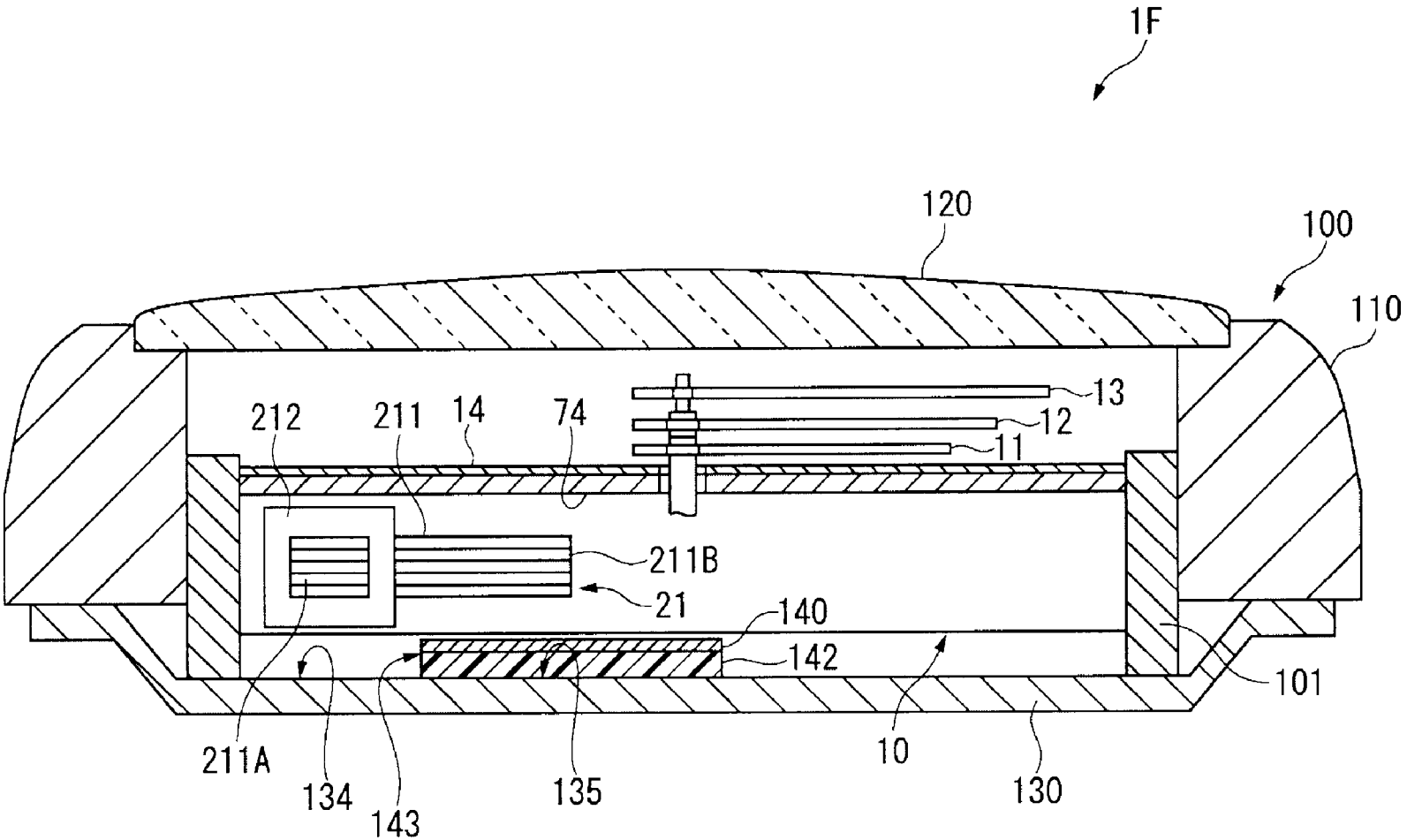
FIG. 22 is a side section view of a radio-controlled timepiece according to an eighth embodiment of the invention.

FIG. 22 is a side section view of a radio-controlled timepiece according to an eighth embodiment of the invention.

In the seventh embodiment of the invention the amorphous foil members 140 are stacked directly on the inside surface of the back cover 130 to form the amorphous foil layer 141. In the radio-controlled timepiece 1F according to the eighth embodiment of the invention, however, a plastic sheet 142 is adhesively affixed as a non-conductive member to the inside surface of the back cover 130, and the amorphous foil members 140 are layered on top of this plastic sheet to form an amorphous foil layer 143.

Note that in FIG. 22 only one amorphous foil member 140 is shown layered on top of the plastic sheet 142, but the invention is not so limited and a plurality of amorphous foil members 140 may be laminated together.

The position where this amorphous foil layer 143 is formed is the same site as in the seventh embodiment, that is, a position where there is no overlap with the coil-facing area 134 and superposed to at least a part of the lead-facing areas 135.

Note that the plastic sheet is not limited to being affixed only at the position where the amorphous foil members 140 are stacked, and may be applied over the entire inside surface of the back cover 130, for example.

Effect of a Radio-Controlled Timepiece According to the Eighth Embodiment

In the radio-controlled timepiece 1F according to the eighth embodiment of the invention a plastic sheet 142 is affixed to the inside surface of the back cover 130, and the amorphous foil member 140 is laminated on top of the plastic sheet 142 to form the amorphous foil layer 143.

The magnetic flux lines produced when signals are received by the antenna 21 thus do not flow from the amorphous foil member 140 to the back cover 130, and the production of eddy current in the back cover 130 can be more effectively suppressed. Furthermore, if the radio-controlled timepiece 1F is subject to shock, the plastic sheet 142 acts as a damper so that stress is not applied directly from the back cover 130 to the amorphous foil member 140. As a result, impact damage to the amorphous foil member 140 can also be prevented.

In addition because the amorphous foil member 140 can be positioned proximally to the lead parts 211B as described in the seventh embodiment, the flux collection effect of the antenna 21 can be improved and good antenna performance can be achieved.

Embodiment 9

A ninth embodiment of the invention is described next with reference to the accompanying figures.

Figure 23:
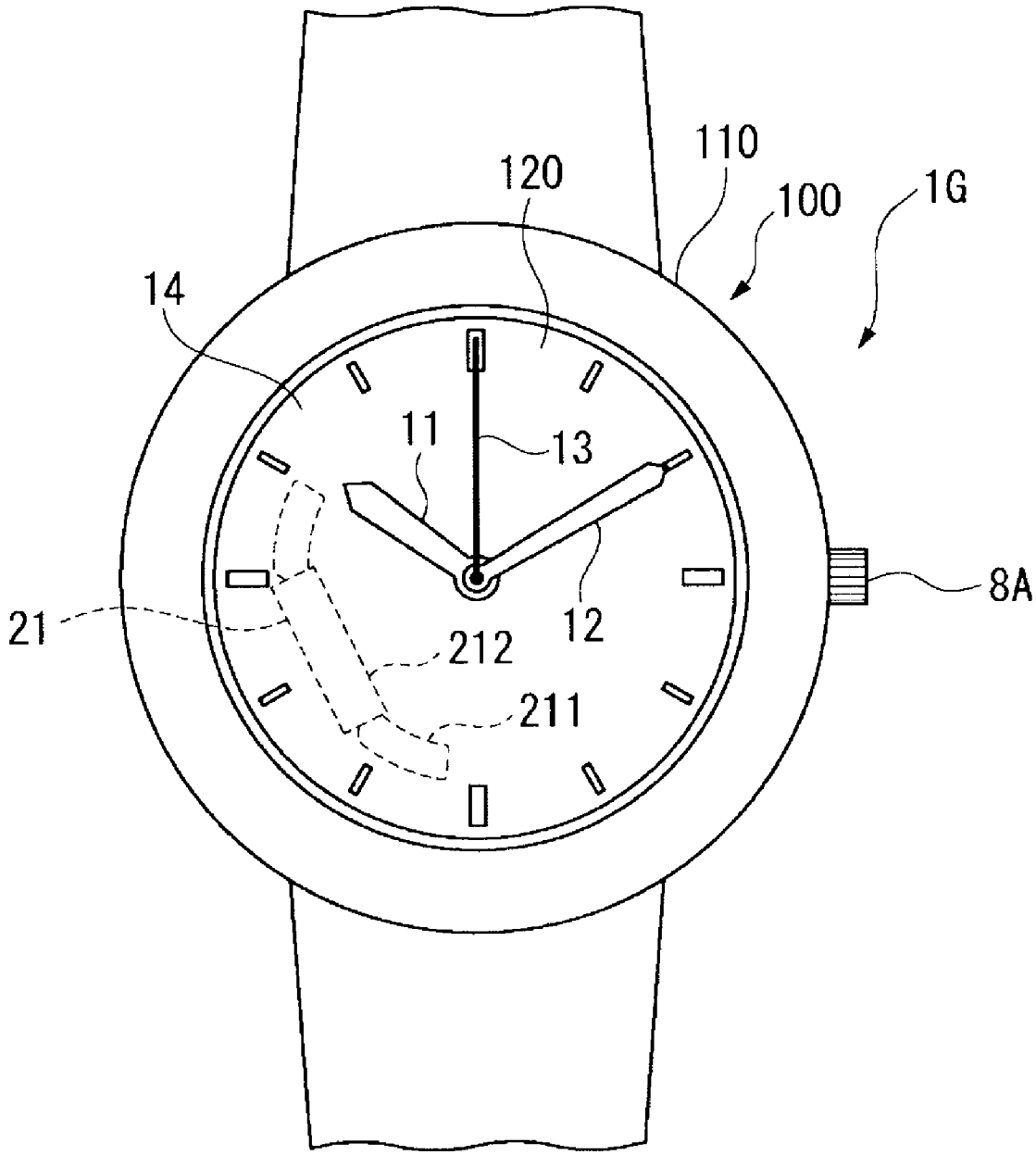
FIG. 23 is a front view of a radio-controlled timepiece as an example of an electronic timepiece with an internal antenna according to a ninth embodiment of the invention.

FIG. 23 is a front view of a radio-controlled timepiece as an example of an electronic timepiece with an internal antenna according to a ninth embodiment of the invention.

As shown in FIG. 23, a radio-controlled timepiece 1G according to this embodiment of the invention is an analog timepiece with hands 11, 12, and 13 and a dial 14, and is a timepiece that can receive long-wave standard time signals as external radio frequency information containing time information, and can correct the positions indicated by the hands 11, 12, and 13 based on the received time information.

The radio-controlled timepiece 1G includes the hands 11, 12, and 13, the dial 14, a module 10 (see FIG. 24) including components for controlling an antenna 21 that receives the standard time signals and driving the hands 11, 12, and 13, and an external case 100 that houses within the hands 11, 12, and 13, dial 14, and module 10.

The dial 14 is preferably made from a non-electrically conductive material such as plastic or ceramic so that the dial 14 does not interfere with standard time signal waves entering the timepiece from the crystal side and signals can be received with good reception.

Module Configuration

The module 10 used in the radio-controlled timepiece 1G is described below with reference to FIG. 24 to FIG. 28.

Figure 24:
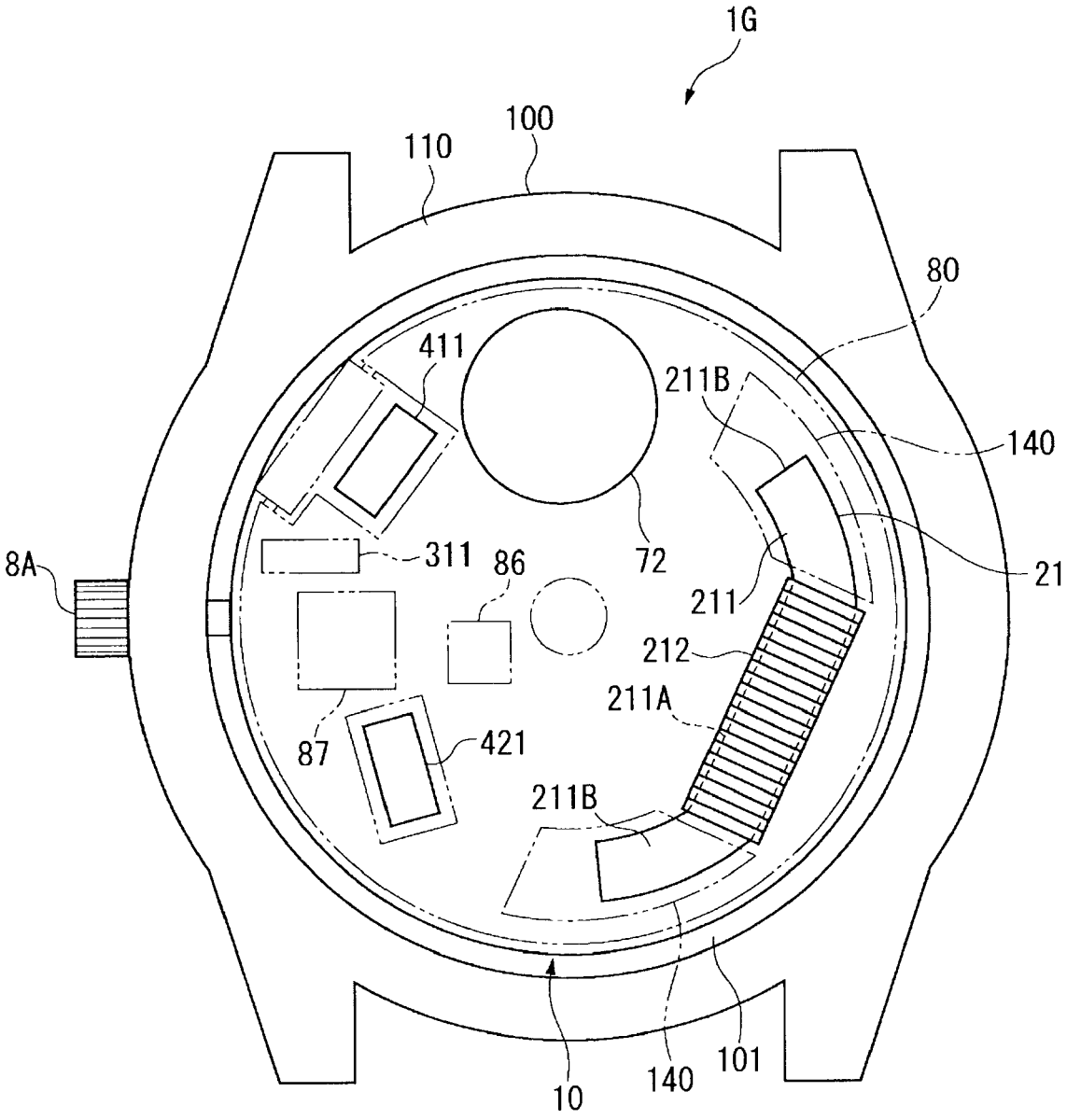
FIG. 24 is a plan view showing the inside of a radio-controlled timepiece according to a ninth embodiment of the invention from the back cover side with the circuit board removed.

FIG. 24 is a plan view showing the inside of a radio-controlled timepiece according to a ninth embodiment of the invention from the back cover side with the circuit board removed.

Figure 25:
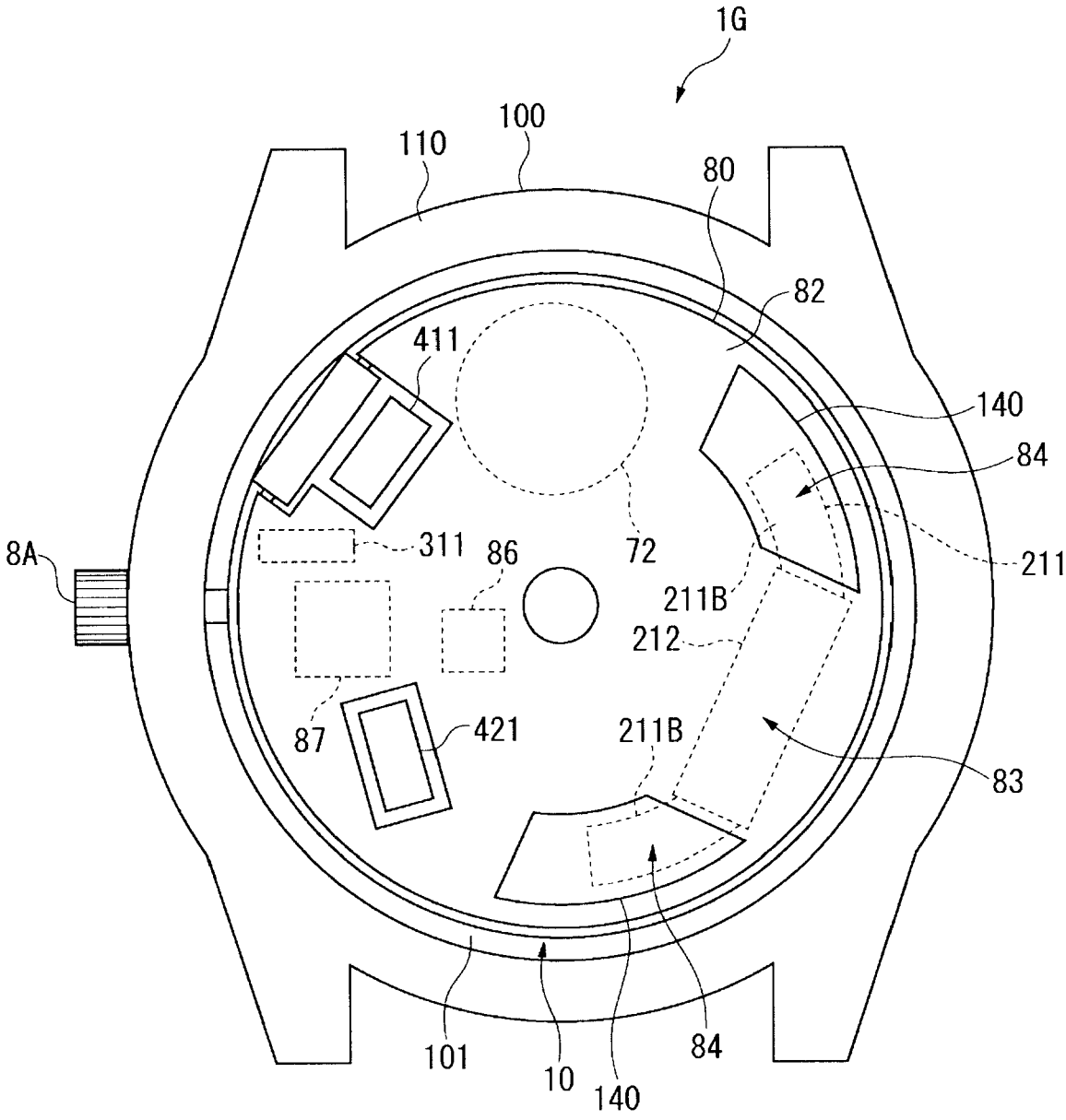
FIG. 25 is a plan view showing the inside of a radio-controlled timepiece according to a ninth embodiment of the invention from the back cover side with the circuit board installed.

FIG. 25 is a plan view showing the inside of a radio-controlled timepiece according to a ninth embodiment of the invention from the back cover side with the circuit board installed.

Figure 26:
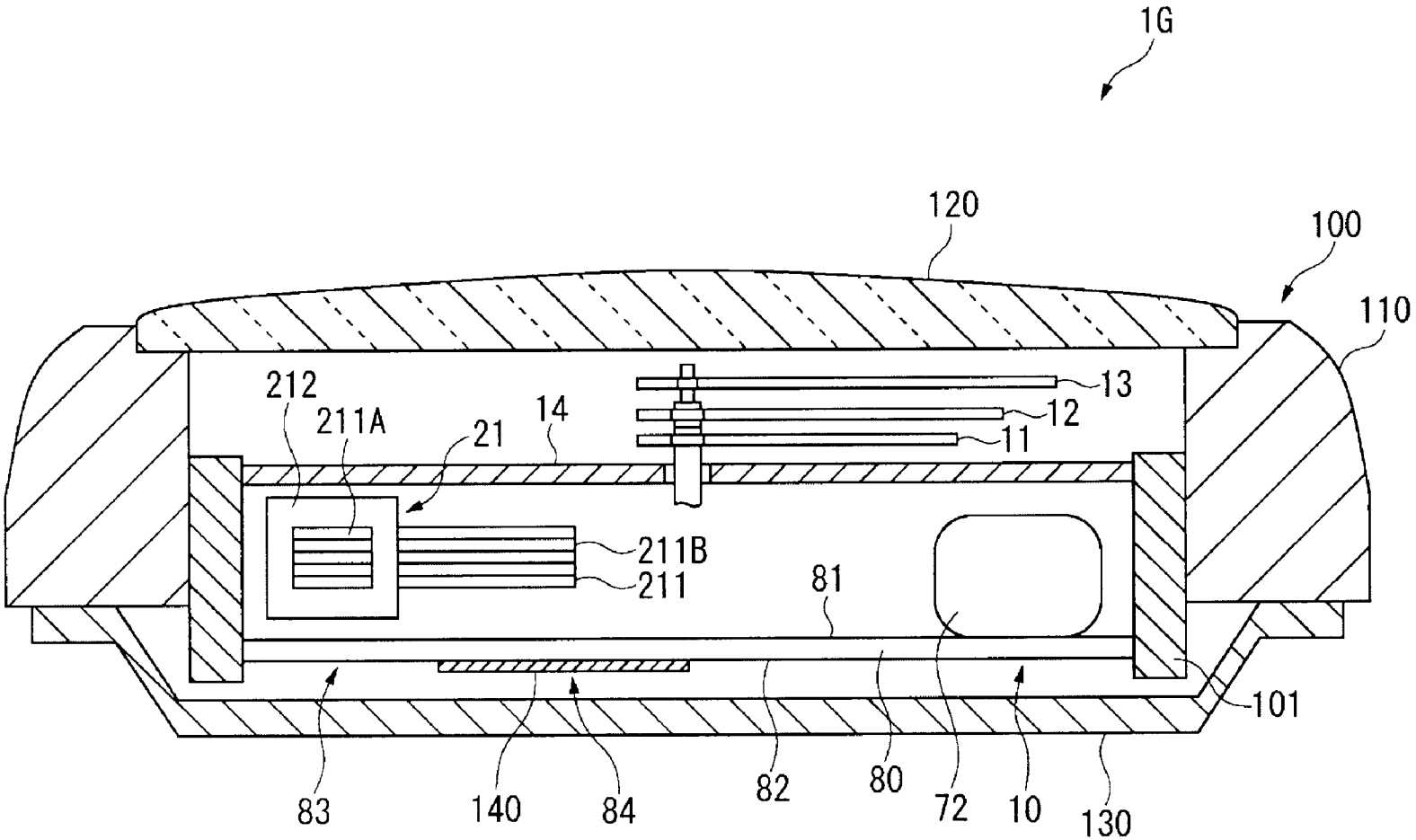
FIG. 26 is a side section view through the thickness of a radio-controlled timepiece according to the ninth embodiment of the invention.

FIG. 26 is a side section view through the thickness of a radio-controlled timepiece according to the ninth embodiment of the invention.

Figure 27:
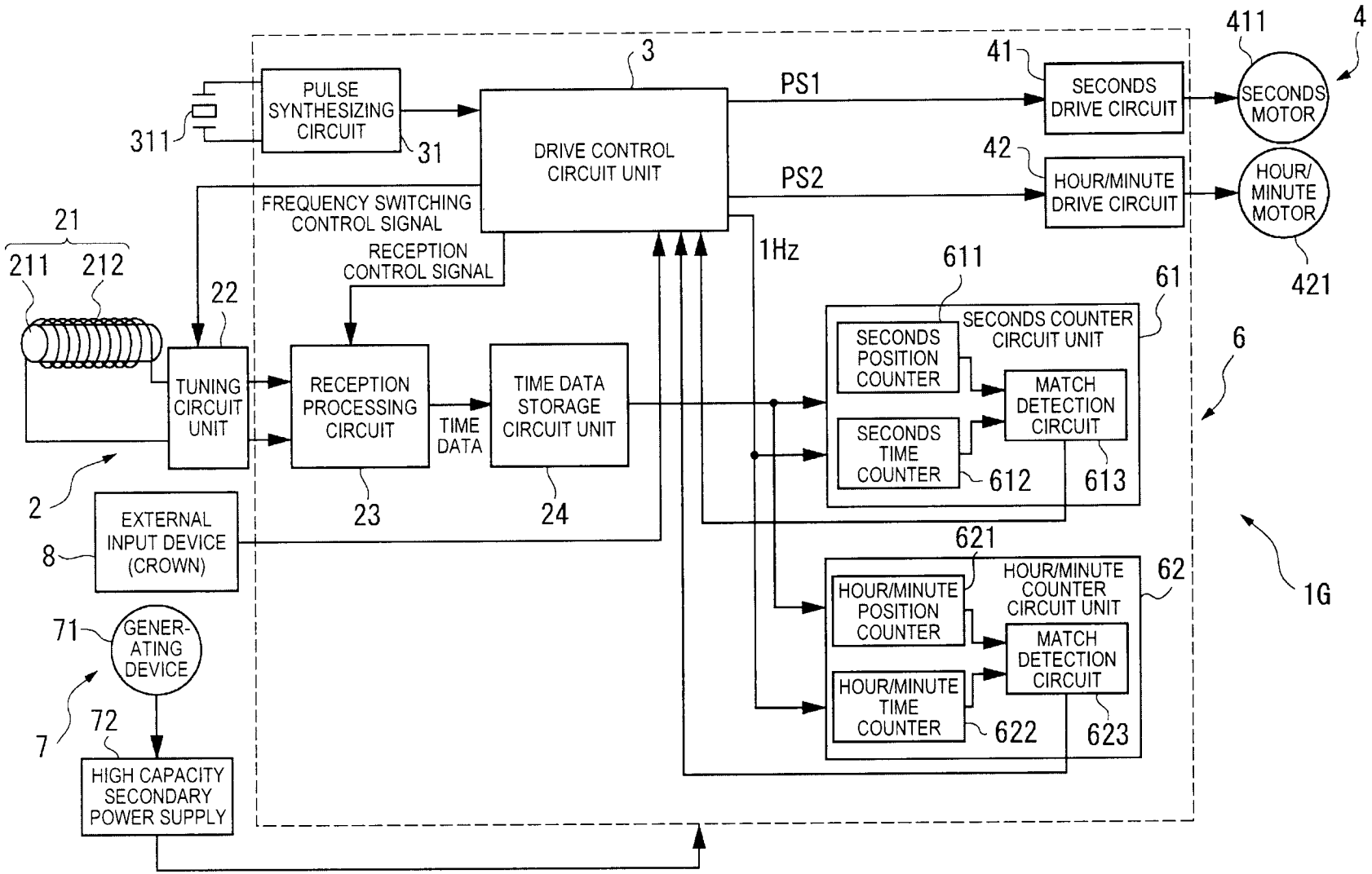
FIG. 27 is a schematic block diagram showing the configuration of a radio-controlled timepiece according to the ninth embodiment of the invention.

FIG. 27 is a schematic block diagram showing the configuration of a radio-controlled timepiece according to the ninth embodiment of the invention.

Figure 28:
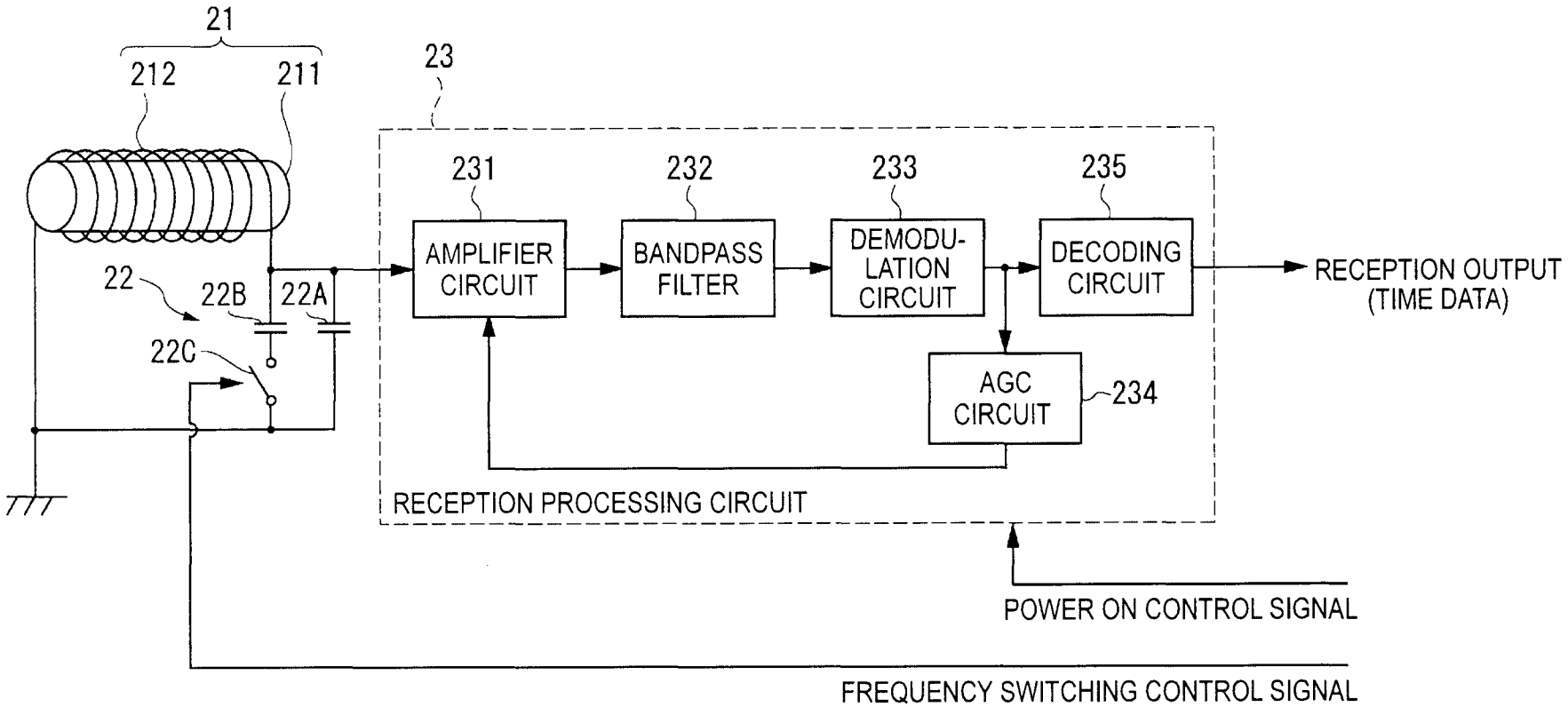
FIG. 28 is a block diagram showing the configuration of the reception circuit unit in a radio-controlled timepiece according to the ninth embodiment of the invention.

FIG. 28 is a block diagram showing the configuration of the reception circuit unit in a radio-controlled timepiece according to the ninth embodiment of the invention.

The module 10 has a plastic module spacer 101 that is round when seen in plan view (see FIG. 26), and is secured by being press fit, for example, to the inside of the external case 100.

Note that a plurality of bosses may be positioned projecting from the outside surface of the module spacer 101 so that when the module spacer 101 is housed in the external case 100, the bosses contact the inside circumference surface of the external case 100 and hold the module spacer 101 in place.

Assembled on the inside of the module spacer 101 in the module 10 are components including a circuit board 80, the movement, a high capacity secondary power supply (storage battery) 72 forming a power supply 7, and an antenna 21 for receiving signals. The circuit board 80 is populated with devices including a reception chip 86, a CPU 87, and a reference oscillator 311. The movement includes motors 411 and 421 that are part of the drive unit 4, and a wheel train.

The module spacer 101 of the module 10 in this embodiment is substantially container shaped, and the circuit board 80 is fastened by, for example, being press fit to the back cover 130 side of the module spacer 101. The module 10 is then held in the external case 100 so that the circuit board 80 faces the back cover 130.

The antenna 21 is located near the 9:00 o'clock position of the timepiece dial conforming substantially to the inside surface of the module spacer 101.

The antenna 21 has a magnetic core 211 and a coil 212 wound around the magnetic core 211.

The magnetic core 211 is substantially square in section as shown in FIG. 26. As shown in FIG. 24, the magnetic core 211 has a straight coil winding part 211A around which the coil 212 is wound, and lead parts 211B that extend from both ends of the coil winding part 211A conforming substantially to the inside surface of the casing 110 that forms the body of the external case 100.

The magnetic core 211 is made by adhesively stacking approximately 10 to 30 foil layers stamped or etched from a cobalt-based amorphous foil sheet (such as amorphous foil containing at least 50 wt % Co), and heat treating the foil layers by annealing, for example, to stabilize the magnetic characteristics. The magnetic core 211 is thus formed by stacking flat amorphous foil layers in the thickness direction of the timepiece. The magnetic core 211 is not limited to a layered amorphous foil construction, and may be made using a ferrite material that is shaped using a mold and then heat treated.

The coil 212 must have an inductance of approximately 10 mH to receive long-wave standard time signals in the 40-77.5 kHz range. In this embodiment of the invention the coil 212 was made by wrapping several hundred winds of an approximately 0.1 μm diameter polyurethane-coated magnet wire around the core.

As shown in FIG. 25, an area superposed on the coil 212 when the radio-controlled timepiece 1G is seen in plan view from the crystal or back cover side is defined as a coil-overlapping area 83. The area superposed on the lead parts 211B in the same view is defined as a lead-overlapping area 84.

The antenna 21 and the reception chip 86 described below positioned on the circuit board 80 are connected by two leads. More specifically, the antenna 21 and the reception chip 86 are electrically connected by soldering the coil 212 at an end part of the antenna to the circuit board. This enables outputting the standard time signal received by the antenna 21 to the reception processor 2. Note that the electrical connection may alternatively be made by attaching a flexible circuit made of polyimide, for example, to the antenna 21, and fastening this circuit to the circuit board 80 with a screw.

The circuit board 80 is described next with reference to the figures. As shown in FIG. 27, the circuit devices positioned on the circuit board 80 include a reception processor 2 for processing the received signals, a drive control circuit unit 3, a drive unit 4 for driving the hands, and a counter unit 6 for counting the time.

The reception processor 2 includes the antenna 21 for receiving signals, a tuning circuit unit 22 composed of a capacitor and other components for tuning to the signal received by the antenna 21, a reception processing circuit 23 that processes information received by the antenna 21, and a time data storage circuit unit 24 that stores the time data processed by the reception processing circuit 23.

As shown in FIG. 28, the tuning circuit unit 22 includes two capacitors 22A and 22B parallel connected to the antenna 21 with one capacitor 22B connected to the antenna 21 through a switch 22C.

The frequency of the signal received by the antenna 21 can be changed by a frequency switching control signal that is output from the drive control circuit unit 3 and causes the switch 22C to turn on or off. This enables switching and receiving long-wave standard time signals of two different frequencies, such as the 40-kHz signals that are transmitted by the standard time signal transmission station at Mount Otakadoya (for eastern Japan) and the 60-kHz signals that are transmitted by the transmission station at Mount Hagane (for western Japan) in Japan.

As also shown in FIG. 28, the reception processing circuit 23 includes an amplifier circuit 231, a bandpass filter 232, a demodulation circuit 233, an automatic gain control (AGC) circuit 234, and a decoding circuit 235.

The amplifier circuit 231 amplifies the long-wave standard time signal received by the antenna 21. The bandpass filter 232 extracts the desired frequency component from the amplified long-wave standard time signal. The demodulation circuit 233 smoothes and demodulates the extracted long-wave standard time signal. The AGC circuit 234 controls the gain of the amplifier circuit 231 to keep the reception level of the long-wave standard time signal constant. The decoding circuit 235 then decodes and outputs the demodulated long-wave standard time signal.

The time data that is received and signal processed by the reception processing circuit 23 is output to and stored by the time data storage circuit unit 24 as shown in FIG. 27.

The reception processing circuit 23 starts receiving time information based on a reception control signal output from the drive control circuit unit 3 according to a predetermined reception schedule or when reception is started unconditionally by operation of an external input device 8.

As shown in FIG. 27, a pulse signal from the pulse synthesizing circuit 31 is input to the drive control circuit unit 3. The pulse synthesizing circuit 31 frequency divides a reference pulse from the reference oscillator 311, such as a crystal oscillator, to generate a clock pulse, and generates pulse signals of different pulse widths and timing from the reference pulse. The reference oscillator 311 is connected to the CPU 87 and produces a clock signal for the circuitry, and is located away from the antenna 21 because the clock signal frequency is near the frequency of the received long-wave standard time signal and produces noise if mixed with the signals received by the antenna 21.

The drive control circuit unit 3 outputs a seconds drive pulse signal PS1 that is output once a second for driving the second hand, and an hour/minute drive pulse signal PS2 that is output once a minute for driving the hour and minute hands, to the seconds drive circuit 41 and hour/minute drive circuit 42. Based on the pulse signals output from the drive control circuit unit 3, the drive circuits 41 and 42 drive the seconds motor 411 and hour/minute motor 421, which are stepping motors, thus driving the second hand and the minute and hour hands that are connected to the motors 411 and 421. The hands, dial, motors 411 and 421, and drive circuits 41 and 42 thus form a time display for displaying the time. Note that the time display may also drive the hour hand, minute hand, and second hand using a single motor.

The counter unit 6 includes a seconds counter circuit unit 61 for counting the seconds, and a hour/minute counter circuit unit 62 for counting the hour and minute.

The seconds counter circuit unit 61 includes a seconds position counter 611, a seconds time counter 612, and a match detection circuit 613. The seconds position counter 611 and seconds time counter 612 are both counters that loop at the 60 count, that is, every 60 seconds when a 1-Hz signal is input. The seconds position counter 611 counts the drive pulse signal (seconds drive pulse signal PS1) that is supplied from the drive control circuit unit 3 to the seconds drive circuit 41. More specifically, the position that is pointed to by the second hand is counted by counting the drive pulse signal that drives the second hand.

The seconds time counter 612 normally counts the 1-Hz reference pulse (clock pulse) that is output from the drive control circuit unit 3. If time data is received by the reception processor 2, the counter is adjusted to match the seconds value in the received time data.

The hour/minute counter circuit unit 62 similarly includes an hour/minute position counter 621, an hour/minute time counter 622, and a match detection circuit 623. The hour/minute position counter 621 and hour/minute time counter 622 are both counters that loop when signals equal to 24 hours are input. The hour/minute position counter 621 counts the drive pulse signal (hour/minute drive pulse signal PS2) that is supplied from the drive control circuit unit 3 to the hour/minute drive circuit 42, and counts the positions that are pointed to by the hour hand and minute hand.

The hour/minute time counter 622 normally counts a 1-Hz clock pulse that is output from the drive control circuit unit 3. More precisely, the hour/minute time counter 622 increments 1 when sixty 1-Hz pulses are counted. If time data is received by the reception processor 2, the counter is adjusted to match the hour and minute values in the received time data.

The match detection circuits 613 and 623 detect if the counts of the position counters 611 and 621 and the counts of the time counters 612 and 622 match, and output a detection signal indicating whether or not the counts match to the drive control circuit unit 3.

If a mismatch signal is input from the match detection circuits 613 and 623, the drive control circuit unit 3 continues outputting the drive pulse signals PS1 and PS2 until a match signal is input. If the 1-Hz reference signal from the drive control circuit unit 3 causes the count of the time counters 612 and 622 to change and a mismatch with the position counters 611 and 621 occurs during the normal timekeeping operation of the movement, the drive pulse signals PS1 and PS2 are output so that the hands move and the position counters 611 and 621 again match the time counters 612 and 622. This operation keeps repeating and the movement is controlled as usual.

When time counters 612 and 622 are adjusted to the received time data, the drive pulse signals PS1 and PS2 are output continuously and the hands are moved quickly and adjusted to the correct time until the counts of the position counters 611 and 621 and the time counters 612 and 622 match.

The circuit elements such as the wiring pattern connecting the reception processor 2, drive control circuit unit 3, drive unit 4, counter unit 6, and other devices on the circuit board 80 are positioned on the antenna-facing surface 81 of the circuit board 80 on the side facing the antenna 21 described below at a position that is not opposite the antenna 21. More specifically, because the effect of the electrical operation of these various circuit elements on the magnetic field can affect the performance of the antenna 21, these circuit elements are positioned at a position separated from the antenna 21 as shown in FIG. 24 to avoid a drop in antenna performance.

An amorphous foil member 140 is also adhesively affixed as a magnetic member on the antenna-facing surface 81 of the circuit board 80 opposite the antenna 21 as shown in FIG. 25 and FIG. 26.

More specifically, when the inside of the radio-controlled timepiece 1G is seen in plan view from the back cover side as shown in FIG. 25, amorphous foil members 140 are adhesively affixed to the back cover side 82 of the circuit board 80 facing the back cover 130 at positions that are outside of the coil-overlapping area 83 superposed on the coil 212 of the antenna 21, and are partially within the pair of lead-overlapping areas 84 that are superposed on the pair of lead parts 211B of the antenna 21. These two amorphous foil members 140 are formed extending in the direction in which the lead parts 211B project from the coil 212 (that is, away from the coil 212) when seen in plan view. The amorphous foil members 140 are larger in area than the lead-overlapping areas 84. The amorphous foil members 140 are also bonded to the back cover side 82 through an intervening adhesive layer not shown formed by applying adhesive.

This amorphous foil member 140 is a cobalt-based amorphous foil made of Co—Fe—Ni—B—Si, for example. The relative magnetic permeability of an amorphous foil member 140 made of a Co—Fe—Ni—B—Si cobalt-based amorphous foil, for example, is 20,000, and the permeability is significantly higher than the circuit board 80. Ambient magnetic flux lines therefore collect in the amorphous foil members 140, the field strength rises, and more flux lines pass from the amorphous foil members 140 through the lead parts 211B into the magnetic core 211.

A test sample was prepared with the amorphous foil members 140 positioned to the circuit board 80 at locations superimposed on the coil-overlapping area 83 and the lead-overlapping area 84, and another sample was prepared with the amorphous foil members 140 not superimposed on the coil-overlapping area 83 but superimposed on the lead-overlapping area 84. The reception sensitivity of the antenna 21 was then measured in both samples, and the results are shown in FIG. 29.

As shown in FIG. 29, an improvement in reception sensitivity was not observed when the amorphous foil members 140 are located at positions superimposed on the coil-overlapping area 83. More specifically, when a part of the amorphous foil member 140 overlaps the lead-overlapping area 84, the distance from the amorphous foil member 140 to the coil 212 becomes closer, magnetic flux lines collected in the coil 212 escape from the part of the amorphous foil members 140 overlapping the coil-overlapping area 83, reception sensitivity does not improve, and the desired effect of improving antenna performance is not achieved. However, when the amorphous foil members 140 are located at positions not overlapping the coil-overlapping area 83 and overlapping the lead-overlapping area, a 2 dB improvement in the reception sensitivity of the antenna 21 was confirmed compared with a configuration not having the amorphous foil members 140.

A power supply 7 includes a generating device 71 and the high capacity secondary power supply 72. The generating device 71 is a power generator formed by a self-winding generator or a solar cell (solar generator). The high capacity secondary power supply 72 stores power generated by the generating device 71. The high capacity secondary power supply 72 may be a lithium ion battery or other type of secondary cell. A primary cell such as a silver oxide battery may alternatively be used as the power supply 7. Note that because the high capacity secondary power supply 72 has a stainless steel case, it is located at a position in the module 10 separated from the antenna 21 as shown in FIG. 24.

The external input device 8 used as an external input has a crown 8A and is used to set the time and start reception, for example.

Configuration of the External Case

The configuration of the external case 100 of the radio-controlled timepiece 1G is described next.

As shown in FIG. 24 to FIG. 26, the external case 100 includes the casing 110, a crystal 120 attached to the dial side of the casing 110, and a metal back cover 130 removably attached to the back side of the casing 110 (the side on the bottom).

The casing 110 may be made of metal, such as stainless steel, brass, or titanium. The casing 110 in this embodiment of the invention is substantially cylindrical and the inside surface is substantially round when seen in plan view. Note that, for example, a magnetic member for preventing eddy currents produced in a secondary magnetic path by the antenna 21 receiving radio waves may be positioned on the back cover 130 or casing 110.

Effect of a Radio-Controlled Timepiece According to the Ninth Embodiment

As described above, an amorphous foil member 140 is adhesively affixed in a radio-controlled timepiece 1G according to the ninth embodiment of the invention on the back cover side 82 of the circuit board 80 at a position that is not superposed on the coil-overlapping area 83 and is superposed on a part of the lead-overlapping area 84.

This amorphous foil member 140 enables collecting more magnetic flux lines, guides the magnetic flux lines to the lead parts 211B, and thus improves flux collection by antenna 21.

Furthermore, because the amorphous foil member 140 is not positioned within the coil-overlapping area 83, magnetic flux lines collected by the amorphous foil member 140 do not escape into the coil 212, and the magnetic flux lines can be concentrated and collected in the lead parts 211B of the magnetic core 211. Therefore, more magnetic flux lines pass through the inside of the magnetic core 211, the flux density also increases, standard time signals can be captured more easily, and the performance of the antenna 21 can be improved.

Furthermore, because the amorphous foil member 140 is adhesively affixed to the back cover side 82 of the circuit board 80, that is, to a flat surface, the amorphous foil member 140 can be easily located in the desired position.

Furthermore, because other circuit elements do not protrude from the back cover side 82 of the circuit board 80, sufficient space can be easily provided for the amorphous foil member 140. The area of the amorphous foil member 140 can therefore be increased, magnetic flux lines can be more easily captured, and antenna performance can be further improved.

An amorphous foil member 140 is used as the magnetic member in this embodiment of the invention. The permeability of this amorphous foil member 140 is significantly greater than the timepiece parts other than the magnetic core 211 of the antenna 21, particularly the circuit board 80, the casing 110, and the back cover 130. Ambient magnetic flux lines can thus be efficiently gathered in the amorphous foil member 140. More magnetic flux lines are thus input to the magnetic core 211 from the amorphous foil members 140 through the lead parts 211B, the magnetic flux collection effect of the antenna 21 is improved, and antenna performance can be improved.

The amorphous foil members 140 are formed extending in the same directions as the lead parts 211B, and cover a larger area than the lead-overlapping areas 84.

More magnetic flux lines are thus gathered in the amorphous foil members 140, and more magnetic flux lines are input to the lead parts 211B. The flux density in the center of the magnetic core 211 is thus also increased, and reception sensitivity can be further improved.

The amorphous foil members 140 are made of foil and are adhesively affixed using an adhesive layer. As a result, the thickness of the amorphous foil members 140 and the adhesive layer can be sufficiently reduced compared with the configuration of the related art that uses a magnetic sheet having an amorphous metal blended with a plastic sheet, and the amorphous foil members 140 can be easily positioned in the small gap between the back cover side 82 of the circuit board 80 and the back cover 130. The thickness of the radio-controlled timepiece 1G is thus not increased and a good design can be achieved.

Embodiment 10

A tenth embodiment of the invention is described next with reference to the accompanying figures. Note that in the figures and embodiments described below parts that are the same as in the radio-controlled timepiece 1G according to the ninth embodiment described above are identified by the same reference numerals, and further description thereof is simplified or omitted.

Figure 30:
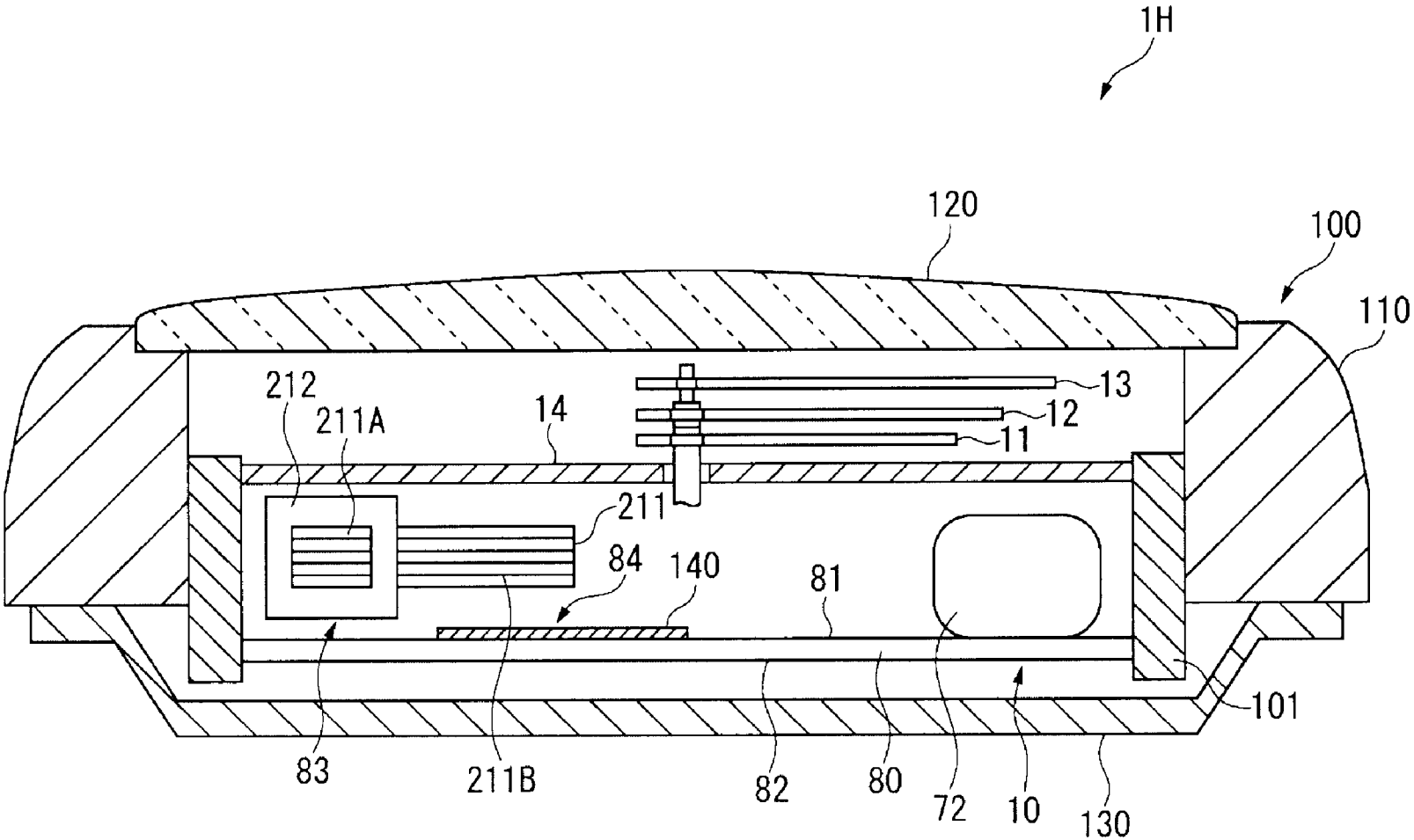
FIG. 30 is a side section view schematically showing a radio-controlled timepiece according to a tenth embodiment of the invention.

FIG. 30 is a side section view schematically showing a radio-controlled timepiece according to a tenth embodiment of the invention.

The radio-controlled timepiece 1H according to the tenth embodiment of the invention differs from the radio-controlled timepiece 1G according to the ninth embodiment of the invention in where the amorphous foil member 140 is positioned.

In a radio-controlled timepiece 1H according to the tenth embodiment of the invention the amorphous foil member 140 is adhesively affixed in the antenna-facing surface 81 of the circuit board 80 opposite the antenna 21. More specifically, as shown in FIG. 30, the amorphous foil member 140 is adhesively affixed on the antenna-facing surface 81 at a position where the amorphous foil member 140 is not superposed on the coil-overlapping area 83 and is superposed on the lead-overlapping area 84. In this position the amorphous foil member 140 is adhesively affixed by an intervening adhesive layer formed with an adhesive, for example, at a position where it is not superposed on any circuit elements positioned on the circuit board 80, including the reception chip 86, the CPU 87, and the reference oscillator 311.

Effect of a Radio-Controlled Timepiece According to the Tenth Embodiment

In addition to the effect of the radio-controlled timepiece 1G according to the ninth embodiment of the invention described above, the radio-controlled timepiece 1H according to the tenth embodiment of the invention has the following effect.

That is, the amorphous foil member 140 is adhesively affixed on the antenna-facing surface 81 of the circuit board 80 at a position where the amorphous foil member 140 is not superposed on the coil-overlapping area 83 and is superposed to at least a part of the lead-overlapping area 84. Compared with positioning the amorphous foil member 140 on the back cover side 82 of the circuit board 80, this aspect of the invention shortens the distance between the amorphous foil member 140 and the lead parts 211B. As a result, magnetic flux lines attracted by the amorphous foil member 140 are guided more easily to the lead parts 211B, and the flux density in the magnetic core 211 can be increased. The performance of the antenna 21 can therefore also be improved.

Embodiment 11

An eleventh embodiment of the invention is described next with reference to the accompanying figures.

Figure 31:
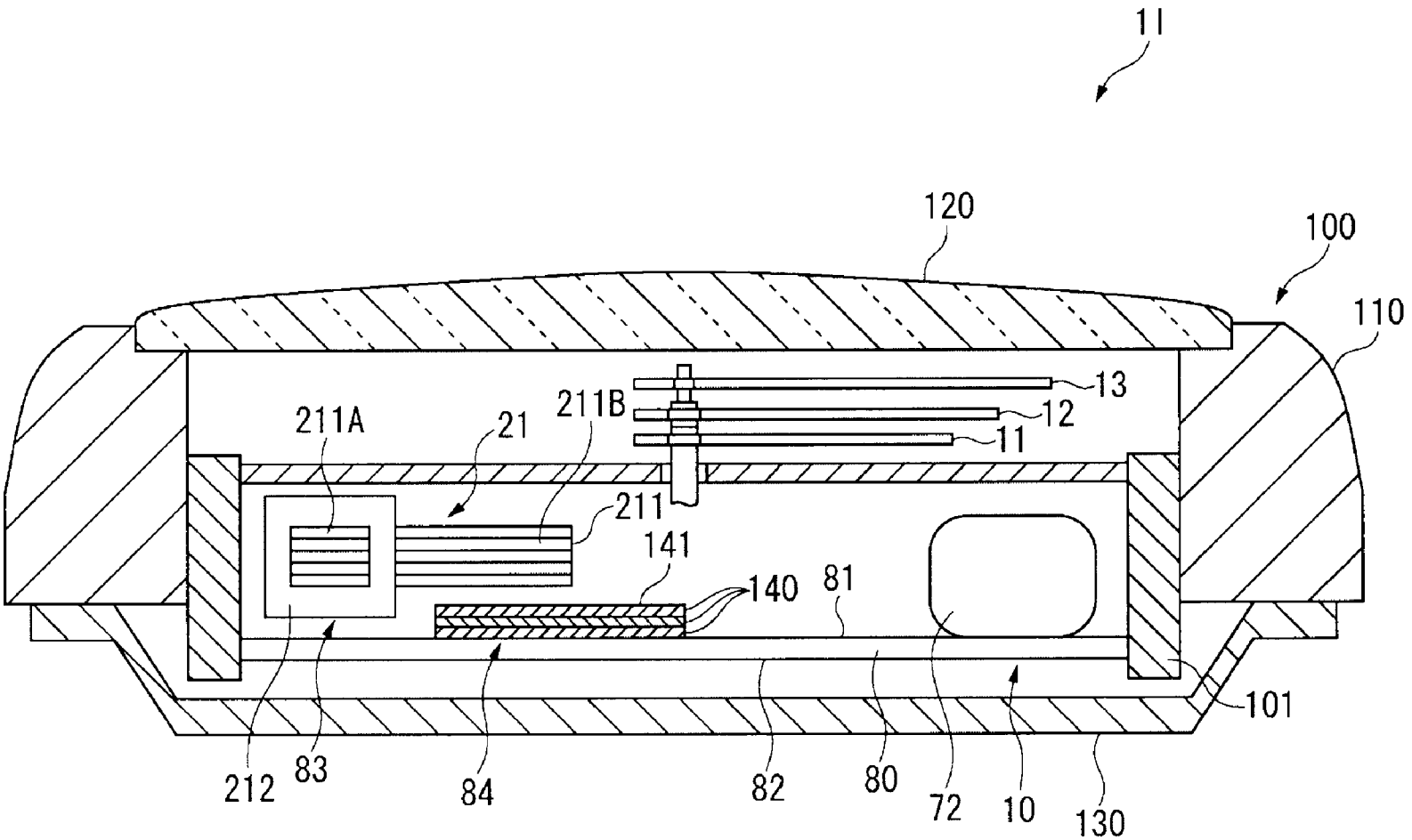
FIG. 31 is a side section view schematically showing a radio-controlled timepiece according to an eleventh embodiment of the invention.

FIG. 31 is a side section view schematically showing a radio-controlled timepiece according to an eleventh embodiment of the invention.

The radio-controlled timepiece 1I according to the eleventh embodiment of the invention differs from the radio-controlled timepiece 1H according to the tenth embodiment of the invention in the configuration of the amorphous foil member 140. More specifically, the radio-controlled timepiece 1I according to the eleventh embodiment of the invention has an amorphous foil layer 141 composed of a plurality of layered amorphous foil members 140 positioned on the antenna-facing surface 81 of the circuit board 80 at a position where it is not superposed on the coil-overlapping area 83 and is superposed on the lead-overlapping area 84. The amorphous foil layer 141 is formed by adhesively affixing a plurality of amorphous foil members 140 together in a stack by using intervening adhesive layers formed by an adhesive coating, and then adhesively affixing the amorphous foil layer 141 to the circuit board 80 with an adhesive.

A gap of a predetermined size is formed between the surface of the amorphous foil layer 141 facing the lead parts 211B and the lead parts 211B. This gap functions to protect the lead parts 211B and amorphous foil layer 141 when, for example, impact is applied to the radio-controlled timepiece 1I. More specifically, even if an impact that causes the amorphous foil layer 141 or lead parts 211B to vibrate is applied, the amorphous foil layer 141 and lead parts 211B do not collide with each other due to this vibration, and damage thereto is thus prevented.

Effect of a Radio-Controlled Timepiece According to the Eleventh Embodiment

As described above, the radio-controlled timepiece 1I according to the eleventh embodiment of the invention has an amorphous foil layer 141 composed of a plurality of layered amorphous foil members 140 positioned on the antenna-facing surface 81 of the circuit board 80 at a position where it is not superposed on the coil-overlapping area 83 and is superposed to at least a part of the lead-overlapping area 84.

The thickness of the resulting amorphous foil layer 141 is thus greater than the thickness of a single adhesively affixed amorphous foil member 140, more magnetic flux lines can be collected, and the flux collection effect can be improved. The performance of the antenna 21 can therefore be improved.

Furthermore, because the amorphous foil layer 141 is laminated to the antenna-facing surface 81 of the circuit board 80, the distance between the amorphous foil layer 141 and the lead parts 211B is shortened, and the collected magnetic flux lines can be more reliably input to the lead parts 211B. The flux density in the magnetic core 211 is thus increased, and antenna performance can be improved.

A gap of a predetermined size is also positioned between the amorphous foil layer 141 and the lead parts 211B. As a result, even if the radio-controlled timepiece 1I is subject to shock that causes the lead parts 211B or amorphous foil layer 141 to vibrate, the lead parts 211B and amorphous foil layer 141 will not collide, and damage to the lead parts 211B and amorphous foil layer 141 can be prevented.

Embodiment 12

A twelfth embodiment of the invention is described next with reference to the accompanying figures.

Figure 32:
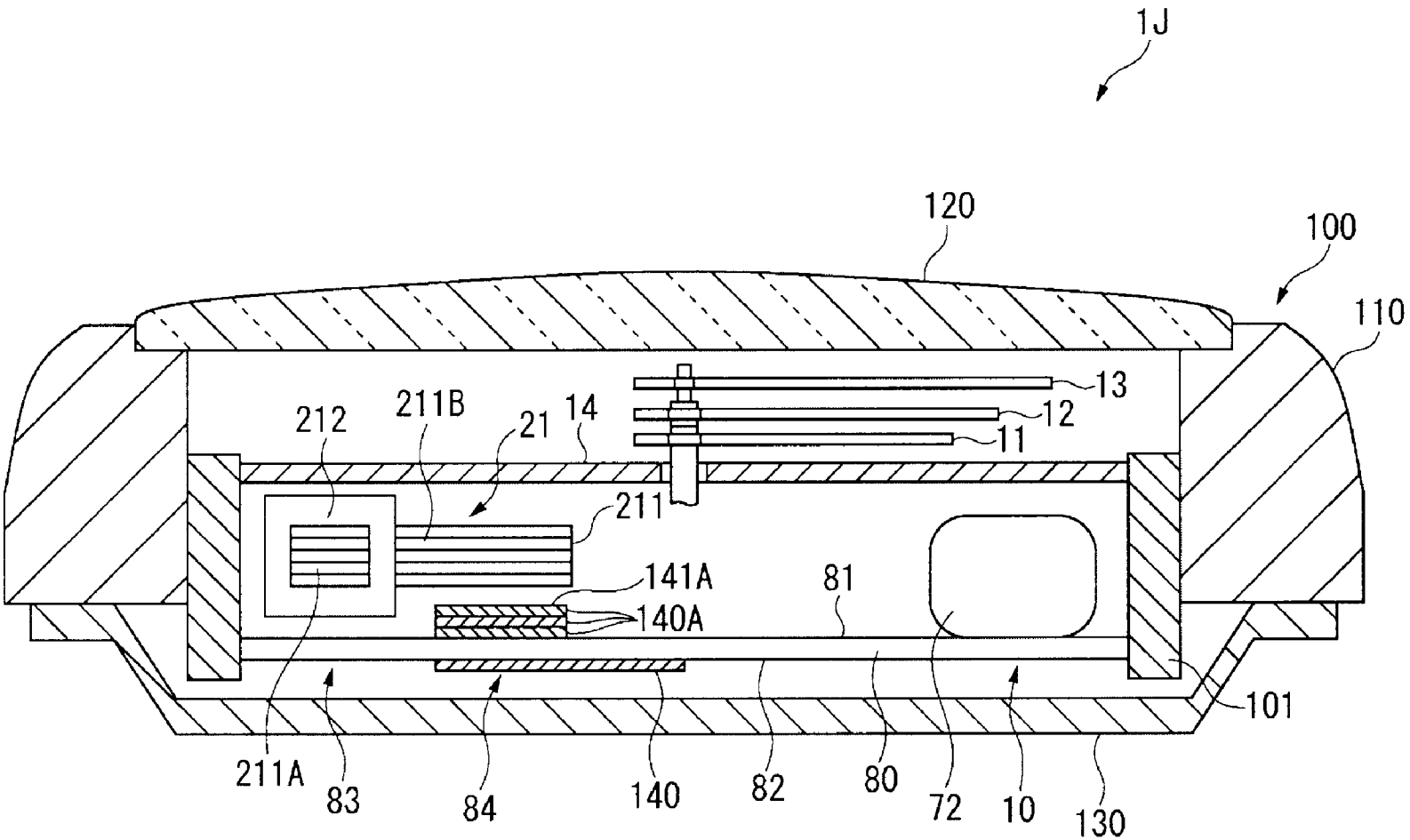
FIG. 32 is a side section view schematically showing a radio-controlled timepiece according to a twelfth embodiment of the invention.

FIG. 32 is a side section view schematically showing a radio-controlled timepiece according to a twelfth embodiment of the invention.

The radio-controlled timepiece 1J according to the twelfth embodiment of the invention is a modification of the radio-controlled timepiece 1G according to the ninth embodiment of the invention.

More specifically, similarly to the ninth embodiment, the radio-controlled timepiece 1J according to the twelfth embodiment of the invention has an amorphous foil member 140 adhesively affixed as a flux collection unit at a position on the back cover side 82 of the circuit board 80 where the amorphous foil member 140 is not superposed to the coil-overlapping area 83 and is superposed to at least a part of the lead-overlapping area 84. In addition, in a part of the lead-overlapping area 84 on the antenna-facing surface 81 of the circuit board 80, an amorphous foil layer 141A is formed as a magnetic field output unit. The amorphous foil layer 141A is formed by stacking a plurality of amorphous foil members 140A as magnetic foil members toward the lead parts 211B. Similarly to the amorphous foil layer 141 in the eleventh embodiment described above, these amorphous foil members 140A are bonded to each other by intervening adhesive layers.

Similarly to the tenth embodiment, a gap of a predetermined size is also positioned between the amorphous foil layer 141A and the lead parts 211B, thereby preventing damage to the amorphous foil layer 141A and lead parts 211B.

Effect of a Radio-Controlled Timepiece According to the Twelfth Embodiment

In the radio-controlled timepiece 1J according to the twelfth embodiment of the invention, an amorphous foil member 140 is adhesively affixed to the back cover side 82 of the circuit board 80 at a position where it is not superposed to the coil-overlapping area 83 and is superposed to at least a part of the lead-overlapping area 84, and an amorphous foil layer 141A is formed in a part of the lead-overlapping area 84 on the antenna-facing surface 81 of the circuit board 80 by stacking a plurality of amorphous foil members 140A toward the lead parts 211B.

As a result, as described in the first to eleventh embodiments, ambient magnetic flux lines can be desirably collected in the amorphous foil member 140, and the magnetic flux lines collected in the amorphous foil member 140 can be output to the lead parts 211B from the amorphous foil layer 141A formed toward the lead parts 211B. More specifically, more magnetic flux lines collected in the amorphous foil member 140 can be guided into the lead part 211B, and the flux density of the antenna 21 can also be increased. The reception sensitivity of the antenna 21 can therefore be further improved, and antenna performance can be further improved.

Furthermore, because the amorphous foil layer 141A is formed only in a part of the lead-overlapping area 84 on the antenna-facing surface 81, the amorphous foil layer 141A does not interfere with other circuit elements on the circuit board 80 or impinge on the space available for installing other parts inside the module 10, such as the clockwork parts forming the movement. The performance of the antenna 21 can therefore be improved without increasing the size of the radio-controlled timepiece 1J.

Embodiment 13

A radio-controlled timepiece 1K according to a thirteenth embodiment of the invention is described next with reference to the accompanying figures.

Figure 33:
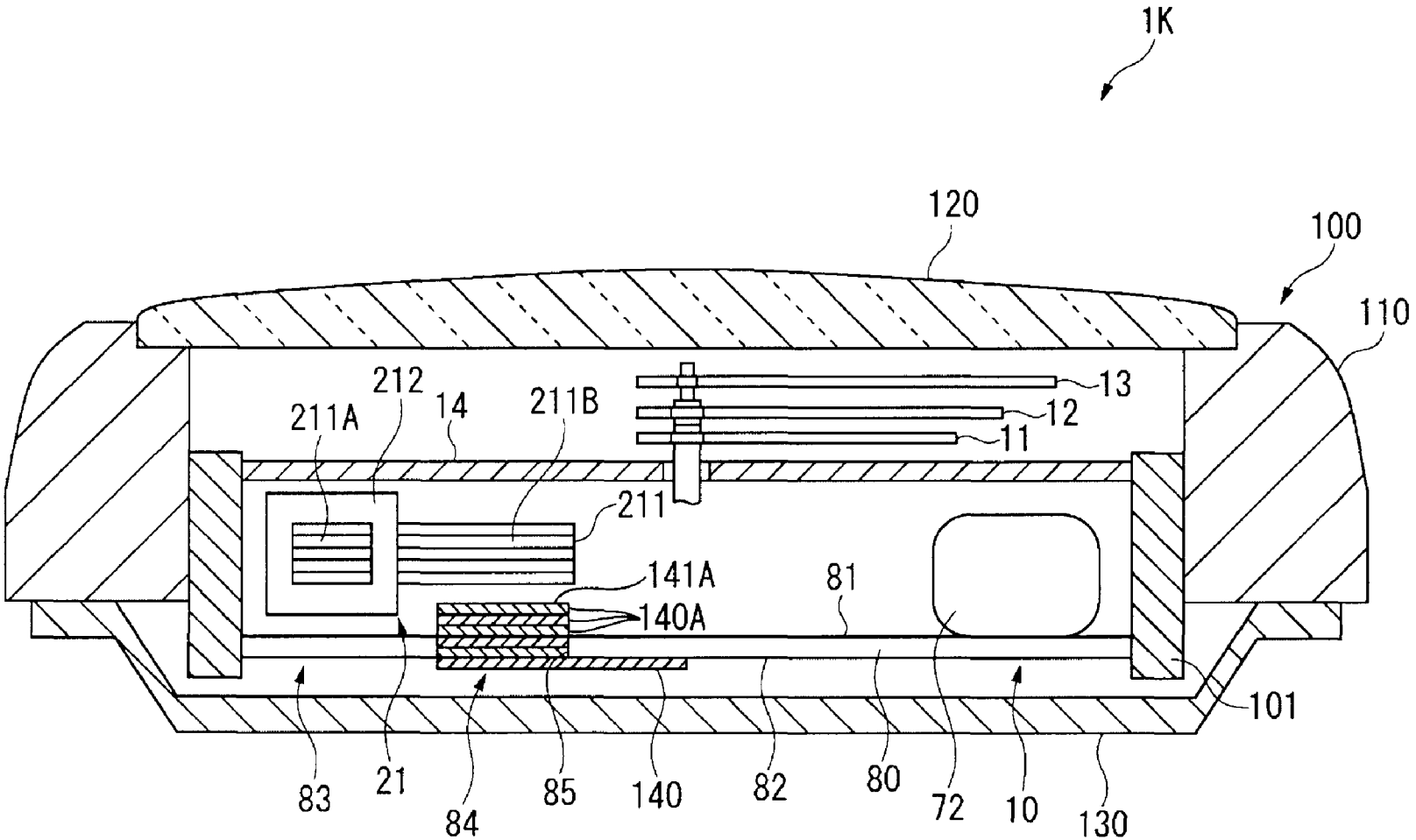
FIG. 33 is a side section view schematically showing a radio-controlled timepiece according to a thirteenth embodiment of the invention.

FIG. 33 is a side section view schematically showing a radio-controlled timepiece according to a thirteenth embodiment of the invention.

The radio-controlled timepiece 1K according to the thirteenth embodiment of the invention is a modification of the radio-controlled timepiece 1J according to the twelfth embodiment of the invention.

More specifically, the radio-controlled timepiece 1K according to the thirteenth embodiment of the invention has a through-hole 85 passing through the antenna-facing surface 81 and the back cover side 82 in a part of the lead-overlapping area 84 of the circuit board 80.

As in the twelfth embodiment, an amorphous foil member 140 is adhesively affixed at a position on the back cover side 82 of the circuit board 80 where the amorphous foil member 140 is not superposed to the coil-overlapping area 83 and is superposed to at least a part of the lead-overlapping area 84. In this thirteenth embodiment of the invention the amorphous foil member 140 forms the flux collection unit of the invention.

In addition, an amorphous foil layer 141A formed by stacking a plurality of amorphous foil members 140A is positioned in this through-hole 85 in the circuit board 80 projecting toward the lead parts 211B. The amorphous foil layer 141A is formed passing through the through-hole 85 with the end on the back cover 130 side adhesively affixed in contact with the amorphous foil member 140. As in the twelfth embodiment, a gap of a predetermined size is formed between the amorphous foil layer 141A and the lead parts 211B to prevent damage to the amorphous foil layer 141A and lead parts 211B.

Effect of a Radio-Controlled Timepiece According to the Thirteenth Embodiment As described above, a through-hole 85 is formed in a part of the lead-overlapping area 84 through the circuit board 80 in the radio-controlled timepiece 1K according to the thirteenth embodiment of the invention. An amorphous foil member 140 is adhesively affixed at a position on the back cover side 82 of the circuit board 80 where the amorphous foil member 140 is not superposed to the coil-overlapping area 83 and is superposed to at least a part of the lead-overlapping area 84, and an amorphous foil layer 141A forming by stacking amorphous foil members 140A is positioned in the through-hole 85 of the circuit board 80 touching the amorphous foil member 140.

As a result, ambient magnetic flux lines can be desirably collected in the amorphous foil member 140, and the magnetic flux lines collected in the amorphous foil member 140 can be output from the amorphous foil layer 141A to the lead parts 211B. Because the amorphous foil member 140 and the amorphous foil layer 141A are in contact with each other, the magnetic flux lines move desirably to the amorphous foil layer 141A with no magnetic flux line loss when the flux lines are guided from the amorphous foil member 140 to the amorphous foil layer 141A. Output of magnetic flux lines from the amorphous foil layer 141A to the lead parts 211B thus increases, and the performance of the antenna 21 can be yet further improved.

Other Embodiments of the Invention

The invention is not limited to the embodiments described above and can be modified and improved in many ways without departing from the scope of the invention.

For example, a foil member made of a ferromagnetic amorphous metal is used as the magnetic member in the embodiments described above, but the invention is not so limited. For example, any magnetic member with permeability that is higher than the permeability of the dial 14 and solar cell 15, for example, may be used, and the position to which the magnetic member is affixed on the dial 14, back cover 130, or circuit board 80 may be suitably determined according to the configuration thereof.

The position to which the amorphous foil member 140 is positioned is also not limited to the foregoing embodiments, and the amorphous foil member 140 can be extended to increase its area if it is located in a position where it is not superposed on the coil-overlapping area 104 or date wheel 160 and is superposed at least in part on the lead-overlapping area.

In addition, a pair of amorphous foil members 140 corresponding to the pair of lead parts 211B are positioned in the embodiments described above, but a configuration having only a single amorphous foil member 140 positioned on only one of the pair of lead parts is also conceivable. This configuration improves antenna performance compared with a configuration that does not have the amorphous foil member 140.

The radio-controlled timepiece 1B according to the third embodiment of the invention describes a configuration having a through-hole 102B in the base plate 102 and an amorphous foil layer 141A stacked in this through-hole 102B, but the invention is not so limited. For example, the amorphous foil members 140A may be positioned on the lead-facing area of the base plate 102 opposite the lead parts without forming a through-hole 102B in the base plate 102. In this configuration magnetic flux lines can pass from the amorphous foil member 140 adhesively affixed to the dial-side surface 103 through the amorphous foil members 140A into the lead parts 211B.

In addition, an amorphous foil member 140 is described as the magnetic member in the first to fourth embodiments, but the invention is not so limited. For example, the magnetic member may be formed by a configuration formed from a ferrite material, a configuration having a ferrite coating, or a plastic sheet to which an amorphous metal or other magnetic member is positioned. Particularly when a gap 163 is formed as described in the fourth embodiment, the magnetic member can be formed to a thickness enabling it to be positioned in this gap 163, and a relatively thick member such as a plastic sheet can be used in this configuration.

The amorphous foil member 140 is positioned on the base plate 102 in the first to fourth embodiments, but the amorphous foil member 140 may alternatively be positioned on the dial 14 or the solar cell 15. More specifically, the location of the coil-overlapping area 104 is not particularly limited insofar as it is not superposed on the coil-overlapping area 104 and is superposed to at least part of the lead-overlapping area 105 when seen in plan view.

For example, if a wheel train bridge supporting a date wheel is positioned between the dial 14 and the base plate 102, the amorphous foil member 140 may be positioned on this wheel train bridge, or the amorphous foil member 140 may be located in any position not superposed with the coil-overlapping area 104 in the area surrounded by the surface area closest to the lead parts 211B on the back side of the dial 14 and the surface area closest to the lead parts 211B on the dial-side surface 103 of the base plate 102.

The solar cell 15 is affixed to the back side of the dial 14 in the foregoing embodiments, but the invention is not so limited and a configuration not having a solar cell 15 is also conceivable.

Furthermore, in the seventh and eighth embodiments the amorphous foil layers 141, 143 are located in the same position as the amorphous foil member 140 in the fifth embodiment, but these amorphous foil layers 141, 143 may be located in the same position as the amorphous foil member 140 in the sixth embodiment or as shown in FIG. 20.

The back cover 130 is made of metal in the embodiments described above, but it may be made of glass or other non-conductive material. This enables standard time signals to enter from the back cover 130 side, enables standard time signals entering from the back cover 130 side to be desirably picked up by the amorphous foil member 140 and received by the antenna 21, and thus further improves the reception sensitivity of the antenna 21.

Figure 34:
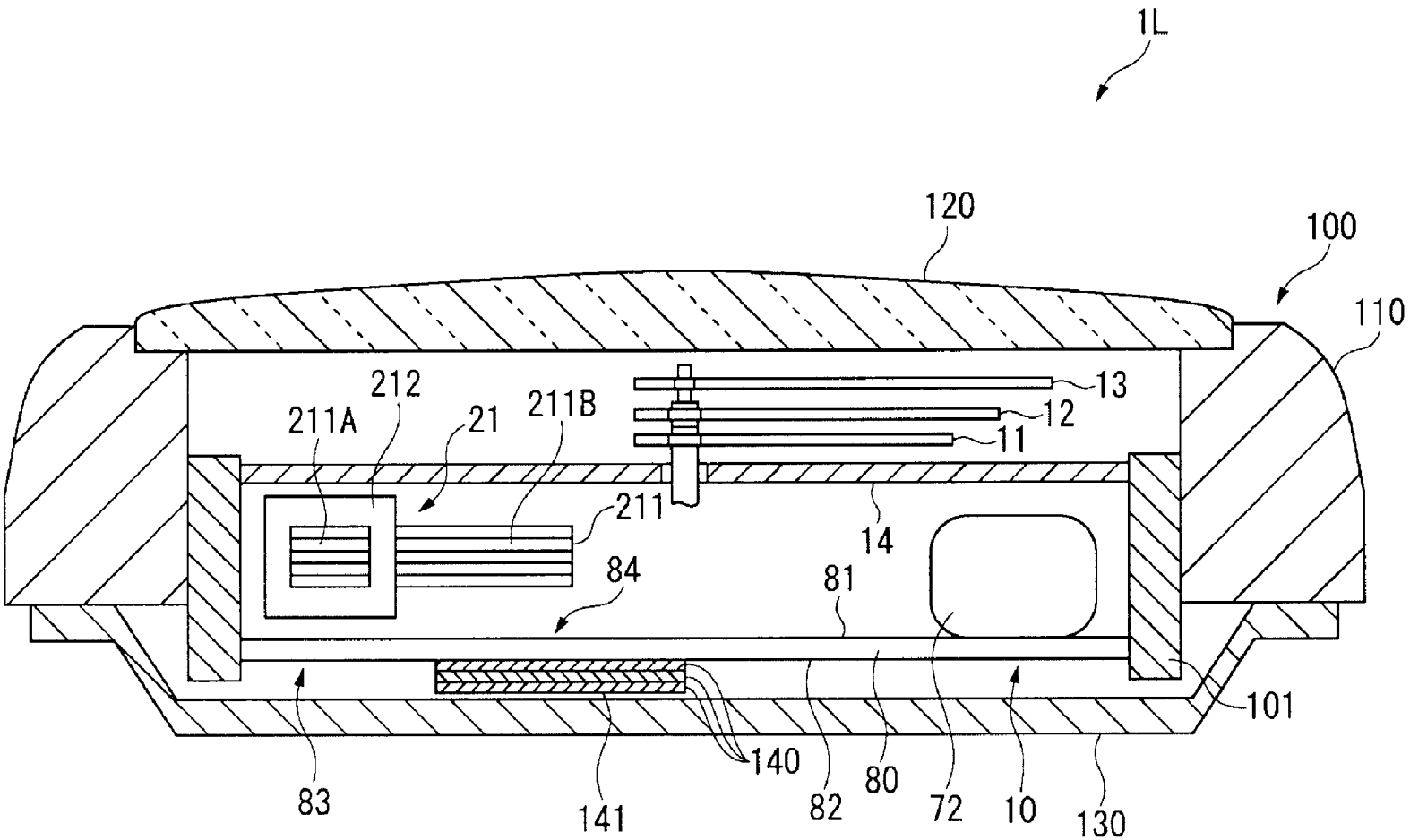
FIG. 34 is a side section view schematically showing a radio-controlled timepiece according to yet another variation of the invention.

In the eleventh embodiment of the invention an amorphous foil layer 141 is formed by stacking amorphous foil members 140 on the antenna-facing surface 81 of the circuit board 80, but the invention is not so limited. For example, as in the radio-controlled timepiece 1L shown in FIG. 34, the amorphous foil layer 141 of laminated amorphous foil members 140 may be formed on the back cover side 82 of the circuit board 80. In this configuration the plural amorphous foil members 140 increase the thickness of the amorphous foil layer 141 compared with a configuration having only one amorphous foil member 140, thus further improving flux collection and improving antenna performance.

In the ninth to thirteenth embodiments an amorphous foil member 140 or amorphous foil layer 141, 141A is positioned in each of the pair of lead-overlapping areas 84 corresponding to the pair of lead parts 211B, but the invention is not so limited. For example, the amorphous foil member 140 or amorphous foil layer 141, 141A may be positioned in the lead-overlapping area 84 corresponding to only one of the pair of lead parts 211B. Further alternatively, one of the pair of amorphous foil members 140 may be positioned on the back cover side 82 and the other may be positioned on the antenna-facing surface 81.

Figure 35:
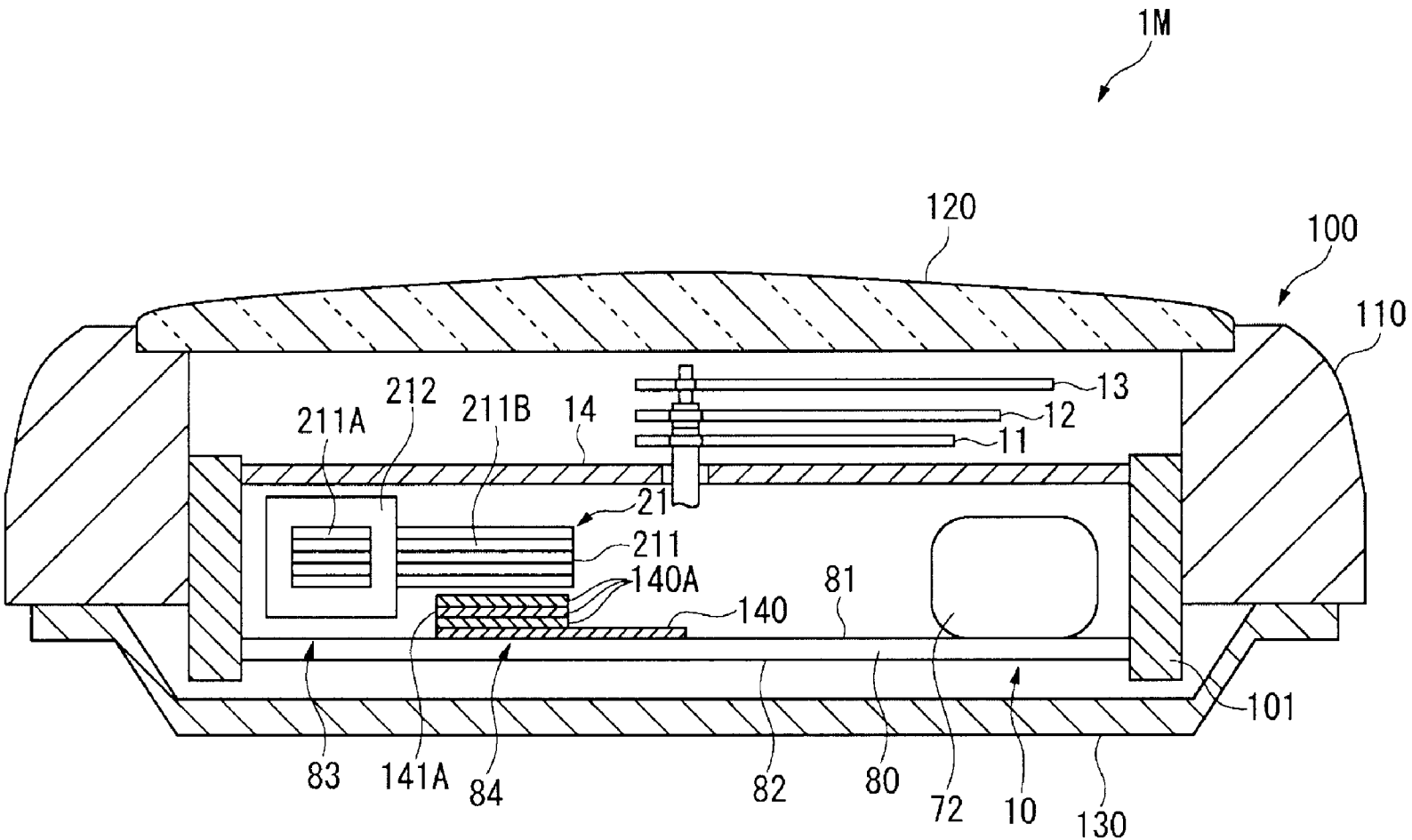
FIG. 35 is a side section view schematically showing a radio-controlled timepiece according to yet another variation of the invention.

An amorphous foil member 140 positioned on the back cover side 82 is described as the flux collection unit in the twelfth and thirteenth embodiments described above, but the invention is not so limited. For example, as shown in the radio-controlled timepiece 1M in FIG. 35, an amorphous foil member 140 may be positioned as the flux collection unit on the antenna-facing surface 81, and the amorphous foil layer 141A may be positioned on top of this amorphous foil member 140.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. An electronic wristwatch timepiece with internal antenna, comprising:

an antenna that has an elongated magnetic core formed from a magnetic body and a coil wound around the magnetic core, and can receive external wireless information, the magnetic core having a coil winding part on which the coil is wound in the lengthwise center part of the magnetic core, and a pair of lead parts extending from both ends of the coil winding part;

a module that houses the antenna and processes the external wireless information; and a magnetic member that is positioned with a predetermined gap between the magnetic member and the lead part at a position that is not superposed on a coil-overlapping area that overlaps the coil winding part of the antenna and is superposed on at least a part of a lead-overlapping area that overlaps the pair of lead parts when the electronic timepiece with internal antenna is viewed in plan view from the timepiece thickness direction of the electronic timepiece with internal antenna.

2. The electronic wristwatch timepiece with an internal antenna described in claim 1, further comprising:

a dial made from a nonconductive material;

wherein the magnetic member has a higher magnetic permeability than the dial and is positioned between the dial and the module.

3. The electronic wristwatch timepiece with an internal antenna described in claim 2, wherein:

the module has a base plate to which the antenna is fastened; and the magnetic member is positioned on the surface of the base plate that faces the dial.

4. The electronic wristwatch timepiece with an internal antenna described in claim 3, wherein:

the base plate comprises a through-hole communicating the lead-side surface opposite the lead parts and the dial-side surface opposite the dial in at least one part opposite the lead parts; and the magnetic member includes a flux collection unit positioned in an area larger than the lead-overlapping area on the dial-side surface of the base plate and covering the through-hole, and a magnetic field output unit that is laminated through the through-hole and projects toward the lead parts from the surface of the flux collection unit opposite the antenna.

5. The electronic wristwatch timepiece with an internal antenna described in claim 2, wherein:

the magnetic member is positioned on the surface of the dial that faces the module.

6. The electronic wristwatch timepiece with an internal antenna described in claim 2, wherein:

the module has a base plate to which the antenna is fastened; and the magnetic member is positioned on the surface of the base plate that faces the dial through an intervening adhesive layer.

7. The electronic wristwatch timepiece with an internal antenna described in claim 2, wherein:

the module has a base plate on which the antenna is positioned, and one or more date wheels positioned on a surface of the base plate opposite the dial for displaying the date in a date display window formed in the dial; and the magnetic member is located in a position that is not superposed on the date wheel between the base plate and the dial.

8. The electronic wristwatch timepiece with an internal antenna described in claim 1, further comprising:

an outside case having a back cover made of metal;

wherein the magnetic member has a higher magnetic permeability than the back cover, and is positioned on the inside surface of the back cover opposite the module.

9. The electronic wristwatch timepiece with an internal antenna described in claim 8, wherein:

the magnetic member is adhesively affixed to the inside surface of the back cover by an intervening adhesive layer.

10. The electronic wristwatch timepiece with an internal antenna described in claim 8, wherein:

the magnetic member is positioned on the inside surface of the back cover through an intervening nonconductive member.

11. The electronic wristwatch timepiece with an internal antenna described in claim 1, wherein:

the module comprises a circuit board on which is positioned a processing circuit unit for executing processes based on external wireless information received by the antenna; and the magnetic member has a higher magnetic permeability than the circuit board and is positioned on the circuit board.

12. The electronic wristwatch timepiece with an internal antenna described in claim 11, wherein:

the magnetic member is adhesively affixed to the circuit board by an intervening adhesive layer.

13. The electronic wristwatch timepiece with an internal antenna described in claim 11, wherein:

the magnetic member is positioned on the antenna side of the circuit board opposite the antenna.

14. The electronic wristwatch timepiece with an internal antenna described in claim 11, further comprising:

an outside case that houses the antenna and the circuit board, the outside case including a back cover;

the circuit board being positioned between the antenna and the back cover; and the magnetic member being positioned on the back cover side of the circuit board opposite the back cover.

15. The electronic wristwatch timepiece with an internal antenna described in claim 11, wherein:

the magnetic member includes a flux collection unit positioned in an area larger than the lead-overlapping area when seen in plan view, and a magnetic field output unit that is formed by laminating a plurality of magnetic foil members toward the lead parts at a position superposed on a part of the lead-overlapping area when seen in plan view.

16. The electronic wristwatch timepiece with an internal antenna described in claim 15, further comprising:

an outside case that houses the antenna and the circuit board, the outside case including a back cover;

the circuit board being positioned between the antenna and the back cover;

the flux collection unit being positioned on the back cover side of the circuit board opposite the back cover; and the magnetic field output unit being positioned on the antenna side of the circuit board opposite the antenna.

17. The electronic wristwatch timepiece with an internal antenna described in claim 16, wherein:

the circuit board comprises a through-hole passing from the antenna side to the back cover side in at least a part of the lead-overlapping area;

the flux collection unit is positioned on the back cover side of the circuit board covering the through-hole; and the magnetic field output unit protrudes through the through-hole toward the lead part from the surface of the flux collection unit facing the antenna.

18. The electronic wristwatch timepiece with an internal antenna described in claim 1, wherein:

the magnetic member is an amorphous foil member made from an amorphous metal.

19. The electronic wristwatch timepiece with an internal antenna described in claim 1, wherein:

the magnetic member is formed in a larger area than the lead-overlapping area when seen in plan view.

20. The electronic wristwatch timepiece with an internal antenna described in claim 1, wherein:

the magnetic member is composed of a plurality of layers.

* * * * *